US009150378B2

(12) United States Patent
Shimura et al.

(10) Patent No.: US 9,150,378 B2
(45) Date of Patent: Oct. 6, 2015

(54) SHEET STACK TRAY HAVING SHEET PRESSURIZING MEMBER

(71) Applicants: Kazuhito Shimura, Yamanashi-ken (JP); Seiji Ono, Yamanashi-ken (JP); Makoto Shimizu, Yamanashi-ken (JP); Akira Sugiyama, Yamanashi-ken (JP)

(72) Inventors: Kazuhito Shimura, Yamanashi-ken (JP); Seiji Ono, Yamanashi-ken (JP); Makoto Shimizu, Yamanashi-ken (JP); Akira Sugiyama, Yamanashi-ken (JP)

(73) Assignees: RISO KAGAKU CORPORATION, Tokyo (JP); NISCA CORPORATION, Minamikoma-gun, Yamanashi-ken (JP)

( * ) Notice: Subject to any disclaimer, the term of this patent is extended or adjusted under 35 U.S.C. 154(b) by 119 days.

(21) Appl. No.: 14/012,437

(22) Filed: Aug. 28, 2013

(65) Prior Publication Data

US 2014/0061993 A1 Mar. 6, 2014

(30) Foreign Application Priority Data

Aug. 31, 2012 (JP) ..... 2012-191418
Aug. 31, 2012 (JP) ..... 2012-191420
Oct. 22, 2012 (JP) ..... 2012-233228

(51) Int. Cl.
*B65H 37/04* (2006.01)
*B65H 39/00* (2006.01)
*B65H 7/20* (2006.01)
(Continued)

(52) U.S. Cl.
CPC ..... *B65H 39/00* (2013.01); *B65H 7/20* (2013.01); *B65H 29/52* (2013.01); *B65H 31/10* (2013.01); *B65H 31/14* (2013.01); *B65H 31/18* (2013.01); *B65H 31/3027* (2013.01); *B65H 31/34* (2013.01); *B65H 39/10* (2013.01); *B65H 85/00* (2013.01); *B65H 2301/42192* (2013.01); *B65H 2403/51* (2013.01); *B65H 2404/61* (2013.01); *B65H 2404/63* (2013.01); *B65H 2404/691* (2013.01); *B65H 2404/693* (2013.01); *B65H 2511/152* (2013.01); *B65H 2511/212* (2013.01); *B65H 2511/222* (2013.01); *B65H 2511/415* (2013.01); *B65H 2511/514* (2013.01); *B65H 2553/612* (2013.01); *B65H 2553/83* (2013.01); *B65H 2601/26* (2013.01); *B65H 2601/321* (2013.01); *B65H 2701/18292* (2013.01); *B65H 2801/27* (2013.01)

(58) Field of Classification Search
CPC ..... B65H 37/04; B65H 39/00; B65H 7/20
USPC ..... 270/58.08, 58.09, 58.11, 58.12; 399/410
See application file for complete search history.

(56) References Cited

U.S. PATENT DOCUMENTS 6,142,469 A * 11/2000 Nanba et al. ..... 271/288
6,244,583 B1 * 6/2001 Ohmichi et al. ..... 270/58.09
(Continued)

FOREIGN PATENT DOCUMENTS

JP 2002-012362 A 1/2002
JP 3752172 B2 3/2006
(Continued)

*Primary Examiner* — Patrick Mackey
(74) *Attorney, Agent, or Firm* — Manabu Kanesaka

(57) ABSTRACT

In an apparatus structure having a sheet discharge mode to store sheets at a stack tray from a sheet discharging path and a sheet discharge mode to store binding-processed sheet bundles with collating and stacking, sheet holding means is arranged above a sheet placement face of the stack tray as a sheet pressurization force being variable in two steps, and then, the pressurization force of the sheet holding means is adjusted in two steps in accordance with the sheet discharge mode for storing sheets at the stack tray.

18 Claims, 26 Drawing Sheets

(51) Int. Cl.

| | |
|---|---|
| ***B65H 29/52*** | (2006.01) |
| ***B65H 31/10*** | (2006.01) |
| ***B65H 31/14*** | (2006.01) |
| ***B65H 31/18*** | (2006.01) |
| ***B65H 31/30*** | (2006.01) |
| ***B65H 31/34*** | (2006.01) |
| ***B65H 39/10*** | (2006.01) |
| ***B65H 85/00*** | (2006.01) |

(56) References Cited

U.S. PATENT DOCUMENTS

| | | | | |
|---|---|---|---|---|
| 6,290,220 | B1 * | 9/2001 | Takehara et al. | 270/58.12 |
| 6,375,181 | B1 * | 4/2002 | Kawano et al. | 270/58.12 |
| 6,601,846 | B2 * | 8/2003 | Saito et al. | 271/226 |
| 7,014,183 | B2 * | 3/2006 | Tamura et al. | 270/58.09 |
| 7,172,186 | B2 * | 2/2007 | Saito et al. | 270/58.08 |
| 8,678,368 | B2 * | 3/2014 | Yoshida | 270/58.13 |
| 8,870,175 | B2 * | 10/2014 | Gamo | 270/58.09 |
| 8,870,177 | B2 * | 10/2014 | Tanaka | 270/58.11 |
| 2010/0150636 | A1 * | 6/2010 | Kubota et al. | 399/407 |
| 2011/0091260 | A1 * | 4/2011 | Azuma et al. | 399/410 |
| 2014/0061991 | A1 * | 3/2014 | Shimura et al. | 270/1.01 |

FOREIGN PATENT DOCUMENTS

| | | | |
|---|---|---|---|
| JP | 4057233 | B2 | 3/2008 |
| JP | 2009-035371 | A | 2/2009 |

* cited by examiner

| | Sensor 1 | Sensor 2 | Sensor 3 |
|---|---|---|---|
| (Ⅰ) Straight sheet discharging at appropriate tray height | ON | ON | |
| (Ⅱ) Straight sheet discharging at high tray height | OFF | ON | |
| (Ⅲ) Straight sheet discharging at low tray height | ON | OFF | |
| (Ⅳ) Sheet bundle discharging at appropriate tray height | ON | | ON |
| (Ⅴ) Sheet bundle discharging at high tray height | ON | | OFF |
| (Ⅵ) Sheet bundle discharging at low tray height | OFF | | ON |

SHEET STACK TRAY HAVING SHEET PRESSURIZING MEMBER

BACKGROUND OF THE INVENTION

1. Field of the Invention

The present invention relates to a sheet storing apparatus which stores sheets having images formed thereon by an image forming apparatus at a stack tray directly or after performing a binding process with collating and stacking.

2. Description of Related Arts

In general, in such a sheet storing apparatus, an image sheet fed out from a main body apparatus such as an image forming apparatus is guided to a sheet discharging path and is stored at a stack tray which is arranged downstream of the sheet discharging path. Then, a lifting mechanism is arranged to lift and lower the stack tray in a stacking direction in accordance with a stacked amount of sheets. Further, a stack level detecting mechanism which detects a height position of the upmost sheet stacked on the stack tray is arranged to control the lifting mechanism.

For example, Japanese Patent Application Laid-Open No. 2009-035371 (Patent Document 1) discloses a sheet storing apparatus in which a sheet having an image formed thereon by an image forming apparatus is conveyed to a post-processing apparatus arranged downstream of a sheet discharging port and is stored at a stack tray arranged in the apparatus.

In Patent Document 1, the storing apparatus includes a sheet introducing path which introduces a sheet from the image forming apparatus, a processing tray which is arranged downstream of the sheet introducing path, and a stack tray which is arranged downstream of the processing tray. The processing tray is provided with an aligning mechanism which performs positioning of a sheet through a sheet discharging port to a predetermined processing position with switching-back, and a stapling unit which binds collated and stacked sheets.

Further, the stack tray is located downstream of the above-mentioned sheet introducing path and is provided with a tray member which is located downstream of the processing tray and a lifting-lowering mechanism which lifts and lowers the tray member in the stacking direction.

Then, a sheet discharging path for discharging a sheet directly to the stack tray from the introducing path (print-out discharging) and a sheet discharging path for discharging a sheet bundle binding-processed at the processing tray (staple-binding discharging) are formed in accordance with a mode specified by the main body (a copying machine, a computer apparatus, or the like).

With such a sheet storing mechanism to lift and lower the stack tray in accordance with a stacked amount of sheets, it is required to detect a height level of the upmost sheet on the stack tray.

As such a level detecting mechanism, there have been known a configuration to perform the detection while a sensor detects a height position of a sheet holding member which is arranged to be movable between an operation position above the stack tray and a waiting position outside the stack tray and a configuration to include, at a side above tray, a light emitting element which radiates beam light to path through the sheet discharging path and a light receiving element which receives the light.

In Japanese Patent No. 4057233 (Patent Document 2), a sheet discharged from an image forming apparatus is stored at a stack tray while being provided with a mechanism to detect a height position of stacked sheets with a sheet-contact lever and a photo-sensor which detects an angle position of the sheet-contact lever and a conveying rotor which performs aligning by causing sheets discharged through a sheet discharging port to be abutted to a sheet end reference face of the stack tray. Here, a rotation force is transmitted to the conveying rotor so that a tailing end of a sheet fed by a sheet discharging roller is drawn to the reference face of the stack tray.

Further, in such an apparatus, there has been widely known a sheet storing apparatus having a jog function to perform storing with offsetting of a sheet discharging path or a storage tray by a predetermined amount in a direction perpendicular to a sheet discharging direction, when a sheet is to be stored at a storage tray arranged at the downstream side from the sheet discharging path.

For example, Japanese Patent Application Laid-Open No. 2002-012362 (Patent Document 3) discloses a sheet storing apparatus which stores a sheet from a sheet discharging path to a processing tray and a jog mechanism which offsets a stack tray by a predetermined amount laterally in a direction perpendicular to the sheet discharging direction while being capable of vertically moving the stack tray in the stacking direction.

In a sheet storing apparatus including a lifting-lowering mechanism and a jog mechanism of a stack tray as described above, the lifting-lowering mechanism is controlled to detect a height level of sheets stored at the stack tray, and when the height level arrives at a predetermined value, to lower the sheet height level by lowering the stack tray.

Further, when a jogging operation is mode-selected by an upstream apparatus (e.g., an image forming apparatus, or the like) and a sheet discharge instruction signal for the first sheet is received, the stack tray is controlled to be moved in the sheet width direction.

In such an apparatus configuration, there is a case that instruction signals for a tray lifting operation and a jogging operation are concurrently provided. There is no disclosure about execution timing of the tray lifting-lowering operation and the tray jogging operation with the apparatus in Patent Document 3.

Regarding execution timing of co-occurring operations, for example, when an operator removes stacked sheets from the stack tray, the apparatus performs the lifting operation of the stack tray as detecting the height level of sheets. When a sheet is discharged through a sheet discharging port at that time, there is a case that the sheet falls outside the stack tray.

Further, during an operation in a jog mode, a jog instruction signal of continuously-discharged sheets is provided and a sheet is discharged thereafter.

In a conventional apparatus, when stacked sheets are carelessly removed from a stack tray, based on detection of the above by a level sensor, a sheet discharging operation is restarted after the stack tray is lifted to an appropriate position with the sheet discharging operation stopped.

In general, such an image forming system configuration has been known as a system which stores sheets having images formed thereon in a duplex manner by an image forming unit at a downstream stack tray after performing a post-process as stacking the sheets to a processing tray which is arranged at a post-processing unit.

In such a system, there has been known a system configuration in which a post-processing unit is arranged above an image forming unit and the post-processing unit includes a stack tray and a guide tray of a duplex path for duplex printing at the upper and lower sides thereof, as disclosed in Japanese Patent No. 3752172 (Patent Document 4), for example.

Patent Document 4 also discloses a system configuration including a duplex path on which a sheet having an image formed at one side by an image forming unit is temporarily discharged to the post-processing unit and is fed again to the image forming portion as being switched back.

Patent Document 4 proposes an apparatus structure in which an post-processing apparatus is arranged above an image forming apparatus, the stack tray of the post-processing apparatus is structured with a lifting-lowering tray which vertically moves in a stacking direction, and a switch-back path for face-reversing a sheet fed from the image forming portion is formed below the vertically-moving lifting-lowering tray.

In Patent Document 4, the guide tray which forms the switch-back path is formed at a wide angle inclined gentler than a sheet placement face of the stack tray. Further, Patent Document 4 discloses a mechanism with which a sheet fed from the image forming apparatus is face-reversed at the switch-back path located at the lower side and the stack tray is lifted and lowered at the upper side.

SUMMARY OF THE INVENTION

As described above, there has been known an apparatus having a sheet discharge mode in which sheets are discharged from the sheet discharging path directly to the stack tray vertically moving in the stacking direction and a sheet discharge mode in which sheets are stored at the stack tray after having a binding process performed thereon as collating and stacking the sheets to the processing tray from the sheet discharging path. Further, there has been known a mechanism which detects a height level of stacked sheets on the stack tray in the above case, for example, as disclosed in Patent Document 1 or the like.

Here, in a case that bound sheet bundles are stored at a sheet placement tray while staple-binding positions are aligned, there arises a problem that staple needle portions are swelled like a heaping manner. The swelling of the staple needle portions cause a problem of detection accuracy of a level sensor mechanism which detects a tray height position.

For example, height positions of stacked sheets on a sheet placement face are different between a case that sheets are stored one by one from the sheet discharging path onto the stack tray and a case that staple-bound sheet bundles are stored from the processing tray.

Further, when a sheet bundle is staple-bound, sheet swelling states are greatly different between a case that binding is performed at a corner thereof and a case that binding is performed at two positions of the center thereof.

Further, when sheets are to be stored one by one at the stack tray, intervals thereof are set short. When staple-bound sheet bundles are to be stored, intervals thereof are set relatively long.

Conventionally, as proposed in Patent Document 2, the sheet face height position is detected by a sensor lever which reciprocates between a detecting position above the sheet placement tray and a retracting position retracted therefrom.

Accordingly, when a pressurization force to press an upper face of stacked sheets by the sensor lever is set low, detection accuracy of staple-bound sheet bundles is drastically deteriorated, so that operational errors such as sheet jamming and tray height position errors due to false detection are caused.

In contrast, when the pressurization force of the sensor lever is set high, there arises a problem that the sensor lever does not operate in time for introducing a subsequent sheet in a sheet discharge mode to store a single sheet.

This is because, for example, operational time becomes long owing to that a sheet pressing member deeply depresses the upper face when staple-bound sheets are stacked on the tray.

Then, the present inventors have come up with an idea that the pressurization force of sheet holding means when detecting the sheet face height is adjusted to be high and low being the first and second in accordance with the sheet discharge mode of sheets stored on the stack tray.

Firstly, the present invention provides a sheet storing apparatus capable of accurately detecting stacked height of sheets on the stack tray with an apparatus structure having the sheet discharge mode to store sheets at the stack tray from the sheet discharging path and the sheet discharge mode to store sheet bundles bound as being collated and stacked.

Then, with a sheet discharging mechanism having a stack tray lifting-lowering mechanism and a jog mechanism, a tray lifting operation is to be preferentially performed for controlling the tray lifting operation and a jogging operation.

For example, when a user carelessly removes a sheet from the stack tray, the apparatus is stopped and subsequent sheet discharging operation is prohibited based on detection of the above by the level sensor. The stack tray is lifted to a predetermined height position after the sheet discharging operation is prohibited (a jam signal), and then, the subsequent sheet discharging operation is restarted as sending a jam releasing signal based on a detection signal of the above by the level sensor.

In such a control configuration, when a careless operation such as an operation to remove sheets from the tray is performed, it is forced to perform an operation to remove a sheet existing at a midway as a jammed sheet after stopping the apparatus at the upstream side.

Thus, when such an unexpected operation is once performed, there arises a problem that time is required to restart the apparatus with complicated operations for restarting the apparatus.

In consideration of the above, the present inventors have come up with an idea that the tray jogging operation and the sheet discharging operation are to be performed preferentially and simultaneously when a jog instruction signal is sent even when the stack tray is not at a predetermined height position.

According to the above, the sheet discharging operation can be performed without stopping an upstream apparatus for image forming or the like.

Secondary, the present invention provides s sheet storing apparatus capable of being effectively operated as a system, with the sheet discharging apparatus having the tray lifting-lowering function and the tray jogging operation, without stopping the upstream apparatus even when an inappropriate position is detected in tray height detection.

As described above, there has been disclosed an apparatus structure, in Patent Document 4 and the like, in which a post-processing unit is arranged above an image forming unit and a duplex path for face-reversing a sheet is arranged at the post-processing unit while a processing tray and a stack tray are arranged thereat.

With such an apparatus, there have been known a case in which the stack tray is arranged at the post-processing unit as being capable of being lifted and lowered and the duplex path is built in the unit and a case in which a sheet is conveyed as being switched-back on a supporting face of a guide tray which is arranged extendedly from the unit.

Here, there arises a problem with the duplex conveying mechanism in which the guide tray is arranged below the stack tray as proposed in Patent Document 4.

According to a layout configuration in which the stack tray is arranged at the upper side in a manner capable of being vertically moved and the guide tray for duplex conveyance is arranged therebelow, a sheet regulating face is required to be arranged long to the lower side for increasing a stack amount of the stack tray. Accordingly, there arises a problem that friction and the like occur owing to contacting between the sheet regulating face and a sheet which is switched-back on the guide tray.

Further, it is dangerous when the stack tray is lowered in a state that a foreign matter exists on the guide tray. Furthermore, when a user pulls out a sheet fed on the guide tray, sheet jam is caused thereby.

According to study of the present inventors, the above problem depends on a tray angle between the guide tray and the stack tray.

Conventionally, as disclosed in Patent Document 4, the guide tray located at the lower side is arranged to have a gentle inclination angle being close to horizontal and the stack tray located thereabove is arranged to have a sharper inclination angle than the guide tray.

Here, a large space widely opened to the outside is formed between the stack tray located at the upper side and the guide tray located at the lower side. When sheet conveyance error occurs at the guide tray located at the lower side, there is a possibility that a user causes a foreign matter to proceed thereto by mistake without relating to (without recognizing) a lowering operation of the stack tray located at the upper side.

Further, since a sheet under a duplex operation is discharged into the widely-opened space which is formed toward the outside between both the trays, a false operation is caused to pull out the sheet regarding as an image-formed sheet by mistake.

According to the above, the present inventors have come up with an idea, in arrangement of the guide tray below the lifting and lowering stack tray, that a base end portion of the guide tray is formed to have a gentler angle than an inclination angle of the stack tray and a top end portion of the guide tray is formed sharper than the base end portion of the guide tray so as to incline the tray to lessen a space in which a user may put a foreign matter or the like.

Thirdly, the present invention provides an image forming system which does not cause a false operation to pull out a sheet during conveyance with smooth and safe sheet conveyance with arrangement of the guide tray to guide a duplex sheet below the lifting and lowering stack tray.

For the abovementioned first issue, in the present invention, the sheet holding means is arranged above the sheet placement face of the stack tray to apply a different sheet pressurization force while the pressurization force is adjusted in accordance with a sheet discharge mode for feeding a sheet to the stack tray. According to the above, following effects are obtained.

Stacked states of sheets stacked on the sheet placement face are largely different between a non-stapled state and a stapled state. In the present invention, since swelling of sheets is large in the stapled state especially with double center binding, the sheet holding means strongly presses the upmost sheet and the sheet height position is detected in that state.

In contrast, in the non-stapled state, the height position is detected in a state that the upmost sheet is weakly pressed.

According to the above, a sheet thickness of staple-bound sheets can be reliably detected with a large pressurization force even when multi-layer inter-sheet spaces exist. Further, for non-stapled sheets, since the sheet holding means can be operated at high speed with a small pressurization force between the waiting position and the detecting position, introducing of a subsequent sheet is not disturbed.

Further, in the present invention, owing to that the height position is detected in a state that the sheet holding member engages with the upmost sheet, the sheet holding member and the height detecting member are not required to be separately arranged. Accordingly, the detecting mechanism can be simplified.

Further, in the present invention, owing to that the sheet holding member is structured with a frictional rotor such as a roller and rotation to apply a conveyance force to a sheet toward the regulating face is transmitted to the frictional rotor, it is possible to perform sheet pressing and correction of the height position and the posture thereof with the same mechanism.

For the abovementioned second issue, in the present invention, when an offset signal is transmitted during a tray lifting operation, controlling of the lifting-lowering operation and the jog shifting operation of the stack tray is performed so that the jog shifting operation of the tray sheet placement face is performed preferentially to or simultaneously with the tray lifting. According to the above, following effects are obtained.

Even when a sheet discharge signal and a jog shift signal are received during lifting operation of the stack tray toward a predetermined position, the sheet discharging operation can be continuously performed without stopping operations of the upstream apparatus. Accordingly, processes can be performed effectively.

That is, even when a jog shift signal is transmitted during the tray lifting operation, control means receiving the signal performs the jog shifting operation of the tray sheet placement face preferentially to or simultaneously with the tray lifting.

Further, in the present invention, the sheet holding means is configured so that a pressurization force to press a sheet face is adjustable in two steps for detecting the height position of sheets stacked on the tray and the sheet holding means is set to provide a small pressurization force during performing the jog sheet discharge mode. Accordingly, even when the sheet placement face is jog-shifted in a direction being perpendicular to the sheet discharging direction during the tray lifting operation, it is possible to suppress a fear that sheets placed on the tray are deviated in position.

For the abovementioned third issue, in the present invention, a guide tray which guides a duplex sheet is arranged below the stack tray. The sheet placement face of the stack tray is set at a first inclination angle and the supporting face of the guide tray is formed in a continuous shape having a second inclination angle and a third inclination angle. Here, with reference to the sheet regulating face of the stack tray, the inclination angles are set in ascending order in the order of the third, the first, and the second inclination angles. According to the above, following effects are obtained.

Since the guide tray has a shape in which the sharp third angle is continued from the gentle second angle with respect to the inclination angle of the lifting and lowering stack tray, a lifting-lowering range of the stack tray can be set large.

That is, with respect to the base end portion of the stack tray set to have the first inclination angle, the guide tray located therebelow is formed to have a gentle inclination angle being larger than the first inclination angle. Accordingly, the lifting-lowering range of the stack tray can be set relatively large without interference in space with the guide tray.

Thus, since the lifting-lowering range of the stack tray can be set large with respect to a space of the apparatus housing, a storage capacity of the stack tray can be enlarged with a compact structure of the apparatus.

Further, according to arrangement of the second inclination angle, a sheet conveyed with switching-back on the guide tray is not sharply bent even in a case that the sheet regulating face is formed long at the lower side to increase a stack amount of the stack tray. Therefore, it is possible to reduce a possibility of contacting with the sheet regulating face.

Further, owing to that the guide tray is arranged at a unit housing of the post-processing unit and the unit housing is supported by the image forming unit, it is possible to guide a sheet without arranging a complicated path.

Further, owing to that the second inclination angle and the third inclination angle of the guide tray are formed as a continuous curved face, contacting resistance can be reduced when a sheet is conveyed with switching-back.

Further, in the guide tray located below the stack tray, the third inclination angle continued from the second inclination angle is set to be an acute angle being shaper than the first inclination angle. Accordingly, the upper side of the guide tray is not exposed to be widely opened to the outside.

Therefore, it is possible to reduce a possibility that a foreign matter is sandwiched between the lifting and lowering stack tray and the guide tray. In addition, a duplex sheet discharged along the guide tray is not largely exposed to the outside. Accordingly, a false operation to carelessly pull out a sheet is prevented.

Further, owing to inclination of the guide tray, the switched-back sheet can be conveyed to the image forming unit without arranging conveying means at the linear path and the guide tray.

Further, owing to that the guide tray is arranged to be rotatable, there is not a fear that a foreign matter is sandwiched even when the stack tray is lowered while the foreign matter exists on the guide tray. Accordingly, safety of the above is improved.

Further, owing to that a rotation support of the guide tray is located at a side toward the linear path from the regulating face, a space is produced in the vicinity of the regulating face. Accordingly, the safety is further improved.

BRIEF DESCRIPTION OF THE DRAWINGS

FIGS. 5A to 5C are explanatory views illustrating operation states of the reversing roller mechanism; while FIG. 5A illustrates a waiting state in which an upper roller separated from a lower roller, FIG. 5B illustrates a state in which the upper roller is engaged with the lower roller with a low pressurization force, and FIG. 5C illustrates a state in which the upper roller is engaged with the lower roller with a high pressurization force;

FIGS. 6A and 6B are explanatory views illustrating engagement states between the upper roller and the lower roller in FIGS. 5B and 5C; while FIG. 6A illustrates pressure-contacted faces of the rollers where the upper roller and the lower roller are engaged with a low pressurization force and FIG. 6B illustrates pressure-contacted faces of the rollers engaged with a high pressurization force;

FIGS. 14A to 14C are explanatory views illustrating operation states of the sheet holding unit; while FIG. 14A illustrates a waiting state of the sheet holding unit, FIG. 14B illustrates a state (low pressurization state) in which the sheet holding unit performs punching on a tailing end of a sheet bundle on the tray, and FIG. 14C illustrates a state (high pressurization state) in which the sheet holding unit presses the upmost sheet on the tray;

FIGS. 15A to 15C are explanatory profile views of the guide tray in FIG. 2; while FIG. 15A illustrates an external shape, FIG. 15B illustrates a sectional shape of the guide tray, and FIG. 15C illustrates a sectional shape of the guide tray being different from FIG. 15B;

FIGS. 16A and 16B are operational explanatory views of the guide tray in FIG. 2; while FIG. 16A illustrates a tray posture in a constant state and FIG. 16B is an explanatory view illustrating a tray posture during a sheet-jam operation;

FIGS. 19A and 19B illustrate operation states of the tailing end supporting member; while FIG. 19A illustrates a state in which the supporting member enters a sheet placement tray and FIG. 19B illustrates a state in which the supporting member entered the tray supports a sheet bundle;

FIGS. 21A to 21D are explanatory views illustrating relations between a sheet bundle to be stored on the tray and the tailing end supporting member; while FIG. 21A illustrates a state in which the supporting member enters the tray, FIG. 21B illustrates a state in which a tailing end of the dropping sheet bundle is supported by the supporting member, FIG. 21C illustrates an initial state in which the tailing end supporting member is about to retract from the tray, and FIG. 21D illustrates a state in which the tailing end supporting member retracts from the tray;

FIGS. 24A and 24B are explanatory views of a sheet discharge mode in which a sheet fed to a sheet discharging path is stored at the stack tray one by one; while FIG. 24A is an explanatory view of an operation flow of jog discharging to collate and sort sheets on the stack tray and FIG. 24B is an explanatory view of operation flow when a sheet bundle is removed in a jog discharge mode;

DETAILED DESCRIPTION OF THE PREFERRED EMBODIMENT

Figure 1:
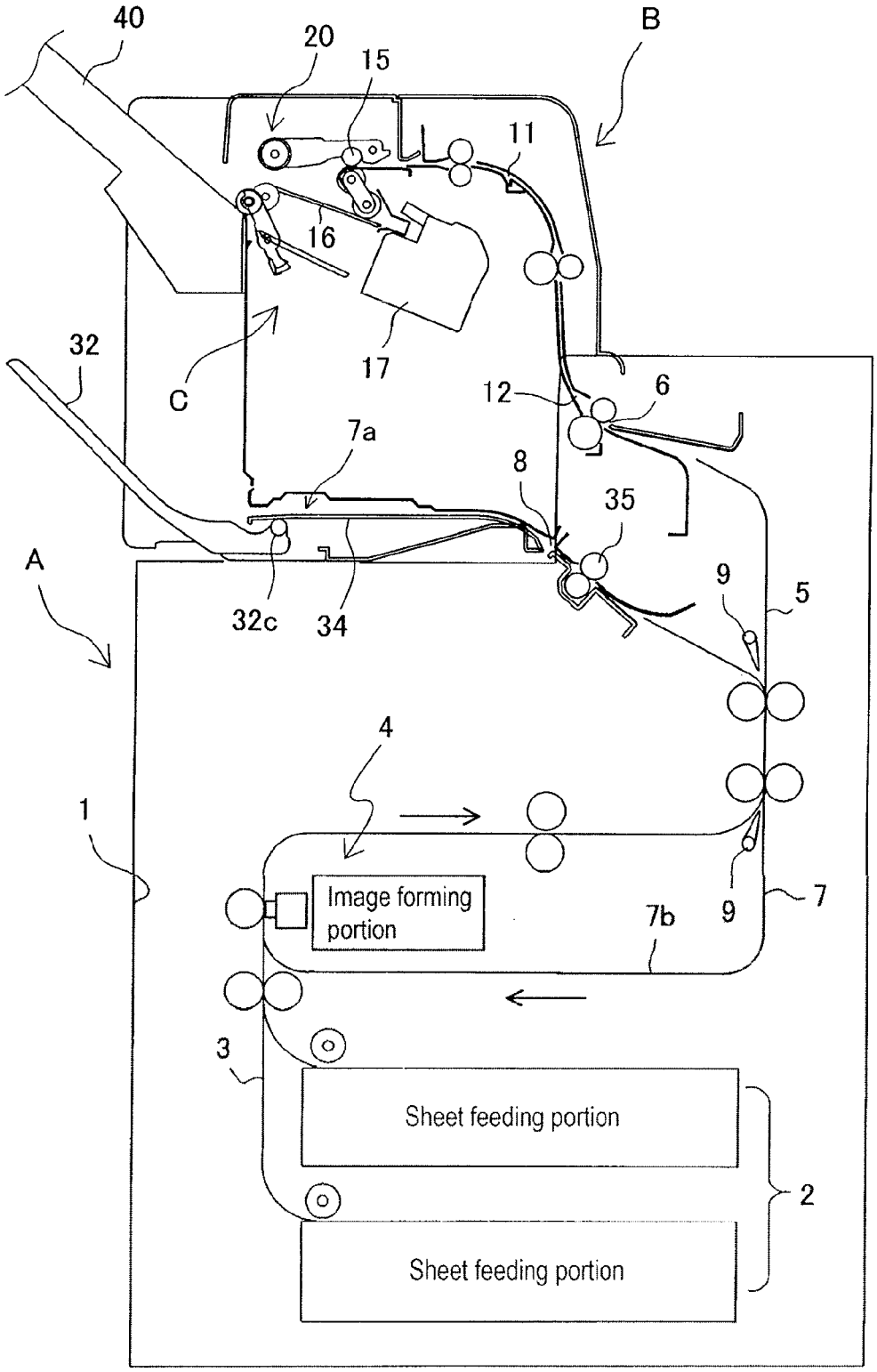
FIG. 1 is an explanatory view of a whole configuration of an image forming system according to the present invention.

In the following, the present invention will be described in detail based on preferred embodiments illustrated in the drawings. FIG. 1 illustrates an image forming system. The image forming system includes an image forming apparatus (unit) A which forms an image on a sheet and a post-processing apparatus (unit) B which performs a post-process such as a binding process of collating and stacking sheets with images formed thereon. A sheet storing apparatus (unit) C according to the present invention is built into the post-processing apparatus B. In the following, description will be performed on the image forming apparatus and the post-processing apparatus in the order thereof.

[Image Forming Apparatus]

The image forming apparatus A illustrated in FIG. 1 is connected to an image managing device such as a computer and a network scanner (not illustrated). The image forming apparatus A forms an image on a specified sheet based on image data transferred from such a device and discharges the sheet through a predetermined discharge port (later-mentioned sheet discharging port).

Other than constituting such a network configuration, the image forming apparatus A is structured as a copying machine or a facsimile machine and copies and forms an image on a sheet based on image date read by a document scanning unit.

In the image forming apparatus A, a plurality of sheet feeding cassettes 2 are arranged at a housing 1. A sheet of a selected size is fed from the corresponding cassette to a sheet feeding path 3 located at the downstream side. An image forming mechanism (image forming portion) 4 is arranged at the sheet feeding path 3.

A variety of types such as an ink-jet printing mechanism, an electrostatic printing mechanism, an offset printing mechanism, a silk-screen printing mechanism, and a ribbon-transfer printing mechanism have been known as the image forming mechanism 4. The present invention may be applied to any of the above printing mechanism.

A body sheet discharging path 5 is arranged at the downstream side of the image forming mechanism 4. A sheet is discharged through a sheet discharging port 6 (hereinafter, called a body sheet discharging port) which is arranged at the housing 1. Here, in some printing mechanisms, a fixing unit (not illustrated) is built into the body sheet discharging path 5.

Thus, a sheet of a selected size is fed from the sheet feeding cassette 2 to the image forming portion 4, and then, is discharged through the body sheet discharging port 6 from the body sheet discharging path 5 after an image is formed thereon.

Further, a duplex path 7 is arranged in the housing 1. According to the duplex path 7 being a path for duplex printing, a sheet is face-reversed in the apparatus and is fed again to the image forming portion 4 after an image is formed on a front face of the sheet at the image forming portion 4, and then, is discharged through the body sheet discharging port 6 after an image is formed on a back face thereof.

Here, the duplex path 7 includes a switch-back path 7*a* on which a conveying direction of a sheet fed from the body sheet discharging path 5 is reversed and a U-turn path 7*b* on which the sheet fed from the switch-back path 7*a* is face-reversed. A connecting port 8 in FIG. 8 formed at the housing 1 connects the switch-back path 7*a* and the body sheet discharging path 5.

In the illustrated apparatus, a sheet is once fed-out to the outside of the housing through a discharge port (connecting port) 8 (see FIG. 1) which is different from the body sheet discharging port 6, and then, is fed again to the image forming portion 4 after being face-reversed at the U-turn path 7*b*.

In the apparatus illustrated in FIG. 1, the switch-back path 7*a* is built in the post-processing apparatus B and the U-turn path 7*b* is built in the image forming apparatus A. A path length being the maximum sheet size is required to switch-back a sheet (to reverse a conveying direction of a sheet) fed from the body sheet discharging path 5. The whole apparatus is downsized by utilizing a vacant space of the post-processing apparatus B for the path.

The illustrated switch-back path 7*a* includes a linear path 34 and a guide tray 32. The linear path 34 is arranged at a lower booth of a later-mentioned post-processing portion (staple-binding portion) 17 of the post-processing apparatus B. The guide tray 32 is structured with a tray protruding outward from a housing 10 of the post-processing apparatus B as being continued from the linear path 34. According to such a configuration, downsizing of the whole system is achieved.

The post-processing apparatus B which will be described later is connected to the body sheet discharging port 6. There is also known a configuration, being different from the illustrated configuration, in which a scanner unit and a document feeding unit which feeds a document sheet to the scanner unit are integrally assembled to the housing 1.

The scanner unit in the above case performs scanning to read an image of a document sheet which is placed on a platen or fed from a feeder mechanism, and then, transfers the read data to an image forming unit. Further, the document feeding unit includes the feeder mechanism which feeds a document sheet onto the platen of the scanner unit. The present invention may be applied to a configuration which integrally includes such units.

[Post-Processing Apparatus]

The post-processing apparatus B illustrated in FIG. 2 includes a housing 10, a sheet conveying path (hereinafter, also called a sheet discharging path) 11 which is built into the housing 10, a processing tray 16, and a stack tray 40. Configurations of the above will be described in the following.

[Sheet Conveying Path (Sheet Discharging Path)]

The sheet conveying path 11 includes an introducing port 12 which is connected to the body sheet discharging port 6 of the abovementioned image forming apparatus A, and a path sheet discharging port 13*a* (hereinafter, called a first sheet discharging port). An image-formed sheet is introduced into the apparatus through the introducing port 12 and discharged from the path sheet discharging port 13.

The processing tray 16 and the stack tray 40 are arranged downstream of the path sheet discharging port 13*a* as forming a step (dh; see FIG. 2) therebetween. Sheets introduced through the sheet introducing port 12 are conveyed as being sorted to the processing tray 16 and the stack tray 40 at the downstream side of the sheet conveying path 11.

An introduction sensor Se1 to detect a sheet leading end (and/or a sheet tailing end) is arranged at the introducing port 12 of the sheet conveying path 11 and a discharge sensor Se2 to detect a sheet leading end and a sheet tailing end is arranged at the path sheet discharging port 13*a*.

Further, conveying rollers 14*a*, 14*b* (see FIG. 2) which convey a sheet are arranged on the sheet conveying path 11 at an appropriate interval. Each of the conveying rollers 14*a*, 14*b* is connected with a roller drive motor (not illustrated). A sheet discharging roller 15 is arranged at an outlet end of the sheet conveying path 11. A configuration of the sheet discharging roller 15 will be described later.

The respective conveying roller 14*a*, 14*b* and the sheet discharging roller 15 are structured with a plurality of roller trains being distanced in the sheet width direction (a direction perpendicular to the sheet discharging direction). Each roller is structured with a pair of rollers which are pressure-contacted to nip a sheet and apply a conveyance force thereto.

Figure 2:
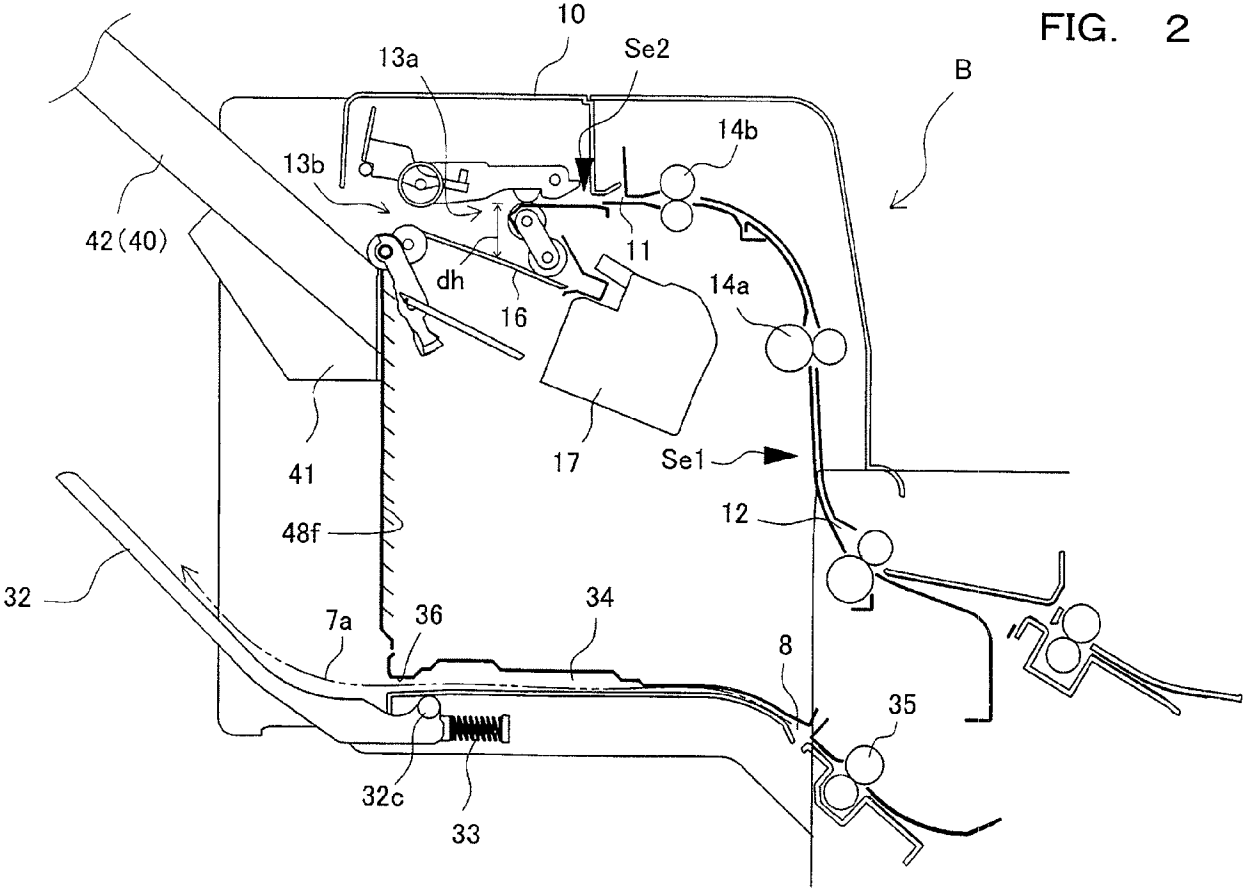
FIG. 2 is a structural explanatory view of a post-processing apparatus of the image forming system in FIG. 1.

As illustrated in FIG. 2, the sheet conveying path 11 includes an approximately linear path as laterally extending in the housing 10 approximately in the horizontal direction. The processing tray 16 and the stack tray 40 are arranged as described below at the downstream side of the path sheet discharging port 13*a* of the sheet conveying path 11.

[Processing Tray]

As illustrated in FIG. 2, the processing tray 16 is arranged at the downstream side of the path sheet discharging port 13*a* as forming a step therefrom. The processing tray 16 is provided with a sheet placement base 16*a* on which sheets are stacked and supported, aligning means (not illustrated) for the sheets placed on the sheet placement base 16*a*, a regulating stopper 18 which performs sheet positioning at a processing position on the sheet placement base 16*a*, and post-processing means 17 (staple-binding apparatus in FIG. 2).

The sheet placement base 16*a* in FIG. 2 is shaped to support a rear part of the sheet which is reversely conveyed (fed in a reverse direction from the sheet discharging direction) from the path sheet discharging port 13*a*.

Then, the sheet is to be supported (bridge-supported) as a leading end part thereof being supported onto the later-mentioned stack tray 40 and a tailing end part thereof being supported by the sheet placement base 16*a*.

Thus, the stack tray 40 and the processing tray 16 are arranged approximately on the same plane and the sheet is supported at the front half part thereof by one tray and the rear half part thereof by the other tray. Accordingly, the apparatus can be downsized compared to a case that a plurality of trays to support the whole sheet respectively are arranged in the front-rear direction.

Further, the regulating stopper 18 which performs regulation with abutting against a sheet tailing end and an aligning mechanism (not illustrated) which biases and aligns sheets in a direction perpendicular to the sheet discharging direction are arranged at the sheet placement base 16*a*.

Since a variety of mechanisms have been known as such an aligning mechanism, detailed description thereof is skipped. Sheets introduced onto the processing tray 16 are positioned according to preset reference (center reference or side reference). The apparatus in FIG. 2 adopts the center reference.

A staple unit which performs a binding process of a collated and stacked sheet bundle is arranged at the sheet placement base 16*a* as the post-processing means 17. Such a staple unit (the post-processing means) 17 has been known as a device which bends a linear staple needle into a U-shape, inserts the staple needle to a sheet bundle from an upper face to a lower face as bending leading ends of the staple needle.

Thus, the post-processing means 17 adopts a staple unit, a punch unit, a stamp unit, a trimmer unit, or the like in accordance with apparatus specifications.

The stack tray 40 described later is arranged at the downstream side of the processing tray 16 in the sheet discharging direction. A tray sheet discharging port 13*b* (hereinafter, called a second sheet discharging port) for discharging sheets to the stack tray 40 is arranged at the processing tray 16.

The path sheet discharging port 13*a* and the tray sheet discharging port 13*b* are arranged as having a distance L1 (see FIG. 8) therebetween. A reversing roller mechanism 20 is arranged between both the sheet discharging ports 13*a*, 13*b*.

The reversing roller mechanism 20 conveys a sheet fed to the path sheet discharging port 13*a* to the downstream side in the sheet discharging direction and reverses the conveying direction at the time when the sheet tailing end passes through the path sheet discharging port 13*a*. Further, the reversing roller mechanism 20 conveys the sheet fed through the path sheet discharging port 13*a* to the downstream side in the sheet discharging direction and reverses the conveying direction at the time when the sheet tailing end passes through the path sheet discharging port 13*a*.

Thus, the conveying direction of the sheet is reversed. The tailing end is guided by the processing tray 16 as dropping by the step dh, and then, is stopped at the position of the regulating stopper 18 as being abutted thereto by a later-mentioned frictional rotor 19 (in a case of a later-mentioned first sheet discharge mode).

The friction rotor 19 which guides the sheet to the regulating stopper 18 in cooperation with the reversing roller mechanism 20 arranged at the path sheet discharging port 13*a* is arranged at the processing tray 16. In FIG. 2, the friction rotor 19 is placed at a position to be engaged with a stacked sheet on the sheet placement base 16*a*. The friction rotor 19 is structured with a raking roller (or belt) and is driven by a drive belt to be rotated integrally with the sheet discharging roller 15.

Then, the friction rotor 19 is engaged with a stacked sheet owing to own weight. The sheet reversely conveyed from the reversing roller 20 with rotation of the friction rotor 19 being the raking roller is conveyed to the regulating stopper 18 and is stopped as being abutted thereto.

[Reversing Roller Mechanism]

Figure 3:
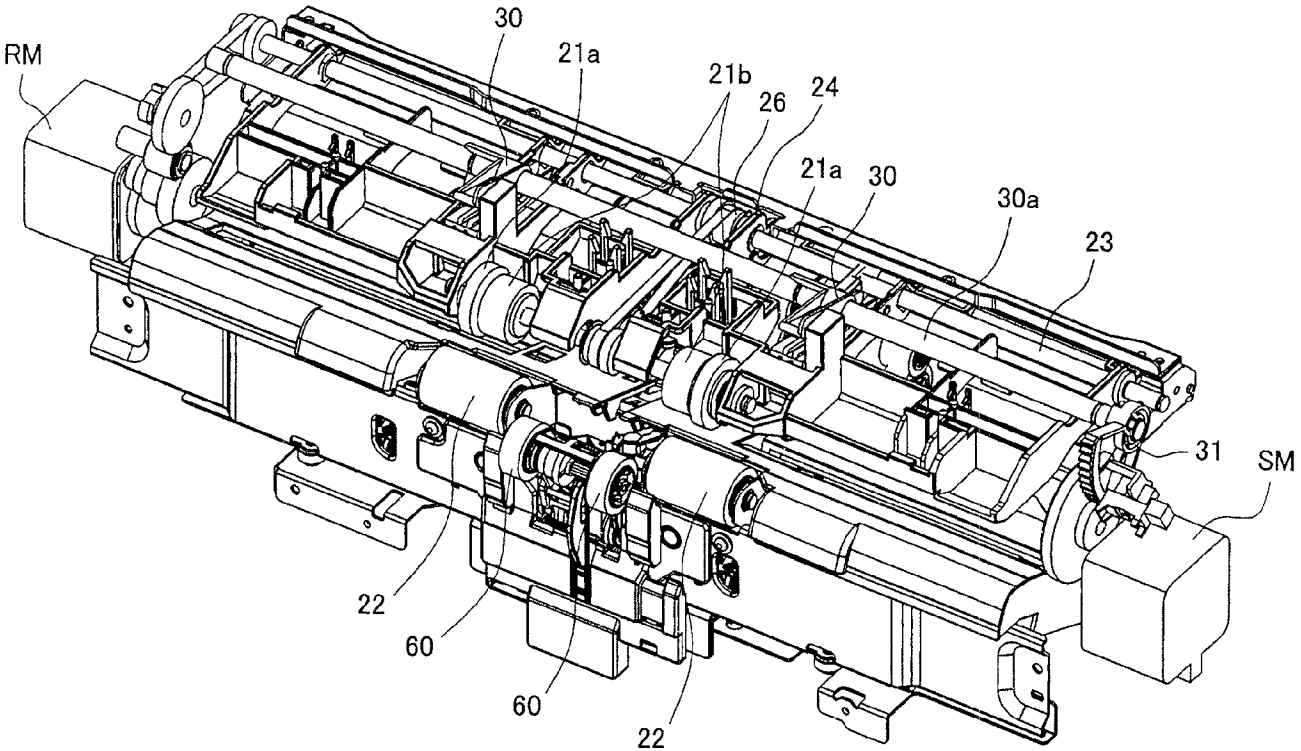
FIG. 3 is a perspective structural explanatory view of a sheet discharging mechanism of the post-processing apparatus in FIG. 2.

FIG. 3 is an explanatory perspective view illustrating a sheet discharging mechanism of the post-processing apparatus B. A pair of reversing rollers 20 are arranged at the center in the width direction of a sheet conveyed from the path sheet discharging port 13*a*. The reversing roller 20 transfers the sheet fed from the path sheet discharge port 13*a* in the sheet discharging direction, and then, introduces the sheet to the processing tray 16 as reversing the conveying direction.

Figure 4A:
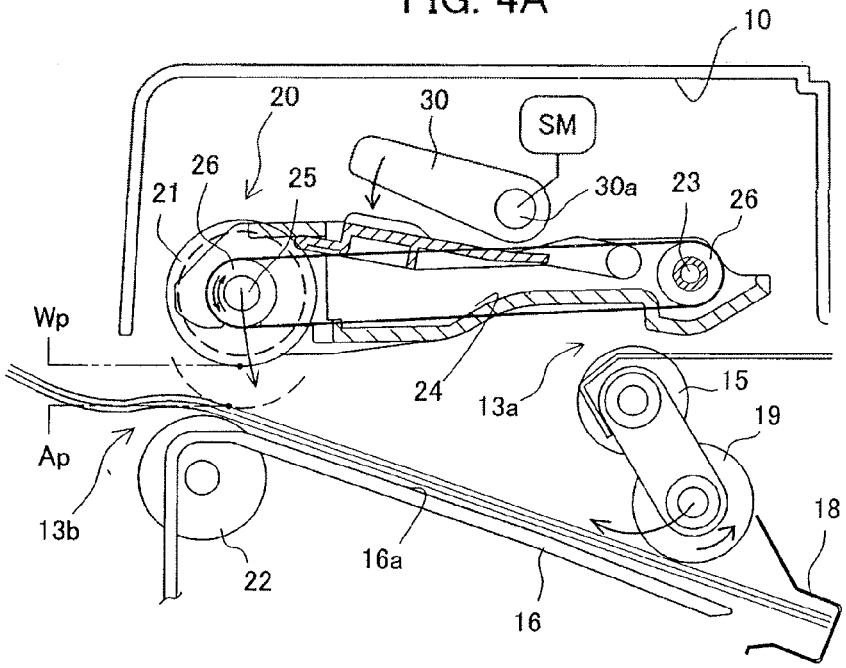
FIG. 4A is an explanatory view of a whole structure of a reversing roller mechanism of the post-processing apparatus in FIG. 2
Figure 4B:
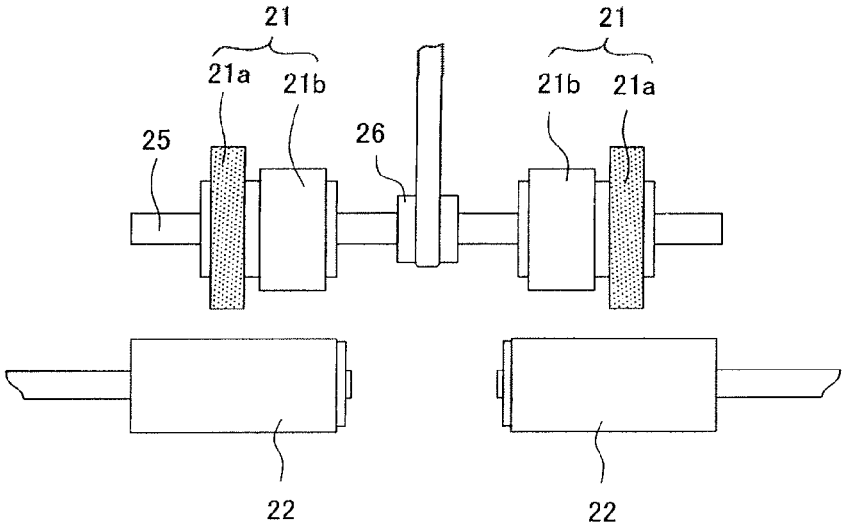
FIG. 4B is an explanatory view illustrating a shape of a reversing roller.

FIGS. 4A and 4B specifically illustrate the reversing roller mechanism 20. FIG. 4A illustrates a lifting-lowering mechanism of the reversing roller 20. FIG. 4B illustrates a roller structure of an upper roller 21 and a lower roller 22. The reversing roller mechanism 20 is structured with the upper roller 21 which is engaged with an upper face of the sheet fed from the sheet discharging port 13 and the lower roller 22 which is engaged with a lower face of the sheet.

The upper roller 21 is swingably supported by an apparatus frame F as being capable of being lifted and lowered between an operating position Ap to be pressure-contacted to the lower roller 22 and a waiting position Wp to be apart therefrom.

Further, rotation of a roller drive motor (forward-reverse motor) RM is transmitted to the upper roller 21 to enable the upper roller 21 to rotate in the sheet discharging direction (clockwise direction in FIG. 4A) and an opposite direction to the sheet discharging direction (counterclockwise direction in FIG. 4A).

A right-left pair of roller brackets (swing arms) 24 is supported by the apparatus frame F as being swingable about a swing pivot 23. A roller rotary shaft 25 is rotatably bearing-supported by the pair of roller brackets 24. The upper roller 21 is fitted to the rotary shaft 25. The swing pivot 23 is supported by the apparatus frame F rotatably or fixedly. The roller bracket 24 is fitted to the swing pivot 23 directly or via a collar member.

According to the above, a bracket base end portion is supported about the swing pivot 23 swingably to a direction of an arbitral angle. Further, a collar member (rotary collar) is loosely fitted to the swing pivot 23 and a drive pulley 26 which transmits rotation to the rotary shaft 25 of the upper roller 21 is connected to the collar member. The roller drive motor RM is connected to the drive pulley 26.

The roller bracket 24 is provided with a lifting-lowering mechanism which performs lifting-lowering motion between the waiting position Wp where the upper roller 21 is apart from the lower roller 22 and the operating position Ap where the upper roller 21 is pressure-contacted to the lower roller 22.

Figure 5A:
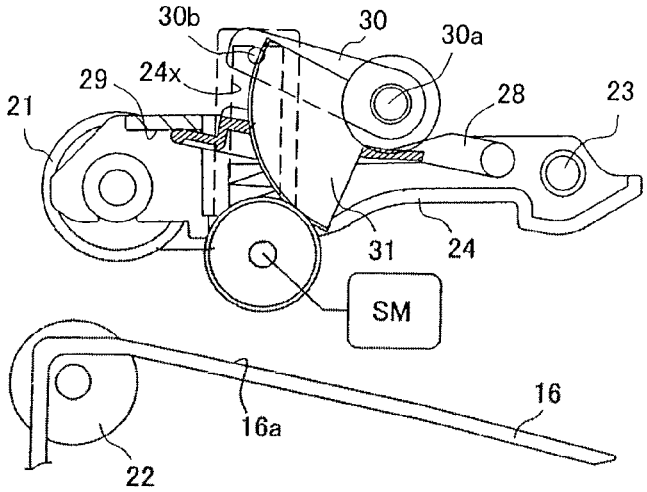
Figure 5B:
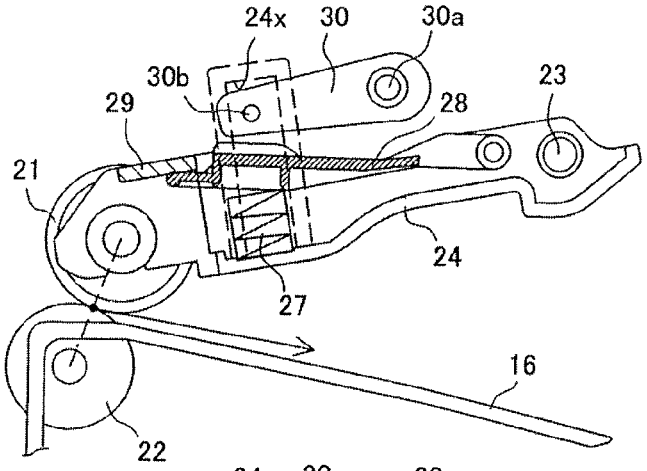
Figure 5C:
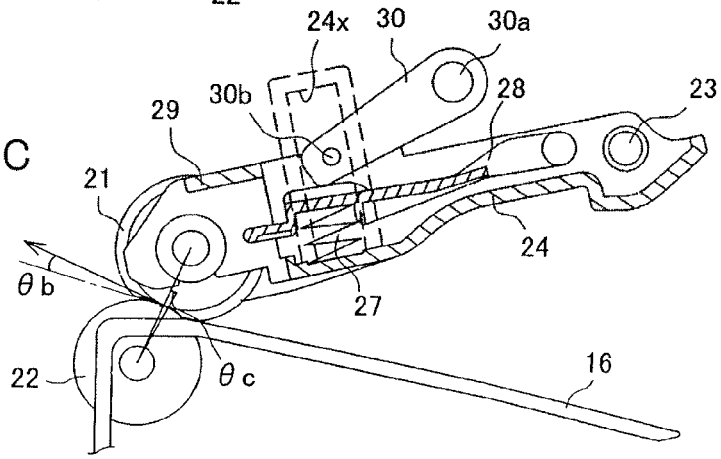

FIGS. 5A to 5C illustrate the lifting-lowering mechanism. As illustrated in FIG. 5A, a lifting-lowering lever 30 is arranged within a movement trajectory of the roller bracket 24 which swings about the swing pivot 23. A base end portion of the lifting-lowering lever 30 is swingably supported by a rotary shaft 30*a*. The rotary shaft 30*a* is connected to a lifting-lowering motor SM via a sector-shaped gear 31. Accordingly, the lifting-lowering lever 30 is configured to be rotated (swung) within a predetermined angle range owing to rotation of the lifting-lowering motor SM.

An operation pin 30*b* is integrally formed at a top end portion of the lifting-lowering lever 30. An engagement receiving portion (long groove) 24*x* which is engaged with the operation pin 30*b* is formed at the roller bracket 24. When the operation pin 30*b* is engaged with the engagement receiving portion 24*x* as illustrated in FIG. 5A, the roller bracket 24 is located at the waiting position. When the operation pin 30*b* is in a state of being apart from the engagement receiving portion 24*x*, the roller bracket 24 is located at the operating position where the upper roller 21 is pressure-contacted to the lower roller 22 owing to own weight.

Further, when the operation pin 30*b* depresses a movable bar 28, a pressurizing spring 27 is compressed and a spring force thereof is added to the roller bracket 24 as a pressure-contact force between the upper roller 21 and the lower roller 22.

Thus, when the lifting-lowering lever 30 is displaced owing to angle control of the lifting-lowering motor SM from a state of FIG. 5A to states of FIGS. 5B and 5C, the upper roller 21 shifts from a state of being apart from the lower roller 22 to a state of being pressure-contacted thereto with a low pressurization force and a state of being pressure-contacted thereto with a high pressurization force. A stopper piece 29 in FIGS. 5A to 5C is arranged at the roller bracket 24 to restrict the upper limit of swing motion of the movable bar 28.

According to the above configuration, when the lifting-lowering motor SM rotates in a predetermined direction (clockwise direction in FIGS. 5B and 5C), the lifting-lowering lever 30 moves to lift the roller bracket 24 in a direction in which the upper roller 21 is to be apart from the lower roller 22. Accordingly, the roller bracket 24 is lifted and moved to the waiting position as being engaged with a stopper (not illustrated) and held at the waiting position with loads of the motor, a transmitting mechanism, and the like.

When the lifting-lowering motor SM rotates in the opposite direction, the lifting-lowering lever 30 rotates in the counter-clockwise direction in FIG. 5A. Accordingly, the roller bracket 24 rotates about the swing pivot 23 in a direction to drop (fall) owing to own weight, so that the upper roller 21 is pressure-contacted to the lower roller 22.

Along with roller lifting-lowering, the roller drive motor RM transmits rotation to the upper roller 21. The roller drive motor RM is structured with a motor capable of rotating forwardly and reversely. In this case, the upper roller 21 is controlled with a first method or a second method described in the following.

According to the first method, the upper roller 21 is rotated in the sheet discharging direction in a state of being pressure-contacted to the lower roller 22 to discharge a sheet through the sheet discharging port 13. When the leading end of the sheet proceeds to the roller nipping section, the sheet is conveyed in the sheet discharging direction as receiving conveyance forces from both of the sheet discharging roller 15 and the reversing roller 20.

Next, when the tailing end of the sheet left from the sheet discharging port 13 (right after occurrence of a detection signal of the discharge sensor Se2), the rotating direction of the upper roller 21 is reversed. Accordingly, at the same time when the sheet tailing end drops from the sheet discharging port 13 to the processing tray 16, the sheet leading end is reversely conveyed by the upper roller 21.

This sheet discharging method is adopted for control when a first sheet is introduced to the processing tray 16 (when friction between sheets does not exist). Here, the pressure-contact force between the upper roller 21 and the lower roller 22 is set as the high pressurization force (in a state of FIG. 5C).

According to the second method, when a preceding sheet is already stacked on the lower roller 22, it is in a waiting state for a sheet to be discharged through the sheet discharging port 13 while the upper roller 21 is kept at the waiting position Wp. At the timing when the tailing end of the sheet is fed out through the sheet discharging port 13, the upper roller 21 is lowered from the waiting position Wp to the operating position Ap. Along with the roller lowering action, the roller drive motor RM is rotated in the direction opposite to the sheet discharging direction.

Accordingly, the tailing end of the sheet fed out through the sheet discharging port 13 drops to the processing tray 16 and the sheet is conveyed with the tailing end side in the lead toward the regulating stopper 18 with the conveyance force received from the upper roller 21. Here, the pressure-contact force between the upper roller 21 and the lower roller 22 is set to the low pressurization force (in a state of FIG. 5B).

In the abovementioned configuration of the present invention, the upper roller 21 is lifted and lowered among the waiting position, the pressure-contact position with low pressurization, and the pressure-contact position with high pressurization by the lifting-lowering lever 30 separately arranged from the roller bracket 24 around the swing pivot 23. Alternatively, it is possible to arrange a spring clutch at the swing pivot 23 of the roller bracket 24 and to rotate a rotary shaft (rotary collar or the like) in forward and reverse directions via the spring clutch.

Accordingly, when rotation occurs in a direction to compress the spring clutch, the roller bracket 24 is lifted from the pressure-contact position to the lifted positing. When rotation occurs in a direction to release the spring clutch, the roller bracket 24 is lowered from the lifted position to the pressure-contact position. In order to adjust the pressure-contact force in two steps being high and low, a pressurizing mechanism (pressurizing lever or the like) to pressurize the roller bracket 24 with a spring pressure may be added.

Next, configurations of the upper roller 21 and the lower roller 22 will be described with reference to FIG. 4B. As described above, the upper roller 21 is moved between the operating position Ap to be pressure-contacted to the lower roller 22 and the waiting position Wp to be apart therefrom. At the operating position Ap, the pressure-contact force is adjustable between the low pressurization state and the high pressurization state.

First, the configuration of the upper roller 21 will be described. The upper roller 21 is configured by combination of a large-diameter roller body 21*a* and a small-diameter roller body 21*b*. The large-diameter roller body and the small-diameter roller body are arranged in the sheet width direction in combination of one or more pairs thereof. In FIG. 4B, the large-diameter roller bodies 21*a* and the small-diameter roller bodies 21*b* are arranged as centering at the sheet center having the same distance therefrom. Here, the large-diameter roller body 21*a* is arranged outside the small-diameter roller body 21*b*.

Thus, the upper roller 21 is structured with the large-diameter roller bodies and the small-diameter roller bodies in a bilaterally symmetric manner against the sheet center. The large-diameter roller body 21*a* has an outer diameter being larger than that of the small-diameter roller body 21*b* by Δd and is structured with a soft member such as sponge and soft rubber.

Meanwhile, the small-diameter roller body 21*b* is smaller than the large-diameter roller body 21*a* by Δd and is structured with a hard member such as synthetic resin. Thus, the upper roller 21 is configured to have different outer diameters. In contrast, the lower roller 22 is structured with a relatively hard material having the same outer diameter.

Figure 6A:
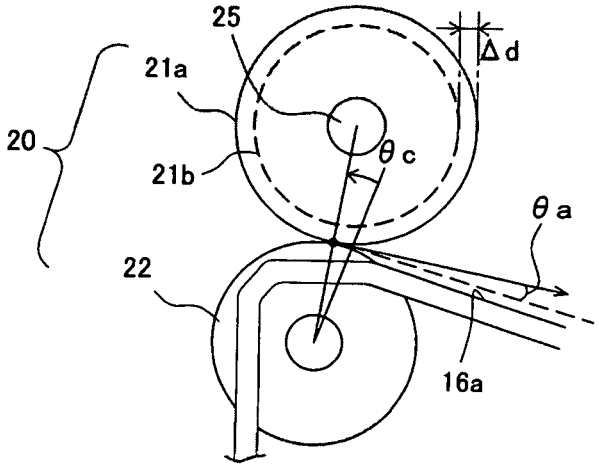
Figure 6B:
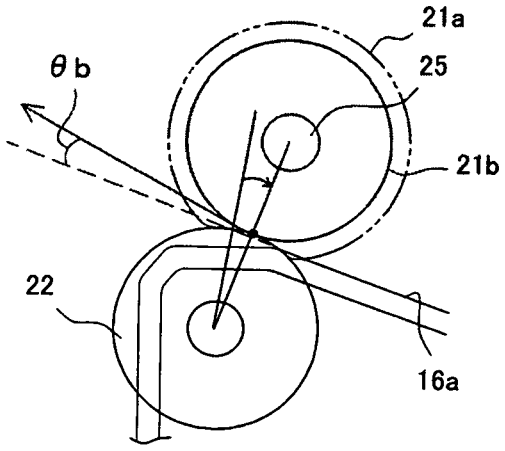

FIG. 6A illustrates a state in which the large-diameter roller body 21*a* of the upper roller 21 and the lower roller 22 are pressure-contacted. FIG. 6B illustrates a state in which the small-diameter roller body 21*b* of the upper roller 21 and the lower roller 22 are pressure-contacted. Here, FIG. 6A indicates a low pressurization state and FIG. 6B indicates a high pressurization state.

As illustrated in FIG. 6A, the large-diameter roller body 21*a* is set to have hardness so that the circumference of the large-diameter roller body 21*a* is pressure-contacted to the lower roller 22 without being elastically deformed under conditions of the low pressurization force without the pressurization force due to the abovementioned lifting-lowering lever 30 being applied.

Further, as illustrated in FIG. 6B, under conditions of the high pressurization force with an action of the lifting-lowering lever 30, the small-diameter roller body 21*b* is pressure-contacted to the lower roller 22 while the large-diameter roller body 21*a* is elastically deformed.

Here, as described above, the lower roller 22 is arranged at the position opposed to the upper roller 21 as being structured with a hard material like synthetic resin such as derlin and nylon. The lower roller 22 is formed to have the same outer diameter.

Here, the hard material denotes a material having hardness on the order of conveying a sheet in a state of approximately maintaining the outer diameter without having large elastic deformation even when the high pressurization force is applied from the upper roller 21.

Thus, the outer diameter difference (Δd) and the hardness difference between the large-diameter roller body 21*a* and the small-diameter roller body 21*b* are set so that the large-diameter roller body 21*a* is pressure-contacted to the lower roller 22 without being elastically deformed when being pressure-contacted to the lower roller 22 with the low pressurization force while the small-diameter roller body 21*b* is not pressure-contacted to the lower roller 22 as forming a space (gap) thereto (state of FIG. 6A).

In contrast, when being pressure-contacted to the lower roller 22 with the high pressurization force, the large-diameter roller body 21*a* is elastically deformed and is pressure-contacted to the lower roller 22 along with the small-diameter roller body 21*b* (state of FIG. 6B).

When the large-diameter roller body 21*a* is pressure-contacted to the lower roller 22 without being elastically deformed as illustrated in FIG. 6A, contact area therebetween is small and a conveyance force to be applied by roller rotation is small. This is to suppress the following problem.

In the case that a sheet is stacked on the lower roller 22, a sheet is fed through the sheet discharging port 13 thereon, and the sheet is to be conveyed by the upper roller 21 in the direction opposite to the sheet discharging direction, the stacked sheet and the introduced sheet are frictionally slid to each other. At that time, a large roller pressure-contact force causes ink friction as image ink being in friction between the mutual sheets. In addition, a sheet face gets dirty with ink adherent to a roller surface or the like.

Further, in the illustrated apparatus, a roller pressure-contact angle is set so that a sheet is conveyed approximately at the same direction as a sheet placement face of the sheet placement base 16*a* as the sheet conveying direction being illustrated by an arrow in FIG. 6A in the state that the large-diameter roller body 21*a* is engaged with the lower roller 22 without being deformed.

That is, an angle θa illustrated in FIG. 6A is set to be zero or to be close to zero. This is to reduce friction between the sheet introduced to the processing tray 16 and the stacked sheet. Such reduction of a frictional force between the mutual sheets is especially effective when images are formed at high speed by the image forming apparatus A at the upstream side or when characteristics of ink for image forming provides printing conditions under which ink friction is easily caused.

When the large-diameter roller body 21*a* is pressure-contacted to the lower roller 22 as being elastically deformed as illustrated in FIG. 6B, contact area therebetween is large and a conveyance force to be applied to sheets by roller rotation is large. Further, in the illustrated apparatus, conveyance is performed with the conveying direction being upwardly shifted from the sheet placement face of the sheet placement base 16*a* by an angle θb in FIG. 6B.

Thus, by structuring the upper roller 21 with the large-diameter roller body 21*a* and the small-diameter roller body 21*b* and varying the pressurization force to be applied to the respective rollers in two steps being high and low, the sheet fed to the tray sheet discharging port 13*b* can be conveyed while varying the conveying mechanism as illustrated in FIGS. 6A and 6B in accordance with a conveyance mode.

That is, when the sheet fed to the tray sheet discharging port 13*b* is introduced to the processing tray 16 with switch-back conveying, ink friction between the mutual sheets can be prevented. When the sheet is conveyed from the tray sheet discharging port 13*b* to the stack tray 40, the sheet is conveyed toward the tray with the sheet discharging direction being set in a parabola direction in an upward posture, so that the sheet on the tray can be discharged relatively further.

The reason why the reversing roller 20 is structured with the pair of large-diameter and small-diameter rollers is as follows. The reversing roller 20 discharges a sheet fed to the tray sheet discharging port 13*b* respectively to the stack tray 40 and the processing tray 16 in a first sheet discharge mode and a second sheet discharge mode which are described later. In the first sheet discharge mode, the sheet fed to the tray sheet discharging port 13*b* is conveyed to the stack tray 40 at the downstream side by nipping one by one with the upper roller 21 and the lower roller 22.

Here, the first sheet discharge mode includes different sheet discharging operations being jog discharging to perform jog sorting of sheets on the stack tray 40 for each bundle and straight discharging to perform discharging without sorting.

Accordingly, in the first sheet discharge mode, since sheets are nipped between the upper roller 21 and the lower roller 22 one by one, reliable conveyance can be performed to the downstream side owing to roller rotation without occurrence of slippage between the rollers and a sheet.

In the second sheet discharge mode, the sheet fed from the tray sheet discharging port 13*b* is introduced onto the upmost sheet which is previously stacked, and then, the sheet is conveyed, as sliding on the upmost sheet, in the sheet discharging direction and subsequently in the opposite direction to the sheet discharging direction as being pressed by the upper roller 21.

As described above, regarding the different conveyance modes, according to the nip conveyance in the first sheet discharge mode, a sheet (sheet bundle in a later-mentioned bundle discharge mode) can be discharged and accommodated reliably in the stack tray 40 at the downstream side with a strong pressure-contact force.

In the second sheet discharge mode, slippage between mutual sheets is unavoidable. In this case, since there is a fear that ink friction occurs with an image formed on a sheet face, it is preferable that a sheet is conveyed with a weak pressure-contact force.

Further, for example, from a viewpoint of compatibility (adhesiveness) with image forming ink, there is a case that a roller surface is coated. Regarding the illustrated rollers, a surface-hardening process such as ceramic coating and a fluorine coating is performed on each surface of the small-diameter roller body 21*b* and the lower roller 22 which conveys a sheet with nipping.

According to the above, there is not a fear that a subsequent sheet gets dirty with ink friction as being adhesive to a roller surface even when ink on the sheet is insufficiently fixed.

Further, in the later-mentioned second sheet discharge mode, a sheet fed from the path sheet discharging port 13*a* is stacked on the sheet placement base 16*a* and the lower roller 22 in a lamination manner, and then, a sheet fed from the path sheet discharging port 13*a* is conveyed in a switch-back manner by the upper roller 21, on the upmost sheet, in the sheet discharging direction and subsequently in the opposite direction to the sheet discharging direction. The upper roller 21 is required to perform conveyance to a predetermined post-processing position while preventing strong friction between the sheet stacked on the sheet placement base and the sheet introduced from the path sheet discharging port 13*a*.

Here, there is a fear that image ink friction occurs when friction occurs between mutual sheets as well as a problem that an ink layer adherent to a roller surface adheres to a sheet face. In order to solve image shifting and dirty marks between sheets, the upper roller 21 is structured with a large-diameter roller being a soft roller made of sponge or the like. In addition, a pressure-contact angle θc of the reversing roller 20 (see FIG. 6A) is set so that a roller contact point is moved in a direction where a sheet follows along the face of the sheet placement base.

Further, regarding the sheet introduced to the processing tray 16, only the large-diameter roller body 21*a* is pressure-contacted to the sheet face and a gap is formed against the small-diameter roller body 21*b* without being pressure-contacted thereto. Accordingly, contact area between the roller and the sheet is small and the pressurization force is set at the low pressurization force. Therefore, static electricity occurring between mutual sheet (between a stacked sheet and an introduced sheet) is slight, so that conveyance of a subsequent sheet is not disturbed by accumulated static electricity.

In the above, description is performed on the configuration that a sheet bundle is conveyed to the stack tray 40 at the downstream side by the reversing roller mechanism 20 after a binding process is performed on the sheet bundle stacked on the processing tray 16. However, it is also possible to arrange conveyer means which discharges a sheet bundle from the processing tray 16 along with the reversing roller mechanism 20.

As illustrated in FIG. 4A, the regulating stopper 18 is structured with a plate-shaped member which performs regulation with abutting against a sheet tailing end and is arranged at one position or a plurality of positions as being distanced in the sheet width direction. The regulating stopper 18 is arranged at a sheet tailing end edge along with the post-processing means such as a staple unit 17. Accordingly, when the staple unit 17 is arranged movably in the sheet width direction, the regulating stopper 18 is configured to be movable as well in the sheet width direction as being interlocked with the staple unit 17. In contrast, when the staple unit 17 is fixedly arranged without being moved in the sheet width direction, it is also possible to arrange the regulating stopper 18 integrally with the staple unit 17.

[Stack Tray]

Figure 9:
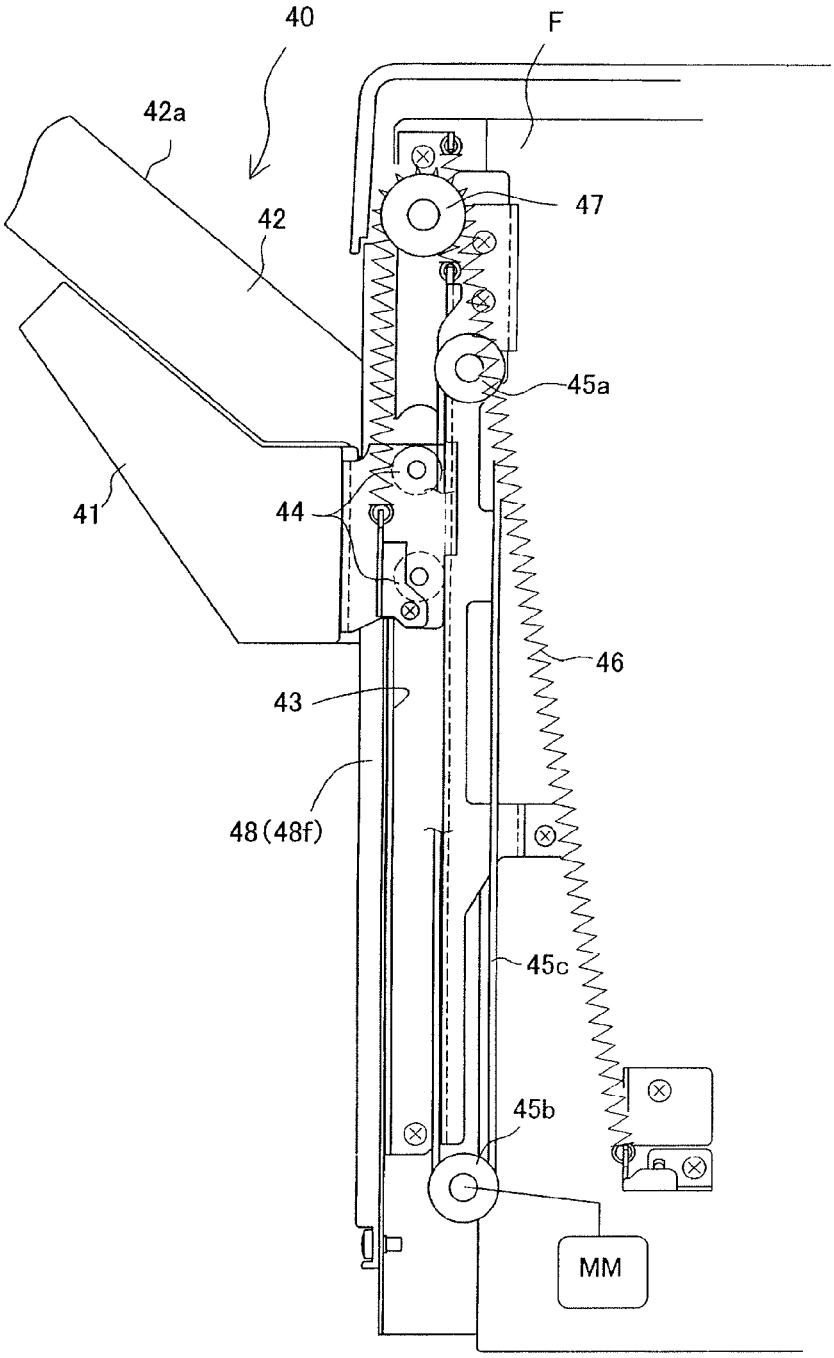
FIG. 9 is an explanatory view of a lifting-lowering mechanism of the stack tray.

Next, the stack tray 40 will be described. As illustrated in FIGS. 2 and 9, the stack tray 40 is arranged at the downstream side of the path sheet discharging port 13*a* of the sheet conveying path 11. The abovementioned processing tray 16 is arranged at the downstream side of the path sheet discharging port 13*a*. The stack tray 40 is arranged at the downstream side of the path sheet discharging port 13*a* and the tray discharging port 13*b* of the processing tray 16.

Here, a single sheet is discharged through the path sheet discharging port 13*a* and a single sheet and a sheet bundle is discharged through the tray sheet discharging port 13*b*, so as to be stored at the stack tray 40 in both cases.

The stack tray 40 is structured with a tray base 41 and a sheet placement tray 42. The tray base 41 is supported by the apparatus frame F to perform lifting-lowering motion at a predetermined stroke. The sheet placement tray 42 is configured to be a tray shape having a tray face on which sheets are stacked and stored.

The sheet placement tray 42 is supported by the tray base 41. Here, a later-mentioned jog shifting mechanism is arranged so that the sheet placement tray 42 performs jog shifting by a predetermined amount in the sheet width direction against the tray base 41.

[Tray Lifting-Lowering Mechanism]

FIG. 9 illustrates a lifting-lowering mechanism of the stack tray 40. A guide rail 43 is arranged at the apparatus frame F vertically in the stacking direction. Slide rollers 44 fixed to a joint portion (joint plate) of the tray base 41 are fitted to the guide rail 43. The guide rail 43 is structured with bar-shaped guide, channel steal, H-shaped steel, or the like and the tray base 41 is slidably fitted thereto.

The tray base 41 is configured with a frame structure having strength for supporting loads of the sheet placement tray 42 and sheets stacked thereon and is cantilever-supported by the guide rail which is similarly stiff. Further, a suspension pulley 45*a* and a winding pulley 45*b* are axially fixed to the apparatus frame F respectively at an upper end part and a lower end part of the guide rail 43.

A tow member 45*c* such as a wire and a geared belt is routed between both the pulleys. A winding motor MM is connected to the winding pulley 45*b* via a deceleration mechanism.

Further, a coil spring 46 for weight lightening is routed between the tray base 41 and the apparatus frame F. That is, one end (lower end in FIG. 9) of the spring 46 is fixed to the apparatus frame F and the other end (upper end in FIG. 9) is fixed to the tray base 41 via a tow pulley 47. Initial tension is applied to the spring 46.

Thus, tray shifting means which lifts and lowers the sheet placement tray 42 in the stacking direction is structured with the winding motor MM, the suspension pulley 45*a*, and the tow member 45*c*.

Here, the sheet placement tray 42 and sheets stacked thereon are lightened in weight in accordance with an elastic force of the coil spring 46 and load torque of the winding motor MM is reduced. Further, it is also possible to adopt a weight lightening mechanism which hangs a weight from a hanging pulley instead of a coil spring.

[Sheet Placement Tray]

The sheet placement tray 42 includes a sheet placement face 42*a* on which sheets fed from the tray sheet discharging port 13*b* at the upper side are placed in a lamination manner. The sheet placement face 42*a* may be horizontally arranged. Here, the sheet placement face 42*a* is inclined by a predetermined angle (later-mentioned first inclination angle $\alpha$). This is for correcting the stacked sheets in posture to the tailing end side owing to own weight. It is preferable that the inclination angle of the sheet placement face 42*a* is approximately in a range between 30° and 45° against a horizontal surface. When the inclination angle is 30° or less, it is difficult to perform sheet correction in posture. When the inclination angle is 45° or more, there is a fear that a curled sheet is overturned at the time of entering the sheet placement tray 42.

Figure 8:
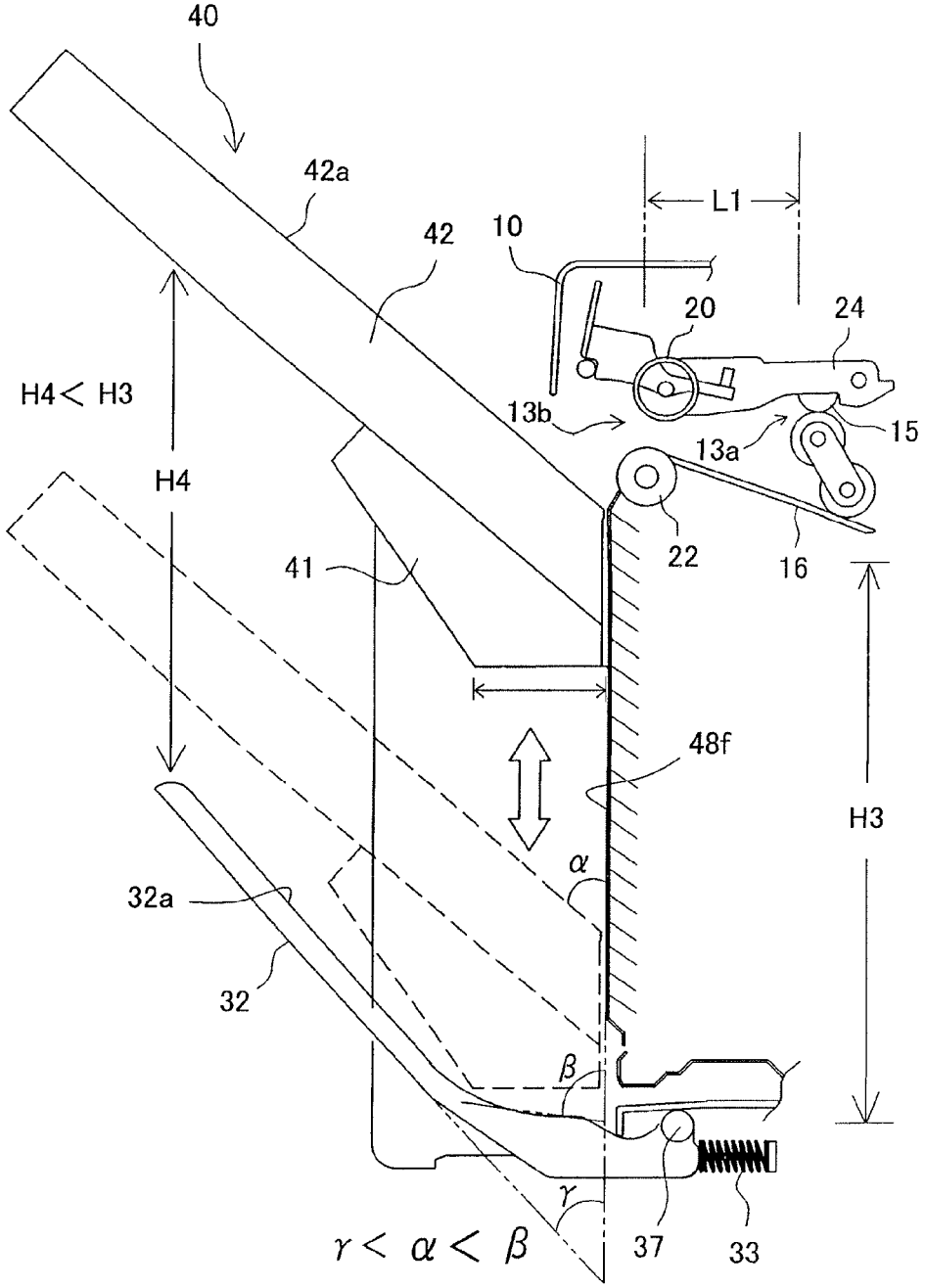
FIG. 8 is an explanatory view of a layout configuration of the stack tray and a guide tray in FIG. 2.

The sheet placement tray 42 is supported by the tray base 41 and performs lifting and lowering motion along the guide rail 43. Further, a fence plate 48 having a tailing end regulating face 48*f* which regulates a sheet tailing end is arranged at the apparatus frame F (see FIG. 9). The fence plate 48 may have a wall face structure of being fixed to the apparatus frame F. In FIG. 8, since the sheet placement tray 42 is configured to perform jog shifting by a predetermined amount in the sheet width direction, the fence plate 48 is configured to perform jog shifting as well along with the sheet placement tray 42. The structure thereof will be described later.

[Jog Shifting Mechanism]

Figure 10:
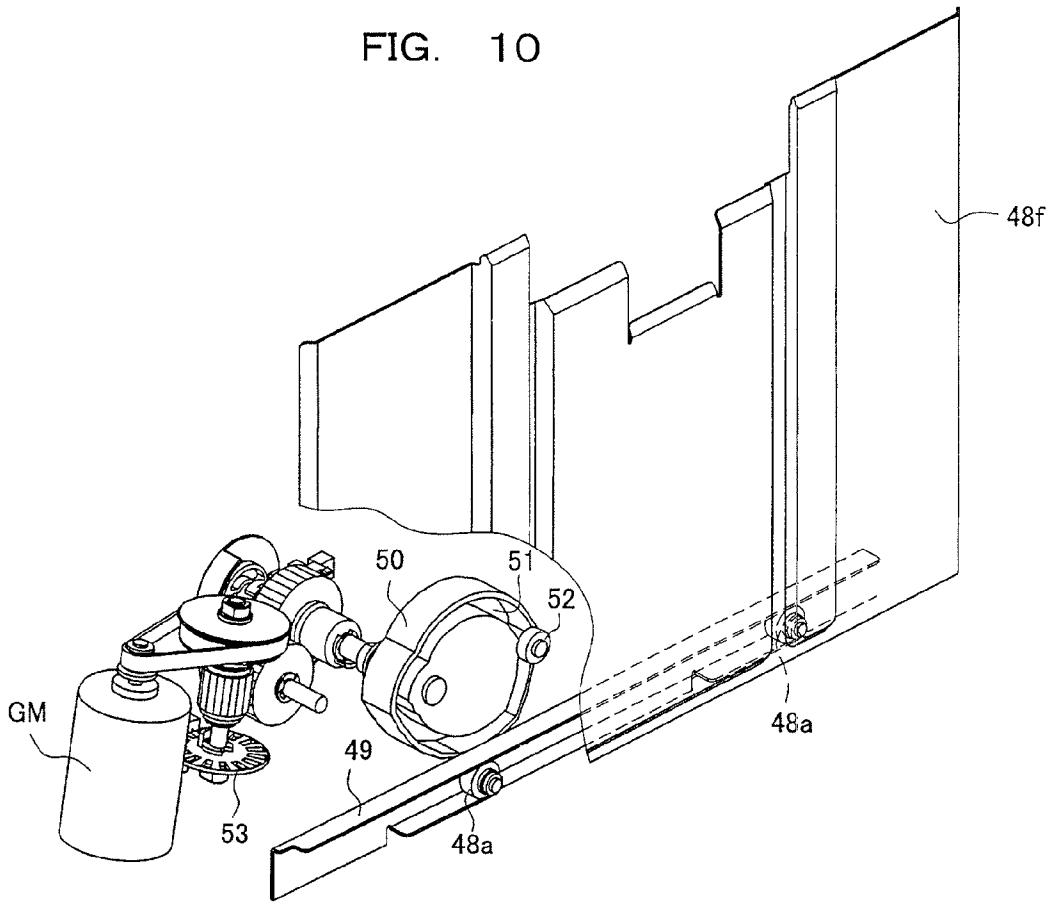
FIG. 10 is an explanatory view of a jog shifting mechanism of the stack tray.

Next, a jog shifting mechanism of the sheet placement tray 42 supported by the tray base 41 will be described with reference to FIG. 10. In FIG. 10, the sheet placement tray 42 is located at the front side (front face side) and the apparatus frame F is located at the back side (back face side). With such a layout, the sheet placement tray 42 is connected to the fence plate 48 with concave-convex fitting as being movable in the lateral direction (sheet width direction) in FIG. 10.

That is, a convex portion is formed at one of the sheet placement tray 42 and the fence plate 48 and a concave portion is formed at the other thereof, so that both thereof are integrated with fitting (tenon fitting or the like). Slide rollers 48*a* are arranged at the fence plate 48 as being fitting-supported by a lateral guide rail 49. The lateral guide rail 49 is fixed to the apparatus frame F in the sheet width direction.

With such a configuration, when either the fence plate 48 or the sheet placement tray 42 is moved in the sheet width direction, both thereof are concurrently moved by the same amount in the same direction. In the illustrated apparatus, a jog shifting motor GM and a cam member 50 connected to the jog shifting motor GM are arranged at the apparatus frame F. A cam pin 52 is fitted to a cam groove 51 which is formed at the cam member 50 (eccentric cam in FIG. 9). The cam pin 52 is arranged at the fence plate 48 to be integrated therewith.

Here, in the jog shifting motor GM, an encoder 53 is arranged at a rotary shaft thereof, so that a rotational angle thereof is controlled. Further, a home position sensor (not illustrated) is arranged at the rotary shaft.

When the jog shifting motor GM rotates by a predetermined angle, the cam member (eccentric cam in FIG. 9) 50 connected thereto rotates by a predetermined angle. Then, the cam pin 52 fitted to the cam groove 51 moves the fence plate 48 integrated therewith in the sheet width direction by a predetermined amount. In accordance with the movement, the sheet placement tray 42 is also moved integrally in the same direction.

[Sheet Level Detecting Mechanism]

The abovementioned stack tray 40 is provided with a level detecting mechanism 55 which detects a height position of stacked sheets and a sheet tailing end supporting mechanism 65. The level detecting mechanism 55 detects a height level of the upmost sheet among the sheets stacked on the sheet placement tray 42.

Figure 11:
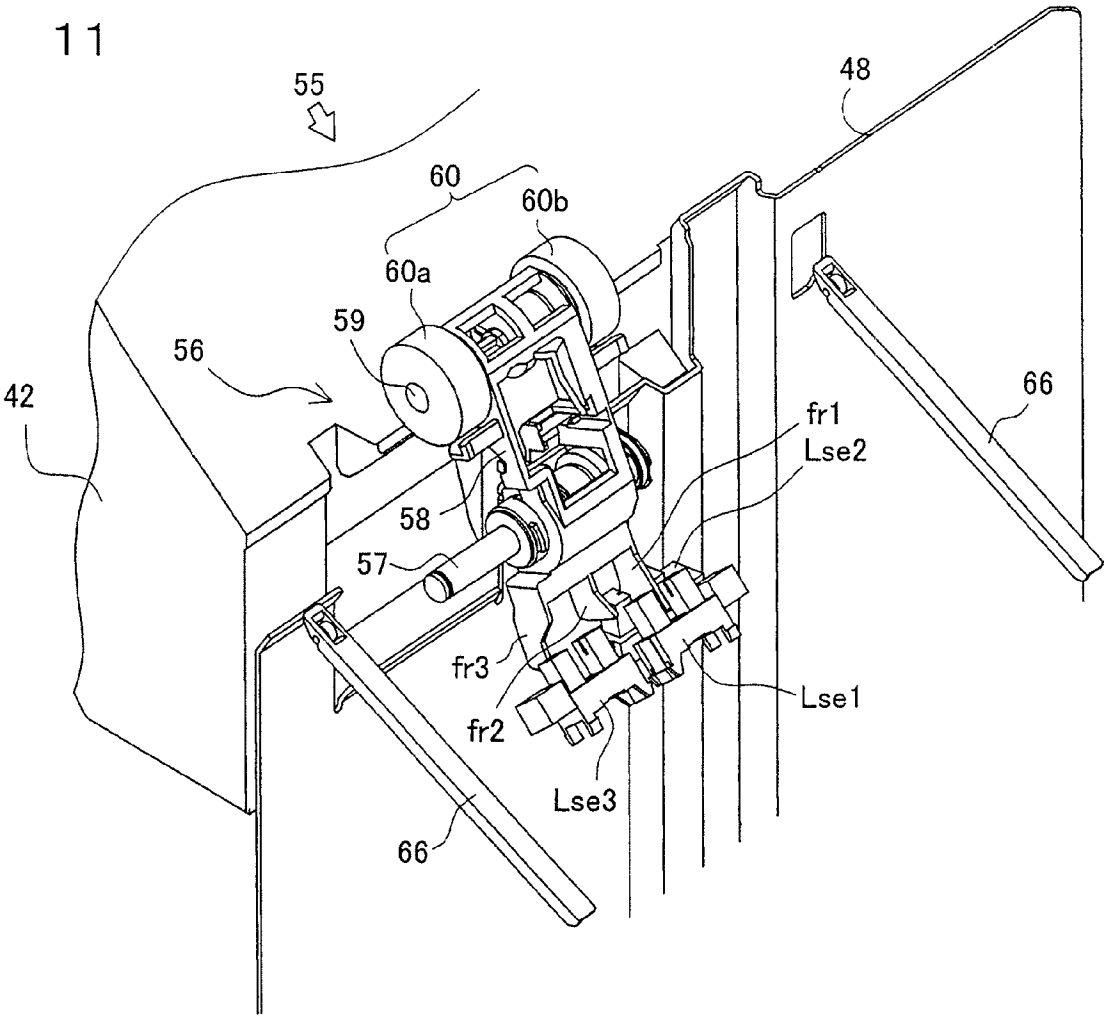
FIG. 11 is an explanatory view of a perspective structure of a sheet holding unit of the stack tray.

As FIG. 11 illustrates a perspective structure thereof, the level detecting mechanism 55 is configured so that a sheet holding unit 56 proceeds to and retracts from the sheet placement tray 42 between a waiting position (state of FIG. 14A) for retracting from the side above the sheet placement tray 42 and an operating position (states of FIGS. 14B and 14C) for engaging with the upmost sheet.

That is, the level detecting mechanism 55 is on standby at the waiting position retracting from a trajectory of a sheet to be stored at the sheet placement tray 42 as dropping through the tray sheet discharging port 13*b* at the upper side and detects a height position as being engaged with the upmost sheet after the sheet is stored onto the sheet placement tray 42.

Here, there is a case that the sheets stacked on the sheet placement tray 42 provides a higher level than a substantial height owing to rising as being influenced by curling, air layers between sheets, and later-mentioned staple needles. Accordingly, the level detecting mechanism 55 includes pressurizing means for sheets. In the illustrated apparatus, the pressurizing means has the following configuration as a sheet holding unit 56.

A swing rotary shaft 57 is bearing-supported by the apparatus frame F. A swing arm 58 is swingably supported at a base end portion by the swing rotary shaft 57. A roller rotary shaft 59 is axially supported by the top end portion of the swing arm 58. A frictional rotor 60 (hereinafter, also called sheet pressurizing member 60*a*, 60*b*) is fixed to the roller rotary shaft 59.

The swing rotary shaft 57 and the swing arm 58 having a set arm length are arranged so as to swing the frictional rotor 60 between a detecting position above the sheet placement tray 42 and a waiting position outside the sheet placement tray 42 as sandwiching the fence plate 48 therebetween. The illustrated frictional rotor 60 is structured with a right-left pair of roller bodies which are mutually distanced.

The roller pair is rotated so that a sheet stored at the sheet placement tray 42 is raked to have a tailing end thereof abutted to the tailing end regulating face 48*f*. For the frictional rotor 60, a drive pulley is arranged at the swing rotary shaft 57 and a roller drive motor RM2 (see FIG. 12) is connected to the drive pulley via a transmission belt 60V.

Figure 12:
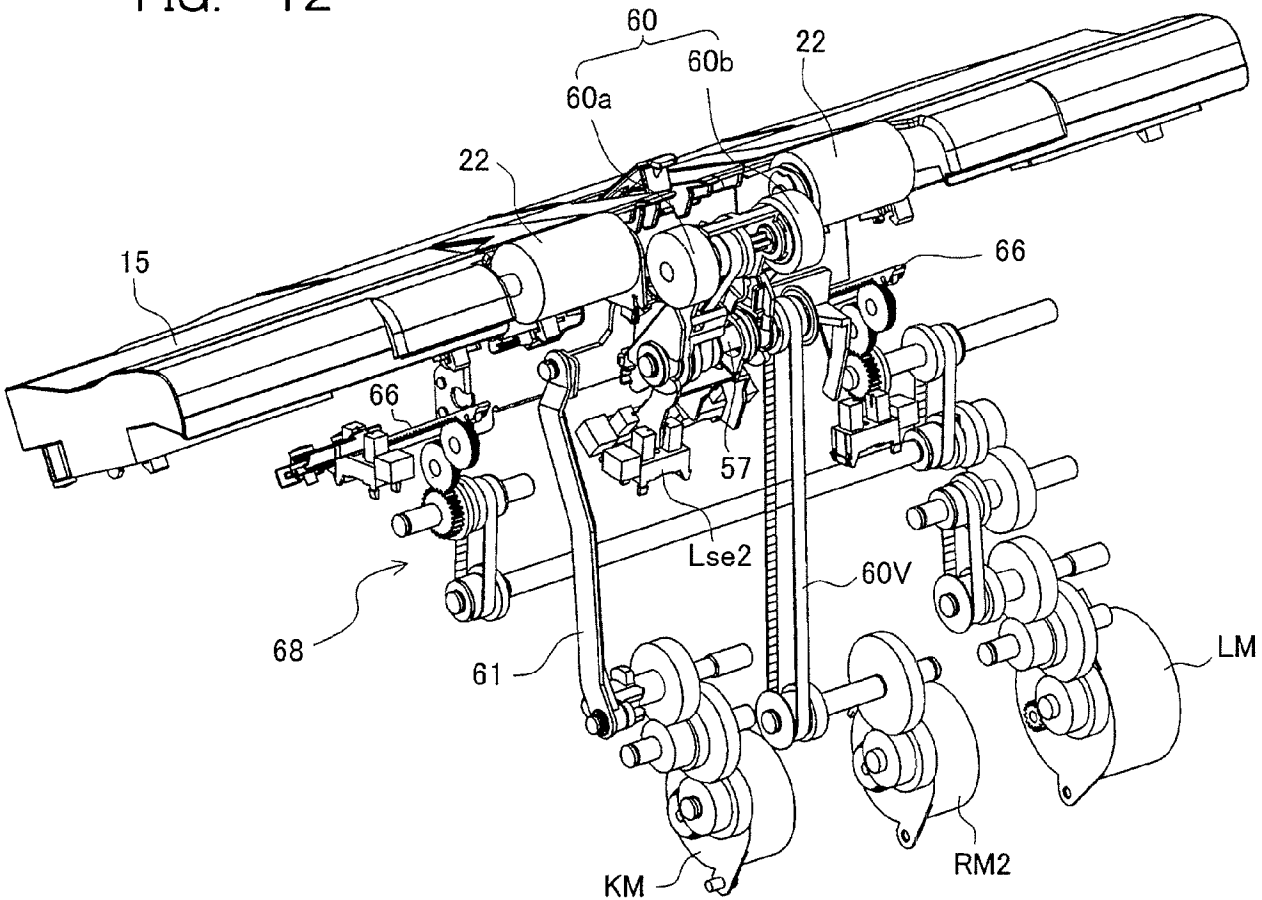
FIG. 12 is an explanatory view of a drive mechanism of the stack tray as illustrating a drive mechanism of a sheet tailing end supporting lever, a drive mechanism of a friction rotor of the sheet holding unit, and a drive mechanism which shifts the sheet holding unit in posture.

As illustrated in FIG. 12, the sheet holding unit 56 is arranged below (the lower roller 22 of) the reversing roller 20 which is arranged at the tray sheet discharging port 13*b*. The sheet holding unit 56 is structured with a swinging mechanism which moves from the outside of the sheet storage trajectory between the tray sheet discharging port 13*b* and the upmost sheet to a position above the sheet.

As illustrated in FIG. 11, the illustrated swinging mechanism includes the swing arm 58 (e.g., roller bracket) swingable about the swing rotary shaft 57 and the frictional rotor 60 (raking roller body; hereinafter, called a roller body) which is rotatably bearing-supported by the swing arm 58.

The illustrated roller body 60 is structured with a pair of roller bodies 60*a*, 60*b* which are mutually distanced in the sheet width direction. Owing to swing motion of the swing arm 58, the roller body 60 mounted on the top end thereof performs reciprocating motion between the waiting position (FIG. 14A) at the inside of the tailing end regulating face (fence plate) 48*f* and a sheet engaging position (the detecting position; FIGS. 14B and 14C) for engaging with the upmost sheet on the sheet placement tray 42.

A press lever 61 is loosely fitted to the swing rotary shaft 57 via a collar member. A sheet holding motor KM illustrated in FIG. 12 is connected to the press lever 61. Then, a pressurizing spring 62 is fixed to the press lever 61 and a top end of the pressurizing spring 62 is arranged at a position to be engaged with the swing arm member 58.

Figure 14A:
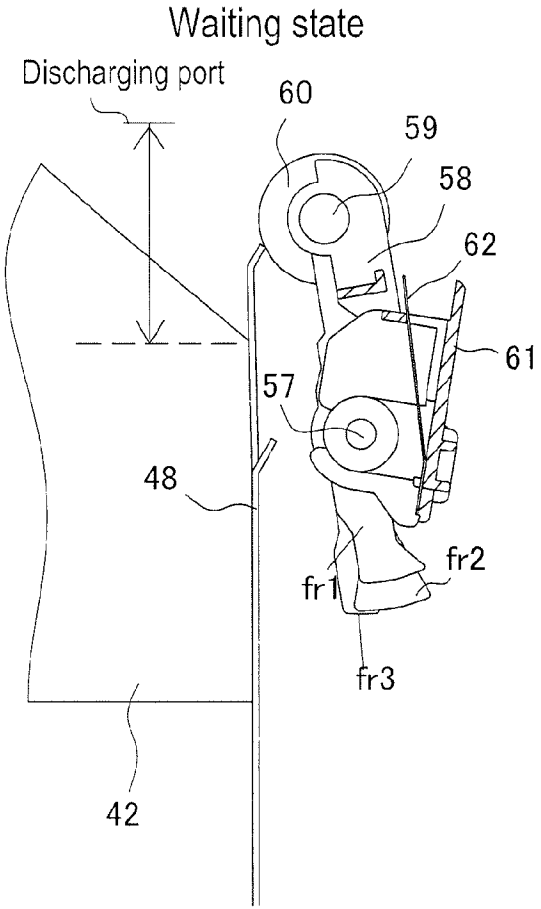
Figure 14B:
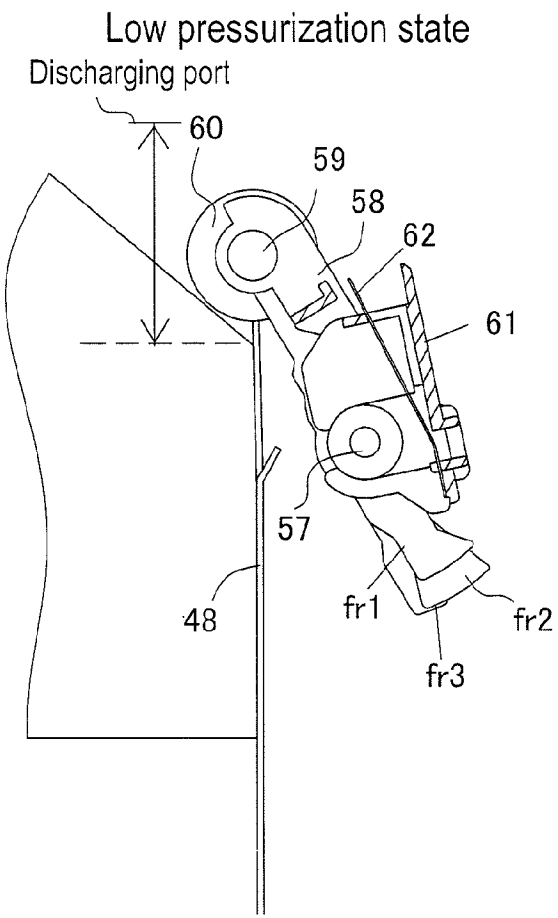
Figure 14C:
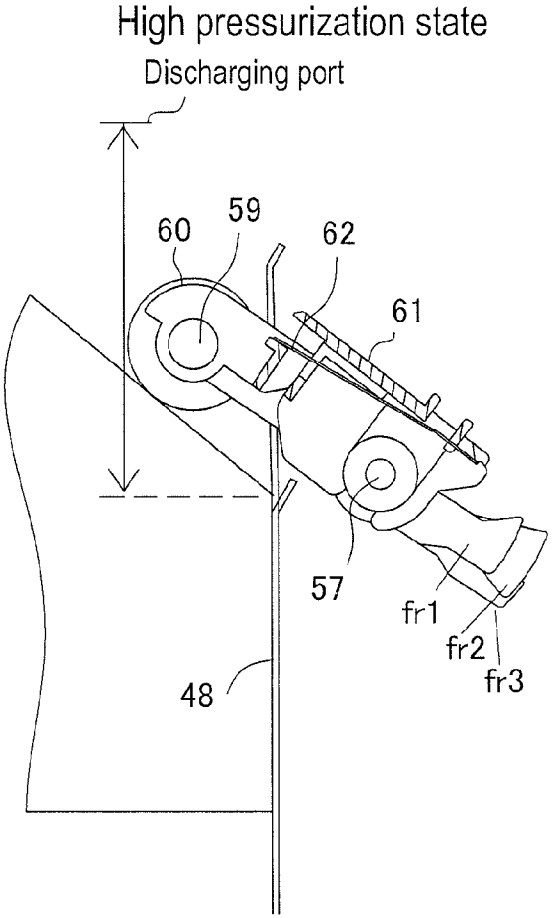

Accordingly, when the sheet holding motor KM rotates within a predetermined angle range, the press lever 61 is rotated from the state of FIG. 14A to the state of FIG. 14B. At that time, the angle is set so that a spring pressure of the pressurizing spring 62 is not exerted. Accordingly, the upmost sheet is pressed by own weight of the sheet holding unit 56 (the roller body 60 and the swing arm 58). Hereinafter, the above state is called a low pressurization state.

When the sheet holding motor KM is rotated further by a predetermined angle in the same direction, the press lever 61 is rotated from the state of FIG. 14B to the state of FIG. 14C. At that time, the pressurizing spring 62 is compressed and the spring force is applied to the swing arm 58.

Accordingly, the roller body 60 presses the upmost sheet in a state that the spring force is added to the own weight. The spring force is set to an urging force to suppress swelling, rolling, winding, and the like of sheets which are stacked on the sheet placement tray 42.

Further, the frictional rotor 60 is structured with a rubber roller, a resin roller, or the like. When being engaged with the upmost sheet in the abovementioned low pressurization state, driving of the roller drive motor RM2 which applies a conveyance force to convey the sheet toward the tailing end regulating face 48*f* is transmitted via the transmission belt 60V.

[Sensor Configuration]

As described above, in the sheet holding unit 56 which is structured with a rotor, a flag fr for angle detection is arranged at the swing rotary shaft 57. In FIG. 10, a first flag fr1, a second flag fr2, and a third flag fr3 are arranged for setting the height position of the sheet placement tray 42 at a first storing height position H1 and a second storing height position H2.

According to the flags fr1, fr2, and fr3, it is possible to detect whether the sheet height of the sheet placement tray 42 is at the previously-set first storing height position H1, at the previously-set second storing height position H2, at the upper side thereof, or at the lower side thereof.

In the above description, the sheet holding unit 56 is structured with the swing arm 58 and the frictional rotor 60 which is mounted thereon. However, not limited to such a structure, it is also possible to adopt a structure with a sheet holding pad and a swing arm which moves the holding pad from a waiting position to a detecting position, for example.

In the following, description will be performed on sheet discharge modes to store sheets at the stack tray 40, positional control of tray height in each sheet discharge mode, and a detection method of the height.

[Sheet Discharge Mode]

Next, description will be performed on the sheet discharge modes of the present invention from the tray sheet discharging port 13*b* to the stack tray 40. Control means 85 described later provides the first sheet discharge mode and the second sheet discharge mode.

The first sheet discharge mode includes a sheet discharging operation to store a sheet fed to the sheet conveying path 11 to the sheet placement tray 42 through the tray sheet discharging port 13*b*. Here, a straight sheet discharging operation to perform discharging sheets fed from the sheet discharging port without performing collating and offsetting and a jog sheet discharging operation to store sheets fed from the sheet discharging port with offsetting for each bundle are performed selectively.

In the second sheet discharge mode, sheets fed to the sheet conveying path 11 are collated and stacked on the processing tray 16 through the tray sheet discharging port 13*b* and a stapling process is performed. At that time, a corner binding process to perform staple binding at one position at a sheet corner and a center binding process to perform staple binding at two positions at a sheet center section are selectively performed.

Owing to later-mentioned control means (hereinafter, also called control CPU) 85, with the straight sheet discharging operation and the jog sheet discharging operation in the first sheet discharge mode, the height of the upmost sheet on the stack tray 40 is set at the first storing height position H1 as described below. With the corner binding operation or the center binding operation in the second sheet discharge mode, the height of the upmost sheet on the stack tray 40 is set at the second storing height position H2 as described below.

Further, owing to the control means 85, during performing the second sheet discharge mode, the sheets fed to the tray sheet discharging port 13*b* of the sheet conveying path 11 are conveyed to a binding position of the processing tray 16. At that time, the control means 85 positions the upmost sheet on the stack tray 40 at the first storing height position H1 as described below.

The first and second storing height positions H1 and H2 will be described with reference to FIG. 7. The first storing height position H1 is set at a position where height difference H1 is formed between the tray sheet discharging port 13*b* and the upmost sheet (hereinafter, also called upmost sheet face) on the sheet placement tray 42. The height difference H1 is set at a height level (height difference) for stacking several sheets with reference to a sheet fed to the sheet discharging port 13.

When the height difference H1 is set high (large), there is a case that a sheet to be stored gets off-balanced owing to an elevation gap. On the contrary, when the height difference H1 is set low (small), it is required to frequently perform a tray lowering operation. Accordingly, the height difference of the first storing height position H1 is set to an appropriate value from experiments and the like in consideration of frequency of the tray lowering operations and alignment of stored sheets.

At the second storing height position H2, a sheet bundle with a binding process performed is stored from the processing tray 16 onto the upmost sheet on the sheet placement tray 42 as being dropped thereon. Here, the height difference H2 between the tray sheet discharging port 13*b* and the upmost sheet face is set larger than a maximum allowable bundle thickness Hmax of a sheet bundle on which a binding process is performed on the processing tray 16.

The height difference H2 is set in consideration of variations of stacked quantity (variations of stacked sheets due to air layers between stacked sheets, wave-shaped winding deformation, curling, and the like) with reference to the maximum allowable bundle thickness Hmax (apparatus specification), for example.

In particular, when staple-bound sheet bundles are stacked on the sheet placement tray 42 (when the later-mentioned second sheet discharge mode is performed), there occurs a phenomenon that staple needle portions are stacked upward to be swelled like a heaping manner. Owing to that sheet faces of sheet bundles stacked on the sheet placement tray 42 get uneven, the second storing height position H2 is set to have the height difference H2 which is sufficiently larger than the maximum allowable bundle thickness Hmax.

Here, a tailing end supporting mechanism 65 (tailing end supporting member 66) which supports a tailing end of a dropping sheet bundle is arranged between the abovementioned storing height position H2 and the tray sheet discharging port 13*b* of the processing tray 16 with a later-described structure. Relations among the tailing end supporting member 66, the first storing height position H1, and the second storing height position H2 will be describe with reference to FIG. 7.

The second storing height position H2 provides the height difference H2 against the tray sheet discharging port 13*b*. The tailing end supporting member 66 which supports a tailing end of a sheet bundle is arranged at a middle position of the height difference H2 as being movable to and from a side above the sheet placement tray 42. A supporting face 66*f* to support a sheet bundle which is dropped through the tray sheet discharging port 13*b* is formed at the tailing end supporting member 66.

Then, the height difference Ha between the tray sheet discharging port 13*b* and the supporting face 66*f* is set larger than the maximum allowable bundle thickness Hmax. Meanwhile, in the illustrated apparatus, height difference Hb between the supporting face 66*f* and the upmost stacked sheet face is set smaller than the maximum allowable bundle thickness Hmax.

That is, expressions being "H2=Ha+Hb" and"Ha>Hmax>Hb" are satisfied as Hmax denoting the maximum allowable sheet bundle thickness. Here, Ha is set larger (higher) than the maximum allowable sheet bundle thickness Hmax so that a sheet bundle dropped through the tray sheet discharging port 13*b* is reliably placed on the supporting member 66.

Further, consideration to reduce impact due to dropping by setting the elevation gap small to the extent possible is made for a sheet bundle which drops onto the upmost stacked sheet from the supporting face 66*f*.

In the above description of the present invention, the height position of the stack tray 40 is controlled in two steps being the first and second storing height positions H1 and H2. Not limited to two steps, controlling with more steps may be adopted.

For example, for introducing a sheet to the processing tray 16 through the tray sheet discharging port 13*b*, the height position of the stack tray 40 may be set to be on the same plane as the sheet placement base 16*a* of the processing tray 16.

Similarly, for storing a sheet bundle by dropping onto the stack tray 40, it is also possible to set a third storing height position which is higher than the second storing height position H2 so that a leading end of a sheet bundle which is discharged from the third storing height position is received by the sheet placement tray face and lowering is performed to the second storing height position H2 in accordance with sheet bundle discharging.

A method of positioning the sheet placement tray 42 at the abovementioned second storing height position H2 will be described. As described above, the second storing height position H2 is set to the sum of the height difference Ha between the tray sheet discharging port 13*b* and the supporting face 66*f* (tailing end supporting member) and the height difference Hb between the supporting face 66*f* and the upmost sheet face in the sheet placement tray 42.

That is, the expression of "H2=Ha+Hb" is satisfied. Here, Ha being a design value is set to a value larger than the maximum allowable sheet bundle thickness Hmax. Meanwhile, Hb being a value smaller than the maximum allowable sheet bundle thickness Hmax is set as follows.

The height position of the sheet placement tray 42 is set by either a first height position setting as considering a bundle thickness of a sheet bundle which is waiting at the processing tray 16 at the upstream side or a second height position setting as the bundle thickness being set at a specified value.

With the first height position setting, the height difference Hb between the supporting face 66*f* and the upmost sheet face on the sheet placement tray 42 is set in consideration of a bundle thickness of a sheet bundle which is to be (or has been) stacked on the processing tray 16.

That is, the height difference Hb is set with reference to the bundle thickness while determining the bundle thickness of the sheet bundle to be stored at the height difference Hb. For example, the setting is performed as satisfying an expression of "(height difference Hb)=(thickness of sheet bundle to be stored)+(clearance gap)".

In this case, (i) the bundle thickness of the sheet bundle is obtained by arranging a bundle thickness detection sensor on the processing tray 16. For example, the detection sensor detects a height position of an engaging piece which engages (not illustrated) with the upmost sheet face of the sheet bundle stacked on the processing tray 16.

Alternatively, (ii) the bundle thickness of the sheet bundle is obtained by counting the number of sheets discharged onto the processing tray 16 with the image forming apparatus A or the discharge sensor Set and multiplying the total number by an average sheet thickness with a job end signal. Thus, the bundle thickness of the sheet bundle can be determined with a method of either (i) or (ii).

With the second height position setting, the height difference Hb between the supporting face 66*f* and the upmost sheet face on the sheet placement tray 42 is set to a specified value which is previously set.

For example, the setting is performed as satisfying an expression of "(height difference Hb)=(maximum allowable sheet bundle thickness)+(clearance gap)".

[Height Position Detection]

As described above, in the sheet holding unit 56, the flag fr for angle detection is arranged at the swing rotary shaft 57. For the first to third flags fr1, fr2, and fr3, first to third sensors LSe1, LSe2, and LSe3 are attached to the apparatus frame F to detect the positions thereof respectively.

Figures 13A, 13B:
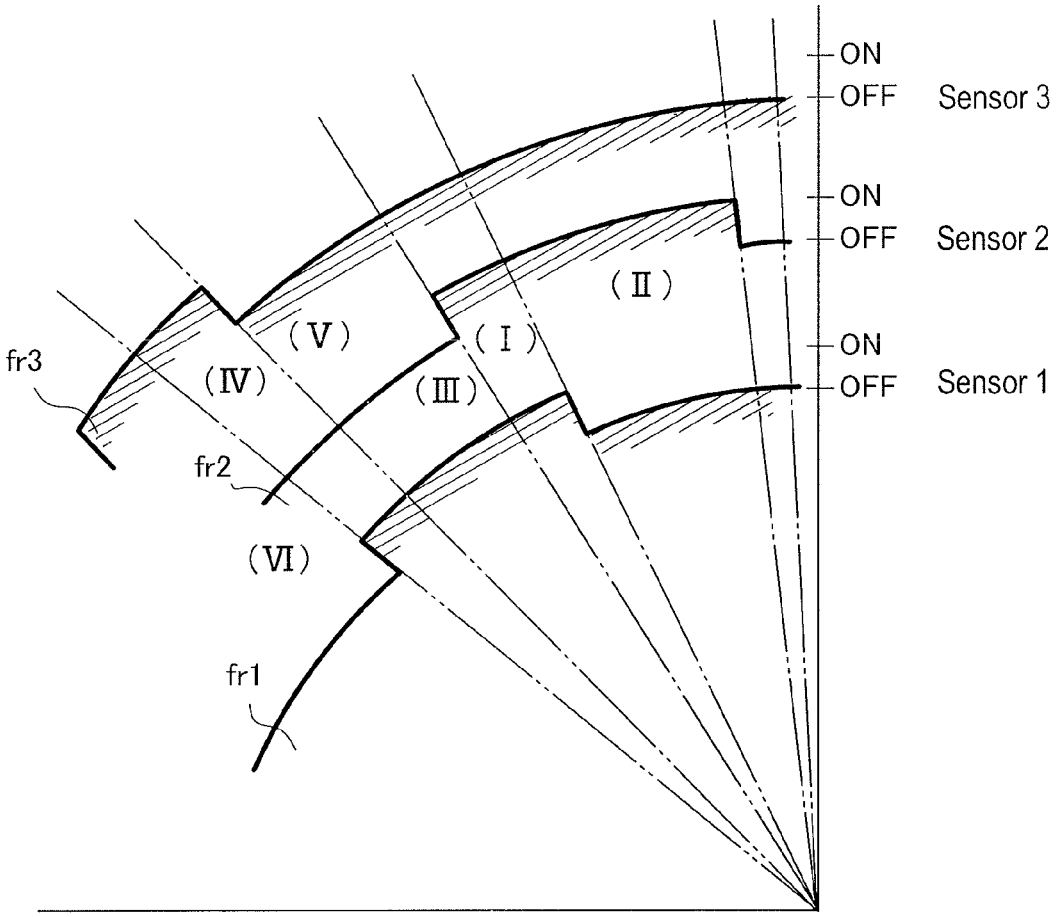
FIG. 13A illustrates shapes of sensor flags of the sheet holding unit for detecting a height level of a sheet stacked on the tray and FIG. 13B illustrates relations between sensors and tray positions.

FIG. 13 illustrates relations between rotational angles of the swing rotary shaft 57 and the respective flags. The first to third sensors LSe1, LSe2, and LSe3 are attached to the apparatus frame F to detect the three flags.

According to positional relations between the sensors and flags as illustrated in FIG. 13, the height level of sheets stacked on the sheet placement tray 42 is detected based on ON/OFF of the first sensor LSe1, ON/OFF of the second sensor LSe2, and ON/OFF of the third sensor LSe3.

Figure 7:
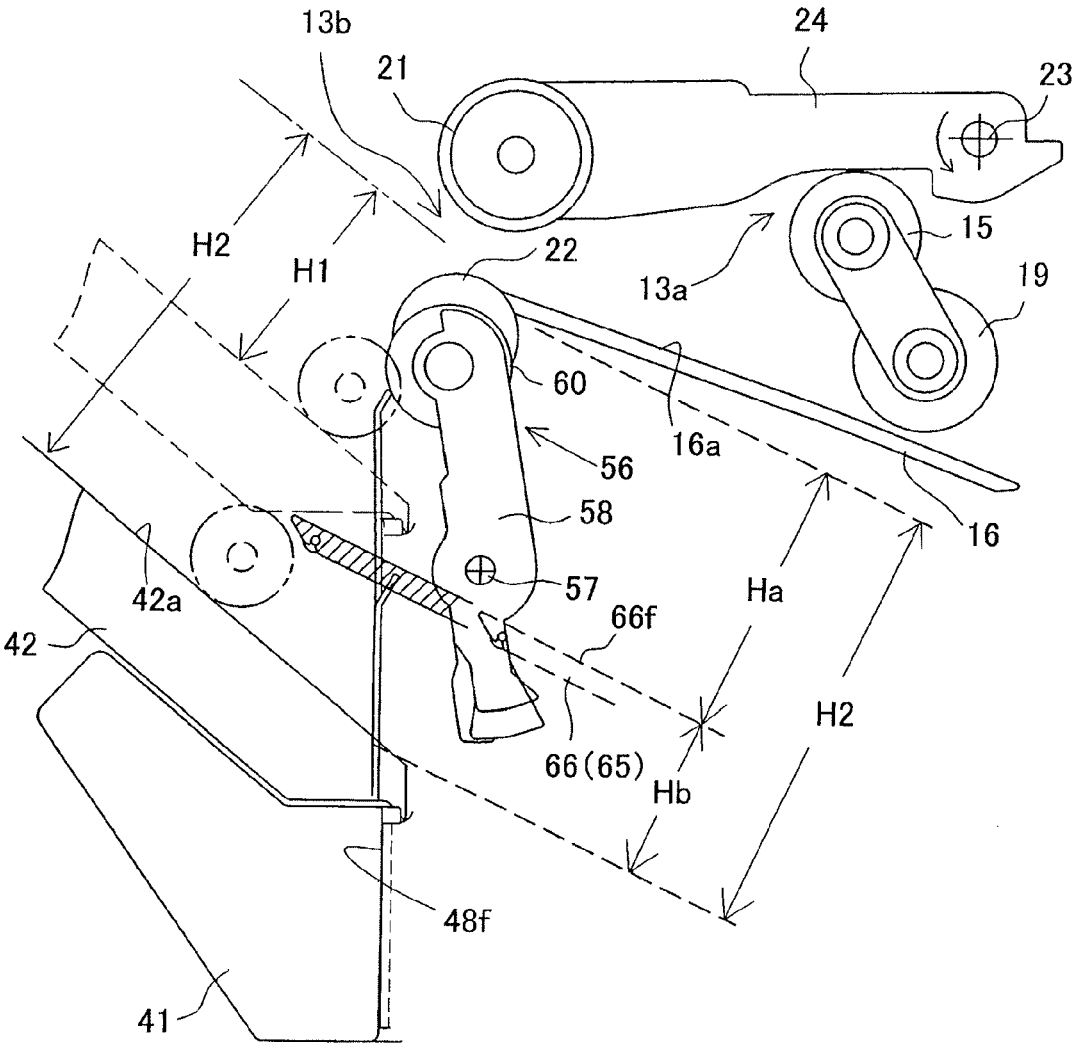
FIG. 7 is a state explanatory view of a sheet holding unit which detects a height position of a stack tray of the post-processing apparatus in FIG. 2.

When the first sensor LSe1 is OFF, the second sensor LSe2 is OFF, and the third sensor LSe3 is OFF, the sheet holding unit 56 is located at the waiting position (home position as illustrated with solid line in FIG. 7). The sensors and flags are arranged at angle positions to satisfy the above.

When the first sensor LSe1 is OFF and the second sensor LSe2 is ON, it is indicated that the sheet holding unit 56 is located at a position being higher than the first storing height. When the first sensor LSe1 is ON and the second sensor LSe2 is OFF, it is indicated that the sheet holding unit 56 is located at a position being lower than the first storing height.

Similarly, when the first sensor LSe1 is ON and the third sensor LSe3 is ON, it is indicated that the sheet holding unit 56 is located at an appropriate position of the second storing height (second level). When the first sensor LSe1 is ON and the third sensor LSe3 is OFF, it is indicated that the sheet holding unit 56 is located at a position being higher than the second storing height. When the first sensor LSe1 is OFF and the third sensor LSe3 is ON, it is indicated that the sheet holding unit 56 is located at a position being lower than the second storing height.

Here, when the sheet placement tray 42 is set at the first storing height position H1, sheets are stored at the sheet placement tray 42 one by one in the abovementioned first sheet discharge mode. Here, the pressurizing means (press lever 61) is maintained at a non-operating position.

When the sheet placement tray 42 is set at the second storing height position H2, sheet bundles are stored at the sheet placement tray 42 from the processing tray 16 in a later-mentioned second conveyance mode. Here, the pressurizing means (press lever 61) is maintained at a pressurizing position.

Further, the frictional rotor 60 is rotated so that a tailing end of a sheet stored on the upmost sheet face from the tray sheet discharging port 13*b* in the later-mentioned first sheet discharge mode is abutted to the tailing end regulating face 48*f*. At that time, the frictional rotor 60 presses a sheet face with the low pressurization force (own weight of the roller and the swing arm). In a second sheet discharge mode to discharge a sheet bundle from the processing tray 16, sheets are pressed (with the high pressurization force) simply in a state that a rotation force is not applied to the frictional rotor 60.

[Duplex Mechanism]

In the present invention, a sheet having an image formed on a front face thereof by the image forming apparatus A is re-fed to the image forming portion 4 after being face-reversed and a duplex mechanism which discharges the sheet to the post-processing apparatus B after an image is formed on a back face thereof is configured as follows.

FIG. 1 illustrates an embodiment of the duplex mechanism. The illustrated duplex mechanism includes the duplex path 7 which is connected to the body sheet discharging path 5. The duplex path 7 includes the switch-back path 7*a* and the U-turn path 7*b*.

The switch-back path 7*a* is connected via path switching means 9 as diverging from the body sheet discharging path 5. Further, the U-turn path 7*b* is also connected so that a sheet re-fed to the body sheet discharging path 5 is circulated to the image forming portion 4 via the path switching means 9.

The connecting port 8 is formed at the housing 1. The switch-back path 7*a* is connected to the connecting port 8 as the linear path 34 and the guide tray 32 connected thereto. Accordingly, a sheet fed from the body sheet discharging path 5 is reversed in the conveying direction at the linear path 34 and the guide tray 32 and is re-fed to the body sheet discharging path 5.

The U-turn path 7*b* on which the sheet re-fed to the body sheet discharging path 5 is face-reversed is connected to the image forming apparatus A via the path switching means 9. The U-turn path 7*b* is formed as a loop path to re-feed a sheet to the image forming portion 4 after face-reversing.

With such a configuration, a sheet with an image formed thereon by the image forming portion 4 is conveyed to the switch-back path 7*a* from the body sheet discharging path 5 and the conveying direction thereof is reversed on the switch-back path 7*a*. Then, the sheet is conveyed from the body sheet discharging path 5 to the U-turn path 7*b* by the path switching means 9 and is re-fed to the image forming portion 4 after being face-reversed at the U-turn path 7*b*.

Next, a structure of the switch-back path 7*a* will be described with reference to FIG. 2. The connecting port 8 is formed at the housing 1 (external casing) of the image forming apparatus A. A sheet is conveyed from the body sheet discharging path 5 to the connecting port 8 via the path switching means 9.

The linear path 34 is formed as a sheet guide at a bottom portion of the housing 10 of the post-processing apparatus B. The post-processing means 17 and the processing tray 16 are arranged above the linear path 34. That is, the linear path 34 structuring the switch-back path 7*a* is arranged at a space below the processing tray 16 and the post-processing means 17 of the post-processing apparatus B.

The guide tray 32 is connected to the linear path 34, so that discharging and introducing of a sheet is performed between the linear path 34 and the guide tray 32. The guide tray 32 is structured with a sheet placement tray protruding outward from the housing 10 as being arranged below the stack tray 40.

Figure 15A:
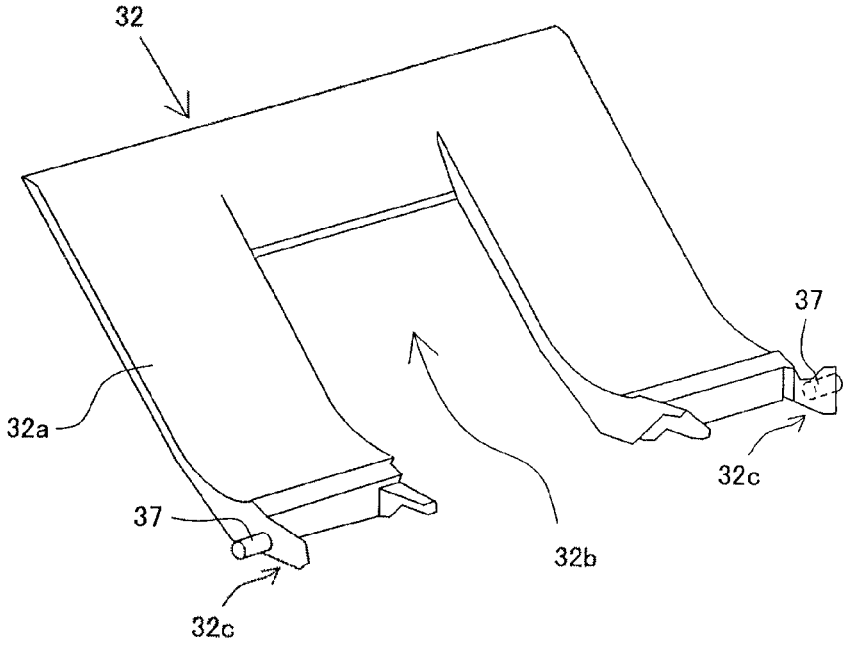

As illustrated in FIG. 15A, the guide tray 32 includes a supporting face (hereinafter, called a tray face) 32*a* which supports a sheet and an opening portion 32*b* at the center of the tray face 32*a*. The opening portion 32*b* forms a later-mentioned operational opening for pulling out a sheet jammed at the linear path 34 to the outside of the housing 10.

Further, an attaching portion 32*c* for being attached to the housing 10 is arranged at the guide tray 32. The attaching portion 32*c* is axially supported by a frame (a part of the housing 10) in a rotatable manner. As illustrated in FIG. 15A, axial support pins 37 are arranged.

A conveying roller 35 is arranged in a vicinity of the connecting port 8 which is formed at the housing 1 of the image forming apparatus A as described above. A forward-reverse motor (not illustrated) is drive-connected to the conveying roller 35 so that the conveying roller 35 can convey a sheet in the sheet discharging direction and a direction opposite to the sheet conveying direction.

Here, the path length of the linear path 34 and the guide tray 32 which structures the switch-back path 7*a* is set shorter than a length of a minimum size sheet for duplex printing in the conveying direction.

Thus, the conveying roller 35 capable of being rotated forwardly and reversely is arranged at the switch-back path 7*a* at the image forming apparatus A side. Here, a conveying roller having drive means is not arranged at the post-processing apparatus B side.

Owing to that sheet conveyance control of the switch-back path 7*a* is performed only by a control unit in the image forming apparatus A, interface ports for transmitting and receiving control signals with the post-processing apparatus B can be eliminated.

Here, also in the above case, it is possible to arrange an idling roller without having a driving function such as a guide roller at the switch-back path 7*a* (e.g., the linear path 34) of the post-processing apparatus B.

Next, a structure of the U-turn path 7*b* will be described with reference to FIG. 1. The U-turn path 7*b* is connected to the body sheet discharging path 5 via the path switching means 9. The U-turn path 7*b* is structured with a path having a loop shape to circulate and convey, from the switch-back path 7*a* to the image forming portion 4, a sheet with the conveying direction reversed so as to face-reverse the sheet. Conveying roller pairs are arranged at the U-turn path 7*b* at appropriate intervals, so that a sheet introduced into the path is conveying toward the image forming portion 4.

As described above, the image forming apparatus A conveys a sheet fed from the sheet feeding portion 2 to the image forming portion 4 and forms an image on a face of the sheet. Then, the sheet is conveyed from the body sheet discharging path 5 to the post-processing apparatus B and is stored at the stack tray 40.

Alternatively, a sheet with an image formed on a face thereof is fed to the switch-back path 7*a* from the body sheet discharging path 5 and re-fed to the image forming portion 4 as being face-reversed at the U-turn path after being reversed in the conveying direction.

Then, after an image is formed on a back face of the sheet at the image forming portion 4, the sheet is conveyed from the body sheet discharging path 5 to the body sheet discharging port 6. Then, a second sheet discharge mode (binding process mode) in which sheets are stored at the stack tray 40 after being staple-bound as being collated and stacked at the processing tray 16 in the post-processing apparatus B and a first sheet discharge mode (print-out mode) in which a sheet fed to the body sheet discharging port 6 is stored at the stack tray 40 without being stacked on the processing tray 16 in the post-processing apparatus B are selectively performed.

[Mutual Configuration of the Stack Tray and the Guide Tray]

FIG. 8 illustrates a relation between the sheet placement tray 42 of the stack tray 40 and the guide tray 32. The stack tray 40 (hereinafter, being the sheet placement tray 42 in the illustrated apparatus) is arranged at the upper side and the guide tray 32 is arranged at the lower side in the sheet stacking direction. The stack tray 40 is structured with the sheet placement tray 42 which vertically moves in the sheet stacking direction and the guide tray 32 is fixed therebelow.

Both of the sheet placement face 42*a* of the stack tray 42 and the supporting face 32*a* of the guide tray 32 are inclined respectively at an acute angle with respect to the tailing end regulating face 48*f*. The sheet placement face 42*a* is set at a first inclination angle $\alpha$ and the supporting face 32*a* is set at a second inclination angle $\beta$.

Further, the guide tray 32 is formed to have a shape having the second inclination angle $\beta$ from the tailing end regulating face 48*f* and a third inclination angle $\gamma$ continued from the second inclination angle $\beta$.

Here, the first inclination angle $\alpha$, the second inclination angle $\beta$, and the third inclination angle $\gamma$ are formed to satisfy "$\beta>\alpha>\gamma$", that is, the second, the first, and the third inclination angles are formed in descending order with reference to the tailing end supporting face 48*f*. With such an angle configuration, the stack tray 40 located at the upper side is protruded to the outside of the housing 10 from the tailing end regulating face 48*f* at the first inclination angle $\alpha$, as illustrated in FIG. 8.

Further, the guide tray 32 located at the lower side is protruded to the outside of the housing 10 from the tailing end regulating face 48*f* at the second inclination angle $\beta$. Here, the second inclination angle $\beta$ is formed at an inclination angle being gentler (larger) than the first inclination angle $\alpha$ ($\beta>\alpha$).

Accordingly, as illustrated by broken lines in FIG. 8, the stack tray 40 at the upper side and the guide tray 32 at the lower side are in a mutually-closed state. In contrast, when the second inclination angle $\beta$ is set shaper than the first inclination angle $\alpha$, a dead space having a triangle shape is formed between the stack tray 40 and the guide tray 32 and both the trays cannot be mutually closed.

Then, the guide tray 32 has the shape having the third inclination angle $\gamma$ continued from the second inclination angle $\beta$. Here, the third inclination angle $\gamma$ is set to be sharper (smaller) than the first inclination angle $\alpha$ ($\alpha>\gamma$).

Thus, as illustrated in FIG. 8, the stack tray 40 and the guide tray 32 are formed so that a tray top end distance H4 therebetween is small and a tray base end distance H3 therebetween is large (H3>H4). Accordingly, there is not a fear that a foreign matter is sandwiched between the lowering stack tray 40 and the guide tray 32.

Further, since the stack tray 40 located at the upper side and the guide tray 32 located at the lower side are formed so that the tray top end distance H4 therebetween is small, a false operation to pull out a sheet discharged on the guide tray 32 with false recognition of a user that the sheet is discharged to the outside of the apparatus is less caused.

The above is understandable with a tendency that a sheet discharged from the lower side is recognized as an image-formed sheet by mistake with a tray distance being wide outward in a case that the third inclination angle $\gamma$ of the guide tray 32 is set to be gentler than the first inclination angle $\alpha$ of the stack tray 40.

Figure 15B:
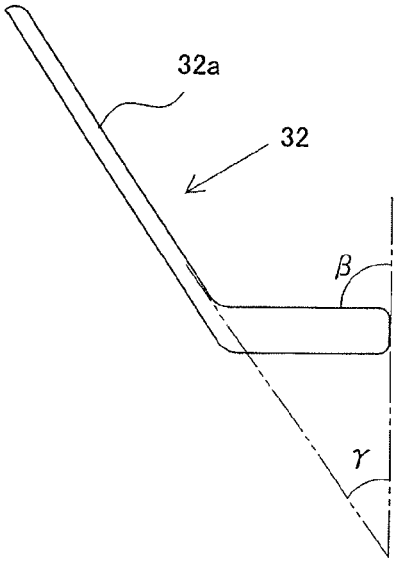
Figure 15C:
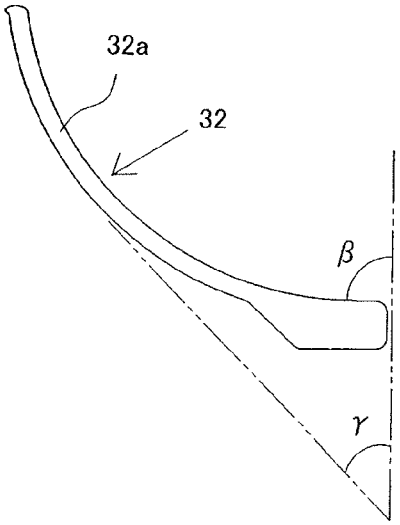

FIGS. 15B and 15C illustrate embodiments of different shapes of the guide tray 32. FIG. 15B illustrates a tray shape in which the second inclination angle $\beta$ and the third inclination angle $\gamma$ are formed by approximately linear shapes. With such a configuration, the second inclination angle $\beta$ and the third inclination angle $\gamma$ can be set to have a small distance between stack tray 40 and the guide tray 32. However, there arises a problem that a duplex sheet cannot be smoothly guided.

FIG. 15C illustrates a tray shape curved like a U-shape with the second inclination angle $\beta$ and the third inclination angle $\gamma$. With such a tray shape, smooth guiding of a duplex sheet is achieved.

In short, the shape of the guide tray 32 and second and third inclination angles are designed in consideration of a guide function to smoothly convey a duplex sheet and a function to narrow a space distance against the stack tray 40.

Next, a supporting structure of the guide tray 32 will be described with reference to FIGS. 16A and 16B. The guide tray 32 is axially supported by an appropriate frame in the housing 10 of the post-processing apparatus B with the axial support pin 37 in a rotatable manner.

Figure 16A:
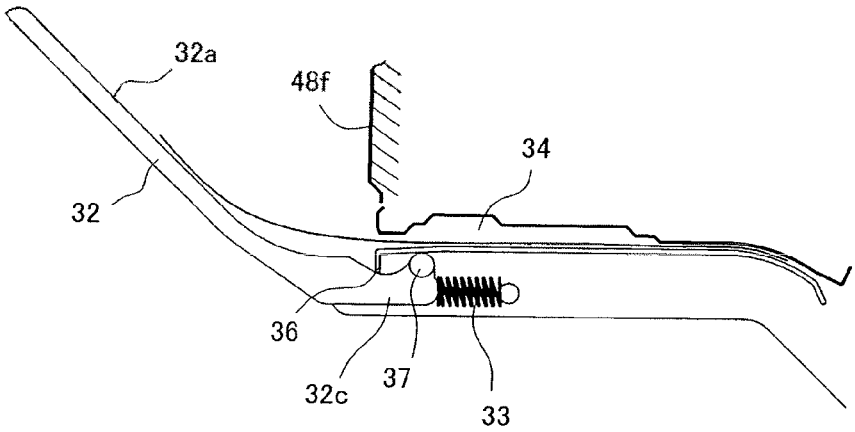

Then, an urging spring 33 (compression spring in the drawing) is arranged at the tray base portion, so that the guide tray 32 is continuously urged toward an attached state as illustrated in FIG. 16A. A stopper 36 maintains the attached state (state in FIG. 16A) with an urging force of the urging spring 33.

Figure 16B:
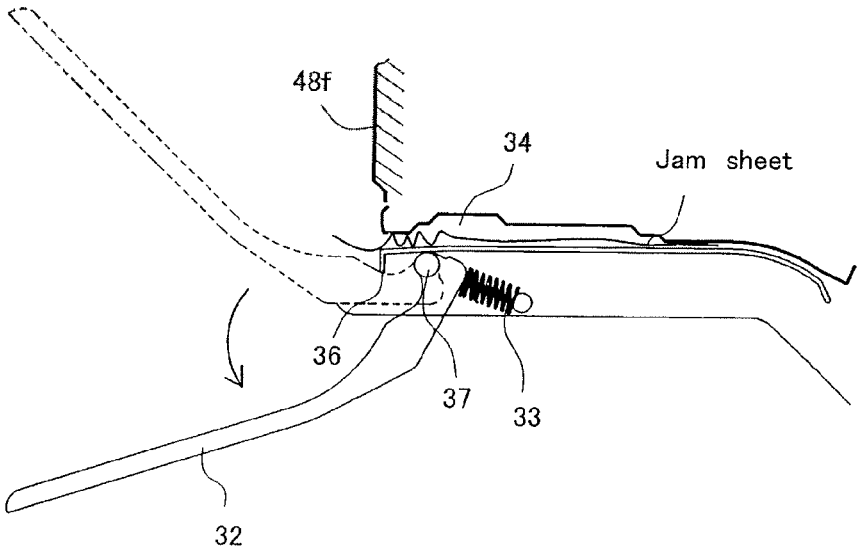

FIG. 16B illustrates a state in which a sheet to be introduced and discharged is removed when sheet jamming occurs therewith on the linear path 34 continued to the guide tray 32.

The guide tray 32 which is rotatably supported by the axial support pin 37 is rotatable from a state illustrated by a broken line to a state illustrated by a solid line in FIG. 16B against the urging force of the urging spring 33.

Thus, when sheet jamming occurs on the linear path 34, the guide tray 32 is opened in the solid line state and a jammed sheet on the linear path 34 is removed outward. The opening portion 32*b* of the guide tray 32 provides a space which facilitates the above operation.

Further, owing to that the rotation support 37 of the guide tray 32 is arranged at the linear path side from the tailing end regulating face 48*f*, a space can be produced in the vicinity of the tailing end regulating face 48*f* with the rotation of the guide tray 32.

Further, when the guide tray 32 is rotated as exceeding a predetermined angle, the axial support pin 37 is disengaged with deflection of the guide tray 32, so that the guide tray 32 is removed. Thus, breakage of the apparatus due to sandwiching of a foreign matter at a space against the stack tray 40 is prevented and safety of the apparatus is improved.

[Sheet Tailing End Supporting Mechanism]

As described above, the illustrated post-processing apparatus B provides the first sheet discharge mode and the second sheet discharge mode. In the first sheet discharge mode, the height difference between the tray sheet discharging port 13*b* and the upmost sheet face on the sheet placement tray 42 is set to the first storing height position H1.

In the second sheet discharge mode, the height difference H2 between the tray sheet discharging port 13*b* and the sheet placement tray 42 is set to the second storing height position H2 (second level Hv2). The first height difference is set small and the second height difference is set large, that is, the height difference H1 is smaller than the height difference H2.

The sheet tailing end supporting mechanism 65 is arranged at the middle position to support a tailing end of a sheet bundle when a sheet bundle is stored as being dropped onto the upmost sheet face on the sheet placement tray 42 from the tray sheet discharging port 13*b* in the second sheet discharge mode under such sheet discharge conditions.

Figure 17:
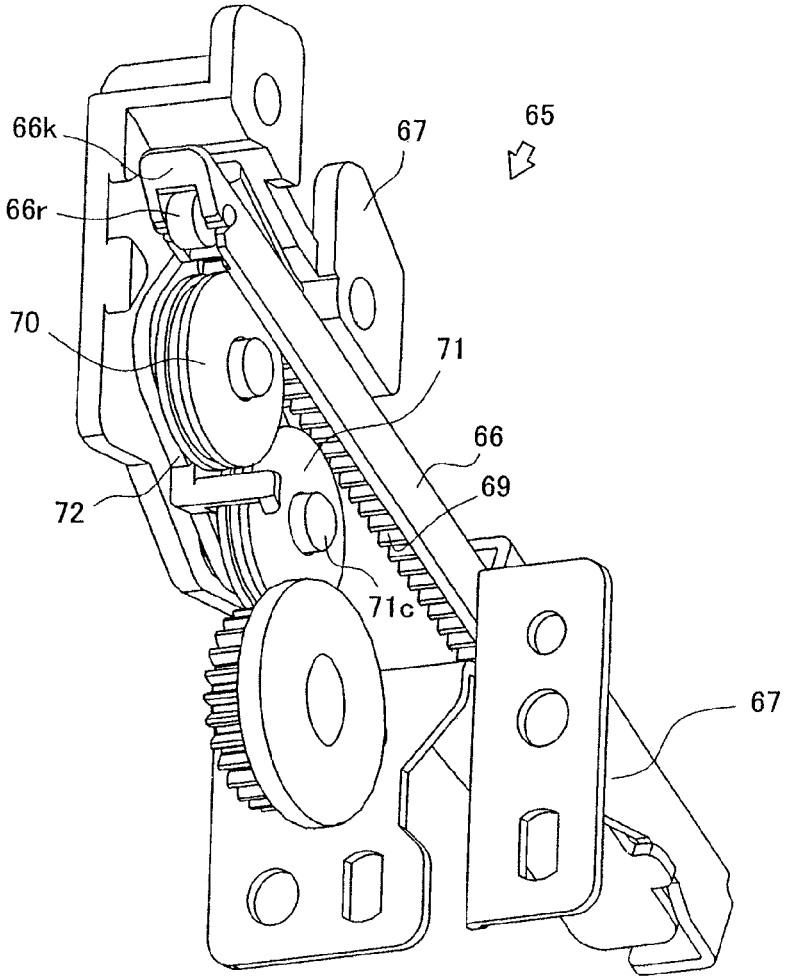
FIG. 17 is an explanatory view of a perspective structure of a tailing end supporting member of the stack tray.

FIG. 17 is an explanatory perspective view of the sheet tailing end supporting mechanism 65. A pair of the tailing end supporting mechanisms 65 each having the illustrated structure are arranged laterally distanced in the sheet width direction. The positional relation thereof is illustrated in FIG. 7. The tailing end supporting mechanisms 65 are arranged at both sides of the abovementioned sheet holding unit 56. The tailing end supporting mechanism 65 at one side will be described with reference to FIG. 17. The mechanism at the other side is the same.

The tailing end supporting mechanism 65 includes the tailing end supporting member 66 which has the supporting face 66*f*, a slide guide 67 (hereinafter, also called a holder member) which supports the tailing end supporting member 66 to be movable between the waiting position Wp retracting from the side above the sheet placement tray 42 and the operating position Ap above the sheet placement tray 42, and lever shifting means 68 which moves the tailing end supporting member between the waiting position Wp and the operating position Ap.

The tailing end supporting member 66 temporarily supports a tailing end of a sheet bundle which drops through the tray sheet discharging port 13*b*. Hence, the tailing end supporting member 66 includes the supporting face 66*f* (also called the support face) which receives and supports a tailing end of a sheet bundle dropping from the upper side is arranged at a middle position between the tray sheet discharging port 13*b* and the upmost sheet face.

The tailing end supporting member 66 is arranged at a height position set between the tray sheet discharging port 13*b* and the upmost sheet face (having a distance Ha against the tray sheet discharging port 13*b* and a distance Hb against the upmost sheet face illustrated in FIG. 7).

The tailing end supporting member 66 is supported by being fitted to the slide guide 67 as being movable between the operating position Ap (illustrated by a solid line in FIG. 7) above the sheet placement tray 42 and the waiting position Wp (illustrated by a broken line in FIG. 7) retracting outside the sheet placement tray 42.

The slide guide 67 is fixed to the apparatus frame F. When a sheet bundle is discharged through the tray sheet discharging port 13*b*, the slide guide 67 moves from the waiting position Wp to the operating position Ap in accordance with discharging timing thereof, supports a tailing end of the sheet bundle dropping onto the sheet placement face above the sheet placement face, and moves rearward after the supporting from the operating position to the waiting position.

Accordingly, the sheet tailing end supported on the supporting face 66*f* is stored on the stacked sheet owing to the rearward moving to the waiting position.

The illustrated tailing end supporting member 66 is structured with a plate-shaped lever member having a predetermined width in the sheet width direction and is configured to proceed to and retract from the side above the sheet placement tray 42 through the fence plate 48 of the apparatus frame F. As illustrated in FIG. 7, the tailing end supporting member 66 is arranged at the middle position of the height difference H2 between the tray sheet discharging port 13*b* and the upmost sheet face while the height Ha in FIG. 7 is set to a distance being larger than the maximum allowable sheet bundle thickness Hmax (Ha>Hmax).

Meanwhile, the distance Hb between the supporting face 66*f* and the upmost sheet face is set smaller than the distance Ha between the tray sheet discharging port 13*b* and the tailing end supporting member 66.

Further, when the distance Hb between the supporting face 66*f* and the upmost sheet face is set to a distance being smaller than the maximum allowable sheet bundle thickness Hmax, the sheet tailing end supported by the supporting face 66*f* can make a soft landing onto the upmost on the sheet placement tray 42.

Following is the reason why height setting of the tailing end supporting member 66 is performed as described above. If the supporting face does not exist, a sheet bundle drops through the tray sheet discharging port 13*b* with the height difference H2 (=Ha+Hb). Owing to the impact at that time, the dropping sheet bundle and sheet bundles stacked on the sheet placement tray 42 are disturbed in posture to cause positional shifting, collapsing, and the like.

In contrast, when the supporting face 66*f* exists at the middle position (Ha) of the height difference H2, first, the sheet bundle drops onto the supporting face 66*f* through the tray sheet discharging port 13*b*, and subsequently, drops onto the stacked sheet face with the height difference Hb.

Accordingly, dropping impact is eased and the dropping sheet bundle and the stacked sheet bundles are prevented from being collapsed.

In the illustrated apparatus, the tailing end supporting member 66 has a configuration having features of (i) being structured with the plate-shaped lever member, (ii) differentiating angles of proceeding to and retracting from the sheet placement tray 42, (iii) forming the top end thereof as an inclined face to follow a sheet face shape of a sheet bundle on the sheet placement tray 42, and (iv) arranging an idling roller at the inclined face. Each configuration thereof will be described.

Figure 18:
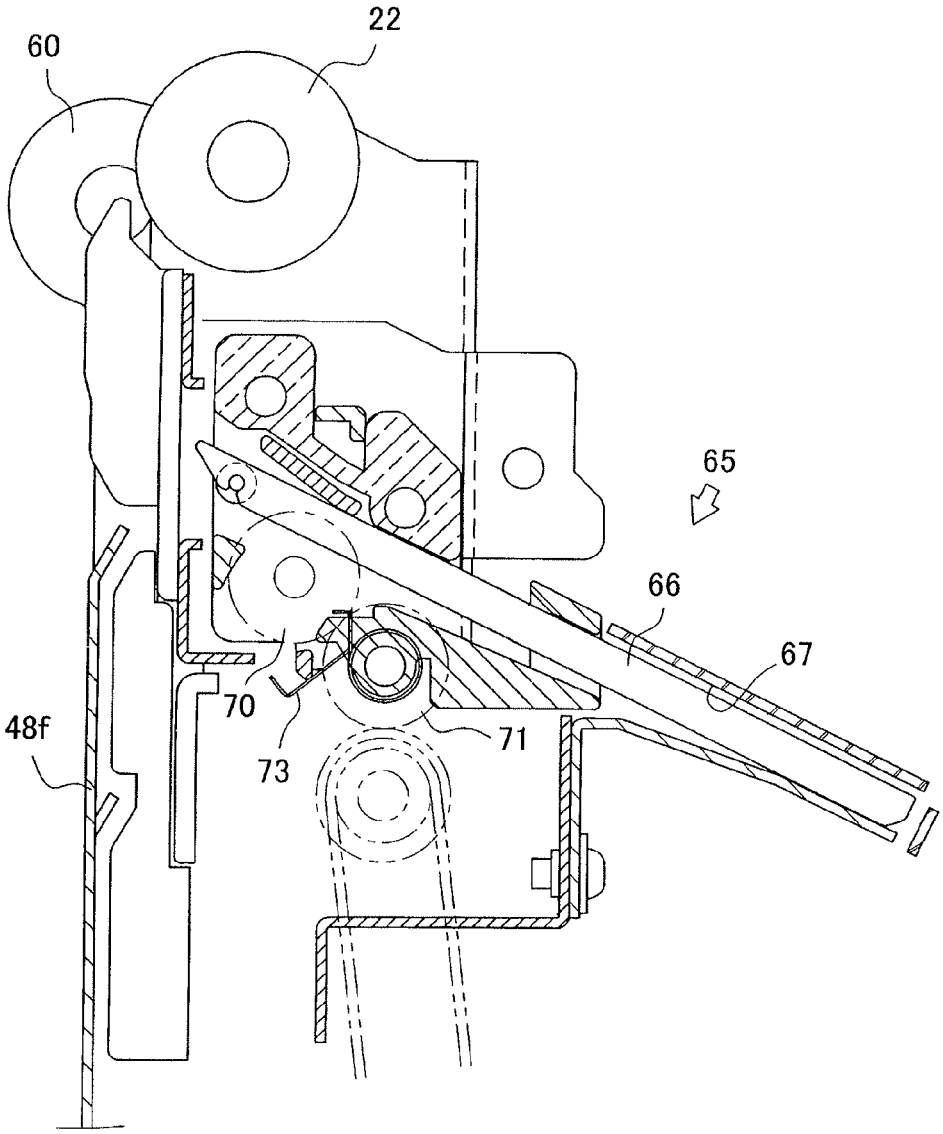
FIG. 18 is an explanatory view of a mechanism which causes the tailing end supporting member to proceed to and retract from the tray.
Figure 19A:
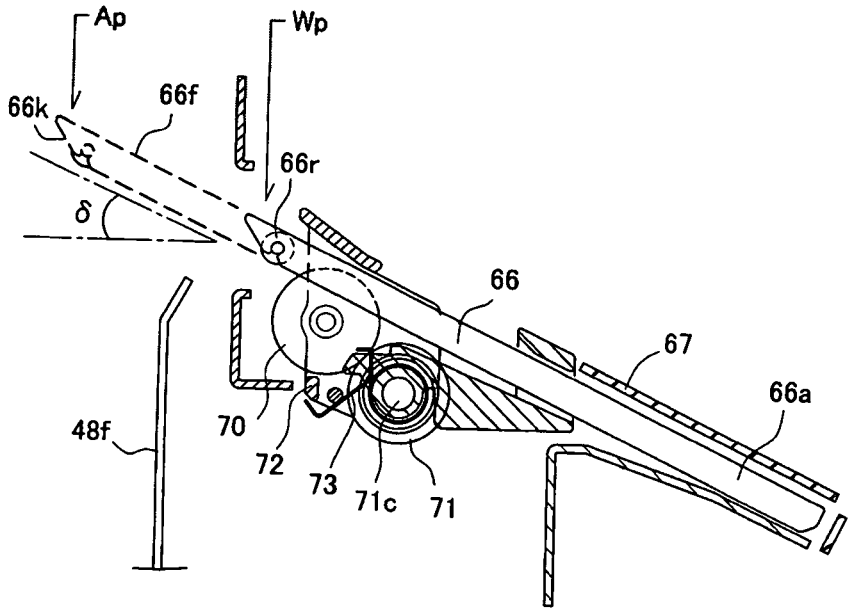
Figure 19B:
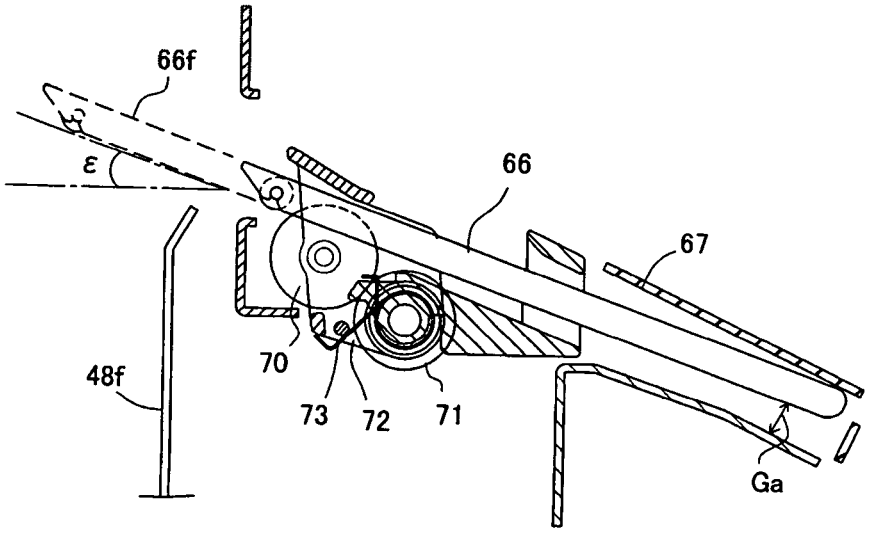
Figure 20:
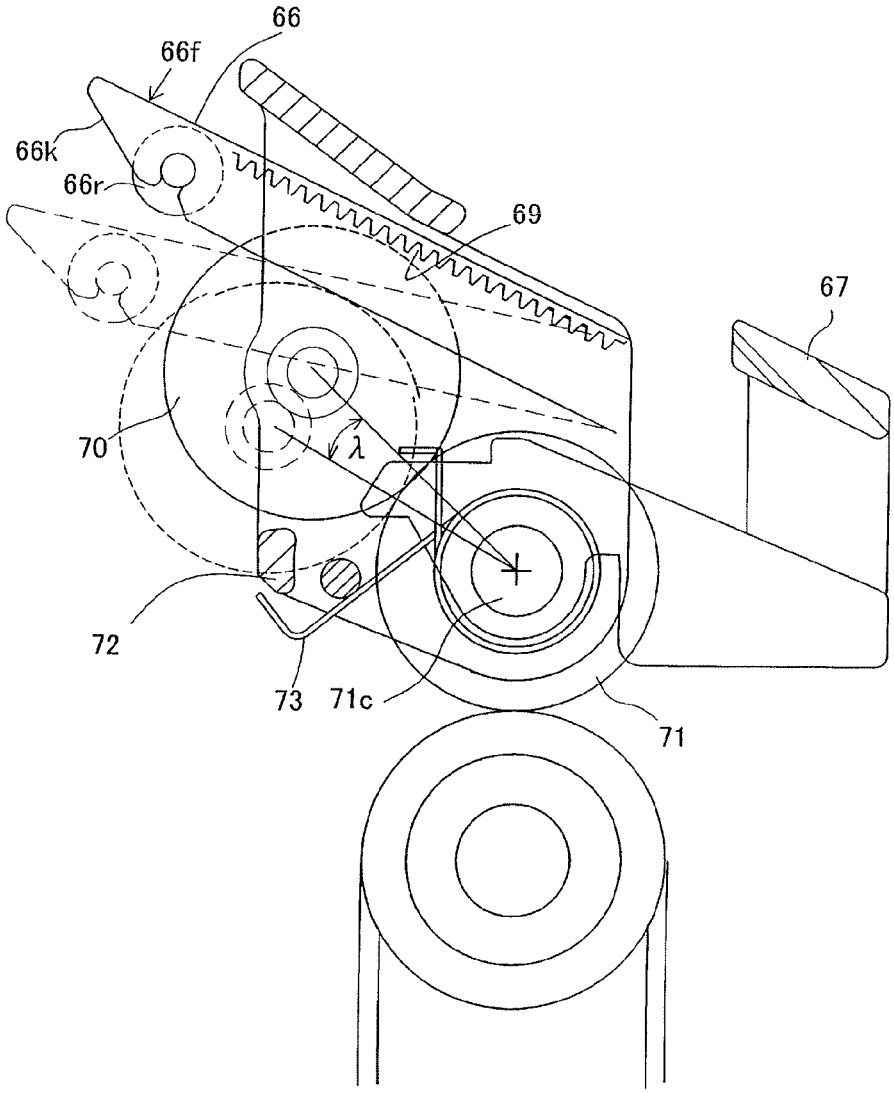
FIG. 20 is an explanatory view illustrating a planetary gear mechanism which varies an angle of the tailing end supporting member.

The tailing end supporting mechanism 65 is illustrated in FIGS. 17 to 20; while FIG. 17 is an explanatory perspective view, FIG. 18 is a plane view in an assembled state, FIGS. 19A and 19B illustrate operation states of the tailing end supporting member, and FIG. 20 illustrates a state of varying an angle thereof. As illustrated in FIG. 17, the tailing end supporting member 66 is structured with the plate-shaped lever member and the lever member is supported by the slide guide 67 (holder member) which is fixed to the apparatus frame F.

As illustrated in FIGS. 19A and 19B, the lever member 66 is moved from the waiting position illustrated by a solid line to the operating position illustrated by a broken line along the slide guide 67. A later-mentioned rack 69 is arranged at the lever member 66 and a pinion 70 which is engaged therewith is connected to a lever operating motor LM (see FIG. 12).

The supporting face 66*f* (support face) is formed at a plate-shaped front face of the lever member 66 and an inclined face 66*k* is formed at a back face thereof. Then, a base end portion 66*a* of the lever member 66 is slidably supported as being fitted to the slide guide 67 which is formed at the apparatus frame F so as to perform reciprocation motion at a predetermined stroke between the operating position AP and the waiting position Wp.

To allow the lever member 66 to perform swing motion in addition to the linear motion at the predetermined stroke, a gap Ga is formed at the illustrated slide guide 67.

The gap Ga is for varying an angular posture of the lever member 66 between a state illustrated by a solid line in FIG. 19 (a first angular posture, an upward angular posture) and a state illustrated by a broken line (a friction posture, a downward posture).

Accordingly, when the gap Ga between the slide guide 67 and the lever member 66 is set large, angle difference between a first angle $\delta$ and a second angle $\epsilon$ becomes large. On the contrary, when the gap Ga is set small, the angle difference becomes small.

The rack 69 is formed at the back face side (a lower face side facing to a stacked sheet face) of the lever member 66. A driving pinion 71 which is connected to the lever operating motor LM is gear-connected to the rack 69. The lever operating motor LM is mounted on the apparatus frame F and is connected to the driving pinion 71 attached to the apparatus frame F via a reduction gear.

The driving pinion 71 is connected to a gear holder 72 so that a transmitting pinion 70 performs planetary motion within a predetermined angle range $\lambda$ (see FIG. 20) as a planet gear.

That is, as illustrated in FIG. 20, the gear holder 72 is rotatably supported by a rotary spindle 71*c* of the driving pinion 71 and the transmitting pinion 70 is rotatably axis-supported by the gear holder 72.

Accordingly, the transmitting pinion 70 receives rotation from the driving pinion 71 and transmits the rotation to the rack 69 of the lever member 66. Then, the transmitting pinion 70 rolls on the outer circumference of the driving pinion 71 as the planet gear.

An urging spring 73 which urges the lever member 66 to the first angle posture (state in FIG. 19A) is arranged at the gear holder 72. One end of the urging spring 73 is engaged with the gear holder 72 and the other end thereof is engaged with the apparatus frame F.

The urging spring 73 continuously urges the supporting member 66 to the first angle posture. The urging spring 73 is set to have spring pressure so that the tailing end supporting member 66 is moved from the first angle posture to the second angle posture owing to sheet bundle weight.

For example, the urging spring 73 is designed so that the spring pressure thereof is overcome by sheet weight applying at the sheet bundle tailing end with an average sheet size, average basis weight, and average bundle thickness.

The top end of the lever member 66 is formed into a shape to follow a face of a sheet stacked on the sheet placement tray 42. As FIG. 20 illustrates an enlarged state thereof, the inclined face at the lever top end is approximately in parallel to a sheet face angle of the upmost sheet tailing end.

That is, the inclined face 66*k* having a tapered shape is formed at the top end of the lever member 66. When the lever member 66 is in the first angle posture, the inclination angle is set to the first angle $\delta$ (a state of FIG. 19A) rising upward against the upmost sheet stacked on the sheet placement tray 42.

According to the above, when the lever member 66 enters the sheet placement tray 42 in the first angle posture, the upmost sheet is guided to an idling roller 66*r* along the inclined face 66*k* of the lever member 66 without being pushed out in the lever proceeding direction even if the upmost sheet is curled.

When the lever member 66 retracts from the sheet placement tray 42 in the second angle posture, the lever member 66 performs a function to draw the upmost sheet in the retracting direction owing to that the lever member 66 retracts at the inclination angle (second angle $\epsilon$; FIG. 19B) which is approximately the same as the angle of the sheet shape of the upmost stacked sheet. According to the inclination angle $\epsilon$, the height difference between the sheet bundle and the upmost sheet can be set minimum.

When the upmost sheet is moved in the lever retracting direction during retracting of the lever member 66, the sheet is regulated in position as the tailing end thereof being abutted to the tailing end regulating face 48*f* (fence plate).

Here, it is also possible to form the plate-shaped lever member 66 to have the same width as that of a sheet bundle in the width direction. However, when contact area with the sheet bundle increases, loads for the lever member 66 increase to proceed to and retract from the side above the sheet placement tray 42. Here, the function to maintain a tailing end of a sheet bundle above the upmost sheet face with engagement is less influenced by the width of the lever member 66.

That is, the width shape of the lever member 66 is determined in consideration of a friction load during proceeding to and retracting from the side above the sheet placement tray 42, the maintaining function to support a sheet bundle tailing end, and an efficiency in space. The plate-shaped lever members 66 are arranged at two positions laterally in the vicinity of a staple binding position as being distanced in the sheet bundle width direction.

Owing to supporting the vicinity of the staple binding position, even when swelling occurs at the staple binding position, contact between a sheet bundle and the staple binding position can be prevented and occurrence of scratches can be prevented. However, it is also possible to support a position being apart from the stapling portion in the sheet width direction.

In the illustrated case, the sheet holding unit 56 (frictional rotor 60) is arranged at the sheet center and a right-left pair of the lever members 66 are arranged at both sides with the same structure. Not limited to the plate-shaped member, the tailing end supporting member 66 may adopt a plate member having an appropriate shape to support a tailing end of a sheet bundle. Further, it is also possible to adopt arrangement at three or more positions along a sheet rear end edge.

[Operation of Tailing End Supporting Member]

Figure 21A:
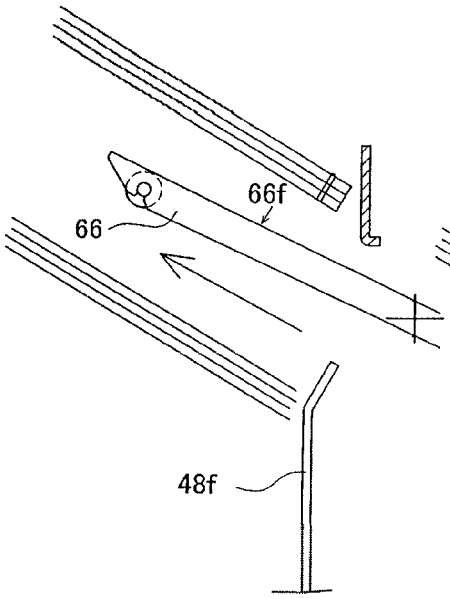

Operation of the tailing end supporting member 66 will be described with reference to FIGS. 21A to 21D. FIG. 21A illustrates a state that the tailing end supporting member 66 enters the sheet placement tray 42 and a sheet bundle drops from the tray sheet discharging port 13*b* at the upper side. In this state, the tailing end supporting member 66 proceeds to the side above the tray at the first angle δ (upward posture).

Here, even when the upmost sheet on the sheet placement tray warps with upward curling, the supporting member 66 proceeds to the side above the sheet placement tray 42 without collapsing sheet posture while the inclined face 66*k* introduces the curled sheet in the direction toward the idling roller.

Figure 21B:
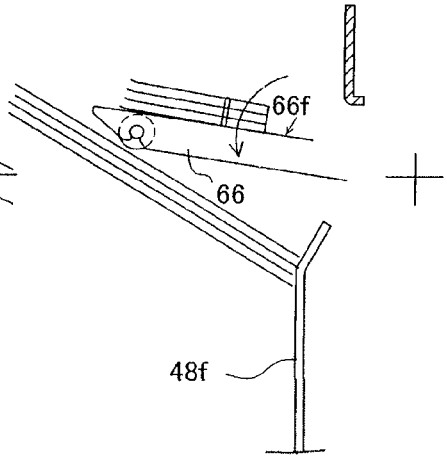
Figure 21C:
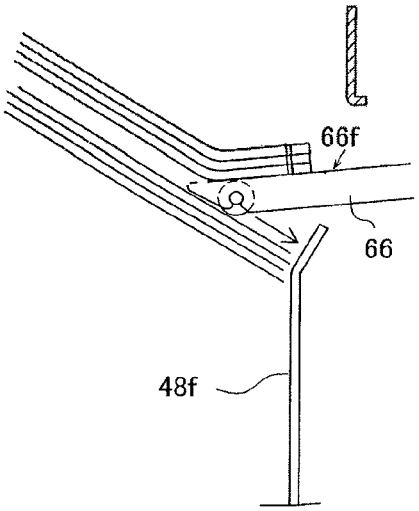

FIG. 21B illustrates a state that a sheet bundle drops on the supporting face 66*f* of the tailing end supporting member 66. The tailing end supporting member 66 is swung onto the upmost sheet with weight of the sheet bundle against the urging spring 73. At that time, the supporting face 66*f* is in the second angle posture at the angle ϵ. FIG. 21C illustrates a state that the tailing end supporting member 66 retracts from the operating position to the waiting position in the second angle posture. At that time, the inclined face 66*k* and the idling roller 66*r* at the top end of the tailing end supporting member 66 draw the upmost sheet stacked on the sheet placement tray 42 to be abutted to the tailing end regulating face 48*f*.

Figure 21D:
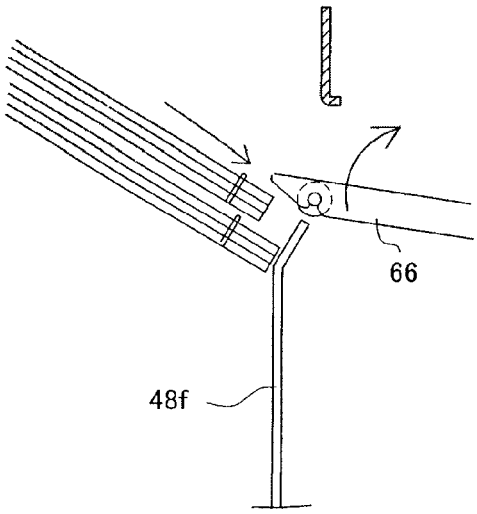

FIG. 21D illustrates a state that the tailing end supporting member 66 retracts from the tailing end regulating face 48*f* to the waiting position. At that time, the tailing end supporting member 66 returns from the second angle posture to the first angle posture. The reciprocating motion of the tailing end supporting member 66 between the waiting position and the operating position is performed with forward-reverse rotation of the lever operating motor LM.

[Different Path Configuration of a Duplex Path]

Figure 22:
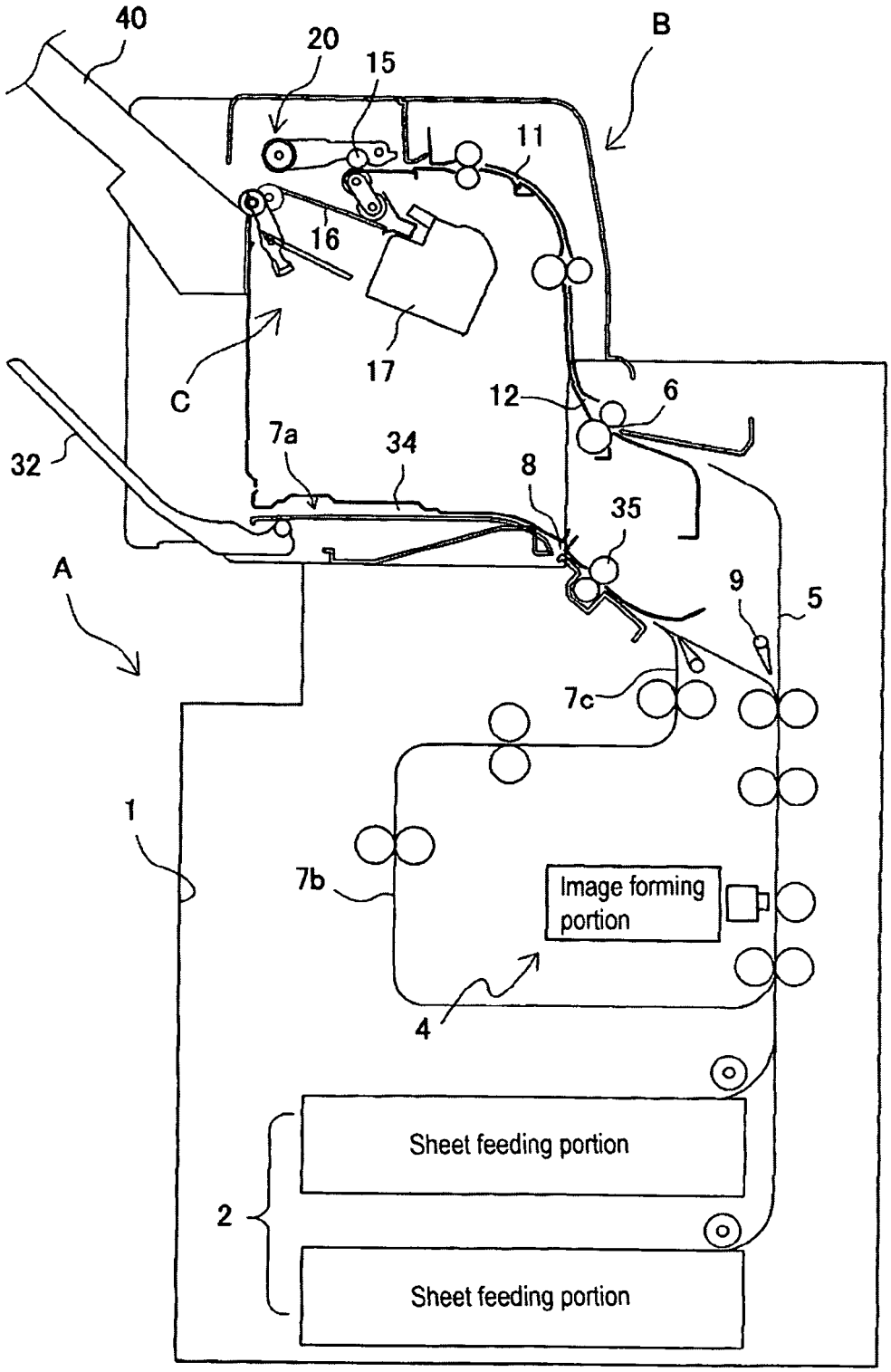
FIG. 22 is an overall view of a system having a path configuration (second embodiment) being different from a duplex path in FIG. 1

FIG. 22 illustrates a path configuration being different from the duplex path 7 in FIG. 1. In the above description of the duplex path 7, the switch-back path 7*a* is continuously arranged as diverging from the body sheet discharging path 5 and the U-turn path 7*b* is continuously arranged as diverging from the body sheet discharging path 5. With such a path configuration, a plurality of sheets cannot be simultaneously introduced and discharged on the body sheet discharging path 5 and the duplex path 7. To solve this problem, the apparatus in FIG. 22 adopts a duplex path 7 as described below.

As illustrated in FIG. 22, a body sheet discharging path 5 on which sheets are conveyed is formed from the image forming portion 4 to the body sheet discharging port 6. A switch-back path 7*a* is connected to the body sheet discharging path 5 via the path switching means 9. Similarly to the abovementioned configuration, the switch-back path 7*a* is configured to guide a sheet from the connecting port 8 to the linear path 34 and the guide tray 32 in the order thereof.

Then, the sheet re-fed into the image forming apparatus A is fed to a connecting path 7*c* which is separately formed from the body sheet discharging path 5. The U-turn path 7*b* is connected to the connecting path 7*c*, so that a sheet with the conveying direction thereof reversed on the switch-back path 7*a* is face-reversed on the U-turn path 7*b* and is re-fed to the image forming portion 4.

Since the connecting path 7*c* is formed separately from the body sheet discharging path 5, a sheet can be introduced from the switch-back path 7*a* to the image forming portion 4 simultaneously with timing when an image-formed sheet is discharged to the body sheet discharging port 6. Since the rest of the configuration is the same as the abovementioned embodiment, description thereof will not be repeated while providing the same references.

[Control Configuration]

Figure 23:
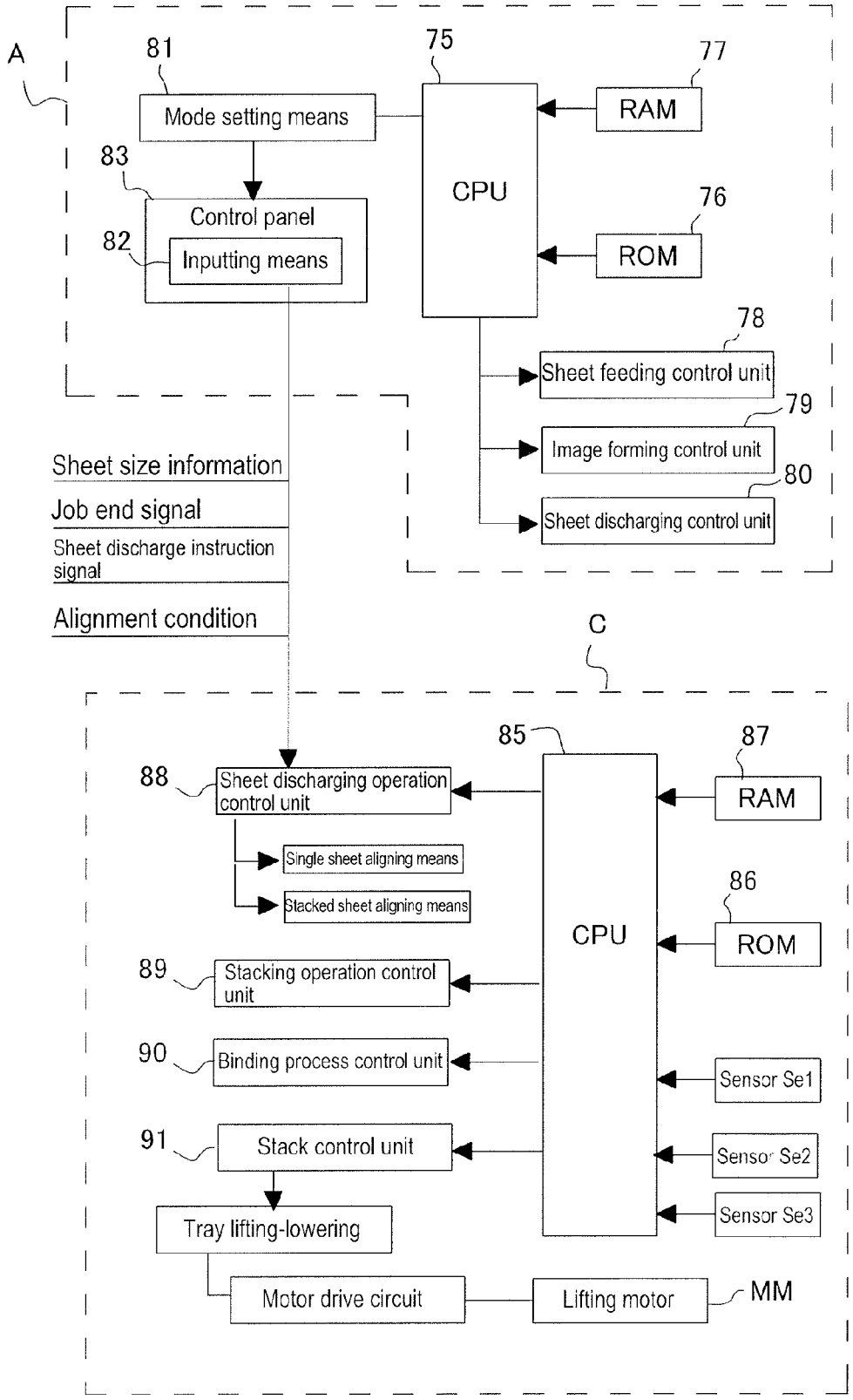
FIG. 23 is an explanatory view of a control configuration of an image forming system in FIG. 1.

A control configuration of the image forming system illustrated in FIG. 1 will be described with reference to FIG. 23. A control CPU 75 is arranged in the image forming apparatus A. The control CPU 75 is connected with a ROM 76 which stores an operational program and a RAM 77 which stores control data.

The control CPU 75 is provided with a sheet feeding control unit 78, an image forming control unit 79, and a sheet discharging control unit 80. Further, the control CPU 75 is connected with mode setting means 81 and a control panel 83 which includes inputting means 82.

Further, the control CPU 75 is configured to perform selection among a print-out mode, a jog mode, and a post-process mode. In the print-out mode, an image-formed sheet is stored at the stack tray 40 without performing a finishing process thereon. In jog mode, image-formed sheets are offset-stored at the stack tray 40 to be capable of being collated and sorted.

In the post-process mode, image-formed sheets are collated and stacked, and then, stored at the stack tray 40 after a binding process is performed thereon.

A post-process control CPU 85 is arranged in the post-processing apparatus B and is connected with a ROM 86 which stores a control program and a RAM 87 which stores control data.

The post-process control CPU 85 receives, from the control unit of the image forming apparatus A, sheet size information, a sheet discharge instruction signal, a mode setting command being the post-process mode and the print-out mode.

The post-process control CPU 85 is provided with a sheet discharging operation control unit 88, a stacking operation control unit 89 for collating and stacking sheets on the processing tray 16, a binding process control unit 90, and a stack control unit 91.

[Description of Operation]

The control CPU 75 of the image forming apparatus A performs a following image forming operation in accordance with an image forming program stored in the ROM 76. Similarly, the control CPU 85 of the post-processing apparatus B performs a following post-processing operation in accordance with a post-process program stored in the ROM 86.

[Image Forming Operation]

When a single print mode is selected, the control CPU 75 feeds out a sheet of a set size from a sheet feeding portion 2 and conveys the sheet to the sheet feeding path 3. Along with the above, the control CPU 75 forms an image at the image forming portion 4 in accordance with specific image data. The image data is stored in a data storing portion (not illustrated) or is transmitted from an external device which is connected to the image forming apparatus A.

When a duplex print mode is selected, after an image is formed on a front face of a sheet by performing the abovementioned operation, the control CPU 75 face-reverses the sheet in the duplex path 7 which is arranged continuously to the sheet discharging path, feeds the sheet again to the image forming portion 4, and then, feeds the sheet to the body sheet discharging path 5 after an image is formed on a back face of the sheet.

Next, the control CPU 85 of the post-processing apparatus B introduces the sheet fed to the body sheet discharging port 6 to the introducing port 12 of the sheet conveying path 11. At that time, the control CPU 85 receives a sheet discharge instruction signal from the image forming apparatus A and rotates the conveying rollers 14*a*, 14*b* on the conveying path in the sheet discharging direction.

The control means (post-process control CPU) 85 performs following sheet discharging operations in accordance with a program stored in the ROM 86 based on the post-process mode which is set at the image forming apparatus A. The illustrated control means 85 includes the first sheet discharge mode (print-out sheet discharge mode) and the second sheet discharge mode (post-process sheet discharge mode).

In the first sheet discharge mode, the sheet fed to the introducing port 12 is stored as being discharged to the stack tray 40 from the sheet conveying path 11. That is, the sheet fed from the sheet conveying path 11 is stored as being dropped through the tray sheet discharging port 13*b* directly to the stack tray 40 without being conveyed to the processing tray 16 by the reversing roller 20. In the first discharge mode, the straight sheet discharging operation and the jog sheet discharging operation are selectively performed.

According to the jog discharging operation, the sheet fed to the introducing port 12 is stored from the sheet conveying path 11 at the stack tray 40 in a state of being sorted and collated. During performing in this mode, the sheet placement tray 42 is moved by the cam member 50 integrally with the fence plate 48 by a predetermined amount in the sheet width direction as operating the abovementioned jog shifting motor GM.

According to the above, a series of sheets are stacked on the sheet placement tray 42 as being collated in the width direction. Then, upon receiving a job end signal from the image forming apparatus A, the control means 85 moves the sheet placement tray 42 to be returned to an initial position. Next, upon receiving an image forming signal and a sheet discharge instruction signal for a subsequent sheet, the control means 85 moves the sheet placement tray 42 by a predetermined amount in a direction opposite to the above.

In the second sheet discharge mode, the sheet fed to the introducing port 12 is stacked on the processing tray 16 from the sheet conveying path 11 and stored at the stack tray 40 after a binding process is performed. The sheet discharging operation in this mode is the same as described above.

[Sheet Discharging Operation]

Figure 24A:
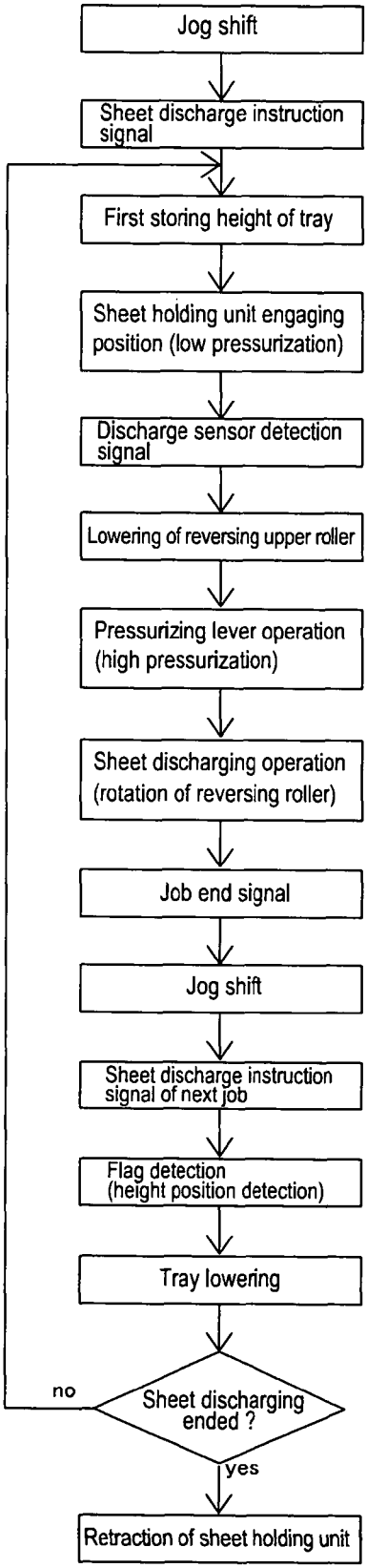
Figure 24B:
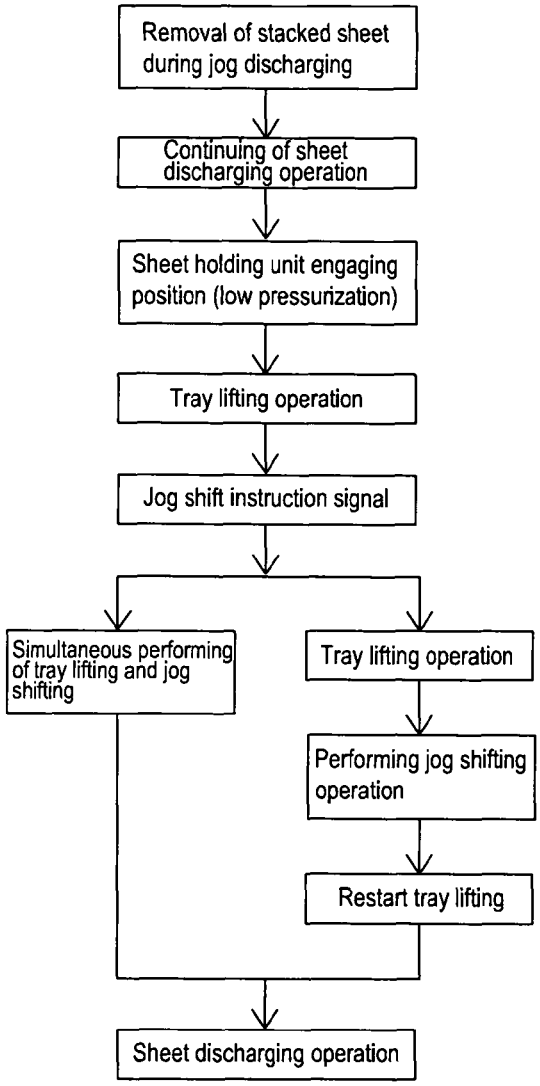

FIGS. 24A and 24B illustrate flow of the jog sheet discharging operation. Here, the sheet holding unit 56 rakes a sheet dropping through the tray sheet discharging port 13*b* at the upper side to be aligned to the tailing end regulating face 48*f* by the frictional rotor 60 in a state of pressing as engaging on the upmost sheet on the sheet placement tray 42 (first embodiment).

Alternatively, a sheet is stored as being dropped through the tray sheet discharging port 13*b* in a state that the sheet holding unit 56 is on standby at the waiting position outside the sheet placement tray 42, and then, a height level is detected at the same time when the sheet holding unit 56 presses the sheets as being engaged onto the upmost sheet at an interval before a subsequent sheet is introduced (second embodiment). Either of the abovementioned operations is selectively performed.

FIG. 24A illustrates sheet holding control to store a sheet as dropping the sheet through the tray sheet discharging port 13*b* onto the frictional rotor 60 of the sheet holding unit 56 in a state that the sheet holding unit 56 is engaged onto the upmost sheet on the sheet placement tray.

When the jog sheet discharging operation is set at the image forming apparatus A, the control means 85 of the post-processing apparatus B moves the sheet placement tray 42 with offsetting to a previously-set jog position. Here, the sheet placement tray 42 and the fence plate 48 are moved in the sheet width direction by the cam member 50 as rotating the jog shifting motor GM by a predetermined amount.

Next, the control means 85 moves the sheet placement tray 42 to the first storing height position H1. The height of the sheet placement tray 42 is controlled with a rotation amount of the winding motor MM while detecting a height position of the sheet holding unit 56 with the first to third sensors Lse1, Lse2, and Lse3.

After performing height position setting of sheet placement tray 42, the control means 85 moves the sheet holding unit 56 from the waiting position at the outside of the sheet placement tray 42 to the operating position at the inside thereof. This operation is performed with the abovementioned rotational angle adjustment of the sheet holding motor KM and position detection of the flags fr1, fr2, and fr3 by the first to third sensors Lse1, Lse2, and Lse3.

Here, when the sheet holding unit 56 is set at the first storing height position H1, a pressurization force of the frictional rotor 60 to press a stacked sheet face illustrated in FIG. 14B is set to be smaller than a pressurization force of FIG. 14C as being set at the second storing height position H2.

That is, FIG. 14B illustrates a state that the pressurizing spring 62 is not operating and FIG. 14C illustrates a state that the pressurizing spring 62 is operating.

Next, when the discharging sensor Se2 detects a sheet leading end, the reversing roller 20 is moved from the waiting position Wp to the operating position Ap after a predetermined amount of time. At that time, the lifting-lowering lever 30 is shifted to a pressurizing position by the lifting-lowering motor SM.

Then, at the reversing roller 20, the upper roller 21 and the lower roller 22 are pressure-contacted with the high pressurization force. Here, the large-diameter roller 21*a* and the small-diameter roller 21*b* are pressure-contacted to the lower roller 22. When the upper roller 21 is rotated in the sheet discharging direction in the above state, a sheet is discharged through the sheet discharging port 13 toward the sheet placement tray 42.

Next, when the control means 85 receives a job end signal from the image forming apparatus A, the jog shifting motor GM is rotated in the direction opposite to the above. Then, the sheet placement tray 42 is returned to the predetermined initial position. Upon receiving a sheet discharge instruction signal for the next job, height of the sheet placement tray 42 is detected by detecting flag positions of the sheet holding unit 56 with the first to third sensors LSe1, LSe2, and LSe3. Here, upon receiving the jog end signal, the sheet holding unit 56 is returned from the detecting position to the waiting position.

A subsequent sheet is stored in a state of offsetting against a preceding sheet by a predetermined amount in a direction perpendicular to the sheet discharging direction to be sorted for each bundle. During such a sheet discharging operation, there is a case that sheets on the sheet placement tray 42 are carelessly removed by an operator.

FIG. 24B illustrates an operation when sheets on the sheet placement tray 42 are carelessly removed. Regardless of careless sheet removing, the control means 85 continues the sheet discharging operation.

Then, height of the sheet placement tray 42 is detected at predetermined timing. When a sheet face on the sheet placement tray 42 is determined as being lower than a predetermined height position with the detecting operation, the control means 85 drives the winding motor MM to move the sheet placement tray 42 to the predetermined height position.

When a jog shift instruction signal is received from the image forming apparatus A during lifting of the sheet placement tray 42, the control means 85 causes the sheet placement tray 42 to move to a predetermined offset position after the lifting operation of the sheet placement tray 42 is stopped or in parallel to the lifting operation thereof.

In the case that the lifting operation is stopped, the control means 85 restarts the lifting operation of the sheet placement tray 42 after moving the sheet placement tray 42 to the predetermined offset position.

Next, an operation when the straight sheet discharging operation is selected in a post-process mode selection step of the image forming apparatus A will be described with reference to FIG. 25.

Figure 25:
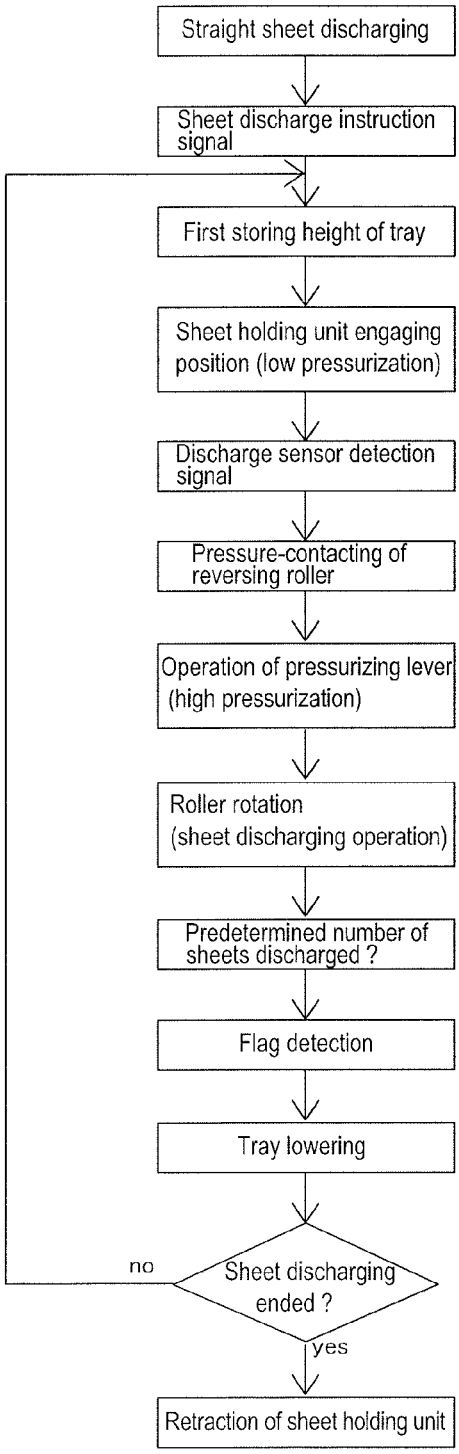
FIG. 25 is an explanatory view of operation flow of a straight sheet discharging operation to discharge sheets on the stack tray without sorting in the sheet discharge mode in which a sheet fed to a sheet discharging path is stored at the stack tray one by one.

When mode selection is performed as the straight sheet discharging operation, the operation is performed in accordance with FIG. 25. When the sheet discharge instruction signal is received from the image forming apparatus A, the control means 85 of the post-processing apparatus B moves the sheet face of the upmost sheet on the sheet placement tray 42 to the first storing height position H1. After the tray lifting operation, the control means 85 moves the sheet holding unit 56 from the waiting state to the low pressurization state.

Then, the reversing roller 20 is moved from a separated state to a pressure-contacted state with reference to a signal of a sheet leading end detected by the discharge sensor Se2. As the operation, the upper roller 21 is lowered toward the lower roller 22 and both the rollers are pressure-contacted at timing when the sheet leading end arrives at the roller position.

Here, the pressure-contact force of the rollers is set at the high pressurization force. The sheet fed to the tray sheet discharging port 13*b* is nipped between the upper roller 21 and the lower roller 22 and is discharged toward the sheet placement tray 42 at the downstream side.

Further, the control means 85 rotates the frictional rotor 60 of the sheet holding unit 56 in a predetermined direction (counterclockwise direction in FIG. 2). With the above operation, the sheet is conveyed toward the stack tray 40 through the tray sheet discharging port 13*b*, and then, drops onto the sheet placement tray 42 after a tailing end thereof passes through the tray sheet discharging port 13*b*. The leading end of the sheet is supported onto the upmost sheet stacked on the sheet placement tray 42 and the tailing end thereof drops onto the frictional rotor 60. At that time, since the frictional rotor 60 is rotated in the counterclockwise direction in FIG. 2, the tailing end side of the sheet is raked onto stacked sheets along the circumferential face of the frictional rotor 60 and is stacked thereon. Then, the tailing end edge of the sheet is aligned as being abutted to the tailing end regulating face 48*f*.

When sheets corresponding to the previously-set discharging times are stored on the sheet placement tray 42 by repeating the above operations, the control means 85 detects the height position of the sheet holding unit 56. Then, the sheet placement tray 42 is lowered by a predetermined amount in accordance with the detected height position.

When a job end signal is received from the image forming apparatus A after the above operations, the sheet holding unit 56 retracts to the waiting position and the flow is ended.

[Staple Binding]

Figure 26:
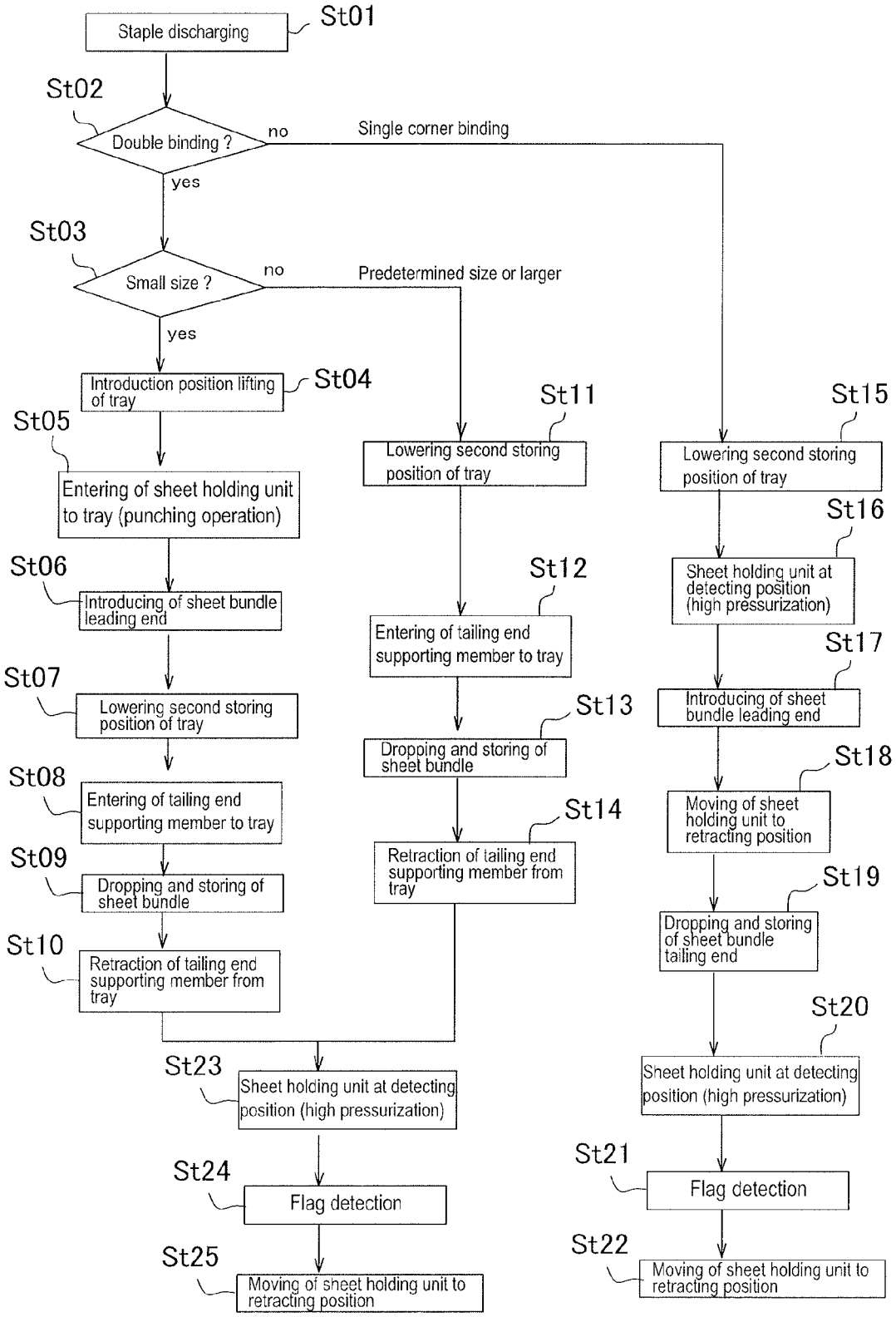
FIG. 26 is an explanatory view of operation flow of a staple discharge mode in which sheets fed from the sheet discharging path are collated and stacked and staple binding is performed thereon in a sheet discharge mode to store the sheets on the stack tray as sheet bundles.

Next, an operation when the second sheet discharge mode is selected in the post-process mode selection step of the image forming apparatus A will be described with reference to FIG. 26. When staple binding is selected as the post-process mode at the image forming apparatus A (St01), the illustrated apparatus is configured to select either double center binding or single corner binding (St02).

[Double Center Binding]

The staple unit 17 described above (hereinafter, also called post-processing means) is mounted on the apparatus frame F so as to be movable in the sheet width direction at the end edge of the processing tray 16. A staple shift motor (not illustrated) is connected to the staple unit 17. A first binding operation and a second binding operation are sequentially performed as equally distanced from the sheet center as moving the single staple unit 17. In the following, the above operation is simply called a binding operation.

When a job end signal is received from the image forming apparatus A, the control means 85 transmits a binding process command to the staple unit 17 after biasing and aligning a sheet bundle on the processing tray. Upon receiving this signal, the staple unit 17 performs the binding process on the sheet bundle on the processing tray.

Next, when a process end signal is received from the staple unit 17, the control means 85 discharges the sheet bundle on the processing tray toward the stack tray 40 at the downstream side. Before performing this operation, the control means 85 compares a length (size) of the sheet bundle in the sheet discharging direction (St03). This is for determining to set the height position of the sheet placement tray 42 whether at the second storing height position H2 or at a position higher than the second storing height position H2 (the first storing height position H1 in the illustrated apparatus).

That is, in the illustrated apparatus, in a case with a sheet bundle having a predetermined length or longer in the sheet discharging direction of the sheet bundle, the sheet discharging operation from start to end is performed while the tray height is set at the second storing height position H2. In a case with a sheet bundle having a length shorter than the predetermined length, the tray height is set to the first storing height position H1 at the beginning of sheet discharging and is set to the second storing height position H2 at the ending of the sheet discharging.

This is to prevent a short sheet bundle from being stored upside down when the sheet bundle is to be stored as dropping onto the tray with large height difference.

[Case of being Shorter than Predetermined Size]

When the sheet bundle having a binding process performed thereon at the processing tray 16 has a length in the sheet discharging direction shorter than the predetermined size, the control means 85 sets the tray height to be set to the second storing height position H2 in two steps in accordance with sheet discharging, that is, the tray height is set to the second storing height position H2 after being set to the first storing height position H1. Upon receiving the process end signal from the staple unit 17, the control means 85 performs positioning of the sheet placement tray 42 at the first storing height position H1 (St04).

Next, right after lifting the tray position to the first storing height position H1, the control means 85 causes the sheet holding unit 56 to perform swing motion in a predetermined angle from the waiting position to the detection position above the sheet placement tray 42 (St05, punching operation).

According to the above operation of moving the sheet holding unit 56 from the state of FIG. 14A to the state of FIG. 14B, that is, from the waiting position to the detecting position, sheet tailing end portion is pushed out toward the sheet placement tray 42 from the tailing end regulating face 48*f* by punching the end edge of the sheet stacked on the sheet placement tray 42 with the sheet holding unit 56 (frictional rotor 60). Accordingly, the sheet end edge is prevented from being caught on the tailing end regulating face 48*f* during the operation of lifting the sheet placement tray 42.

Here, the punching operation described above is not necessarily performed on sheets of all sizes with which the sheet placement tray 42 is lowered in steps. The punching operation is required to be performed on sheets having a relatively-ultrasmall size being a predetermined size such as a strip-shaped size.

As described above, when the length of the sheet bundle in the conveying direction to be conveyed from the processing tray 16 to the stack tray 40 is smaller than the predetermined size, the control means 85 lowers the height position of the sheet placement tray 42 in two steps in accordance with sheet discharging timing, that is, the tray height is lowered to the second storing height position H2 after being lowered to the first storing height position H1 (St06, St07).

Then, after the height of the sheet placement tray 42 is set to the second storing height position H2, the control means 85 causes the tailing end supporting member 66 to proceed to the side above the sheet placement tray 42 from the waiting position (St08). Next, when the sheet bundle drops on the tailing end supporting member 66, the tailing end supporting member 66 shifts from the first angle posture to the second angle posture (St09).

Next, the control means 85 moves the tailing end supporting member 66 to retract from the operating position at the upper side of the sheet placement tray 42 to the waiting position at the outside thereof (St10).

Accordingly, the sheet bundle dropped through the discharging port 13 is stored on the upmost sheet on the sheet placement tray 42.

Next, the control means 85 moves the sheet holding unit 56 from the waiting position onto the upmost sheet on the sheet placement tray 42. The pressurization force at that time is set to the high pressurization force, so that the frictional rotor 60 of the sheet holding unit 56 is pressure-contacted to the sheet bundle with the high pressurization force (St23).

Then, the control means 85 detects the height position of the sheet holding unit 56 with the first to third flags fr1, fr2, and fr3 and the first to third sensors Lse1, Lse2, and Lse3 (St24). After detecting the height position, the control means 85 moves the sheet holding unit 56 to the waiting position (St25), and along with the above, the control means 85 lowers the sheet placement tray 42 by a predetermined amount.

[Case of being Predetermined Size or Longer]

When the sheet bundle having a binding process performed thereon at the processing tray 16 has a length in the sheet discharging direction being the predetermined side or longer, the control means 85 sets the height of the sheet placement tray 42 at the second storing height position H2 (St11). After the setting of the tray height, the control means 85 causes the tailing end supporting member 66 to proceed to the side above the sheet placement tray 42 from the waiting position (St12).

Next, when the sheet bundle drops on the tailing end supporting member 66, the tailing end supporting member 66 shifts from the first angle posture to the second angle posture (St13). Next, the control means 85 moves the tailing end supporting member 66 to retract from the operating position at the upper side of the sheet placement tray 42 to the waiting position at the outside thereof (St14). Accordingly, the sheet bundle dropped through the tray sheet discharging port 13*b* is stored on the upmost sheet on the sheet placement tray 42.

Next, the control means 85 moves the sheet holding unit 56 from the waiting position onto the upmost sheet on the sheet placement tray 42. The pressurization force at that time is set at the high pressurization force, so that the frictional rotor 60 of the sheet holding unit 56 is pressure-contacted to the sheet bundle with the high pressurization force (St23).

Then, the control means 85 detects the height position of the sheet holding unit 56 with the first to third flags fr1, fr2, and fr3 and the first to third sensors Lse1, Lse2, and Lse3 (St24). After detecting the height position, the control means 85 moves the sheet holding unit 56 to the waiting position (St25), and along with the above, the control means 85 lowered the sheet placement tray 42 by a predetermined amount.

[Single Corner Binding]

When the second sheet discharge mode and the single corner binding operation are specified with a mode setting signal from the image forming apparatus A, the control means 85 performs following operations.

When a job end signal is received from the image forming apparatus A, the control means 85 causes the staple unit 17 to move to the binding position (sheet corner) and to perform a binding operation after biasing and aligning a sheet bundle on the processing tray. When a process end signal is received from the staple unit 17, the control means 85 discharges the sheet bundle on the processing tray toward the stack tray 40 at the downstream side.

Before performing the sheet bundle discharging operation, the control means 85 moves the sheet placement tray 42 to the second storing height position H2 (St15). The control means 85 moves the sheet holding unit 56 from the waiting position onto the upmost sheet on the sheet placement tray 42 (detecting position). The pressurization force at that time is set to the high pressurization force and a rotational force is not applied to the frictional rotor 60 (St16).

Next, the control means 85 causes the reversing roller 20 to rotate in the sheet discharging direction, so that the sheet bundle is discharged as being slid on the upmost sheet on the sheet placement tray 42 from the leading end thereof (St17). Here, since the stacked sheet layers (stored sheet bundles) are pressed by the sheet holding unit 56, stacked sheets are not to be moved with a conveyance force of the sheet introduced through the tray sheet discharging port 13*b*.

In particular, when a sheet bundle is pushed out from the processing tray 16 with a strong frictional engagement force onto a corner-bound sheet bundle on the sheet placement tray 42, there is a case that a tear occurs at a portion around a staple needle end. However, since the upmost sheet bundle is supported as being pressed by the sheet holding unit 56, such a problem will not occur.

Next, the control means 85 detects the height position of the sheet holding unit 56 with the first to third flags fr1, fr2, and fr3 and the first to third sensors Lse1, Lse2, and Lse3 (St21). After detecting the height position, the control means 85 moves the sheet holding unit 56 to the waiting position (St22), and along with the above, the control means 85 lowers the sheet placement tray 42 by a predetermined amount.

Incidentally, the present application claims priorities from Japanese Patent Application No. 2012-191418, Japanese Patent Application No. 2012-191420 and Japanese Patent Application No. 2012-233228, the contents of which are incorporated herein by reference.

What is claimed is:

1. A sheet storing apparatus, comprising:

a sheet discharging path including a sheet discharging port;

a processing tray on which a binding process with collating and stacking is performed on sheets fed through the sheet discharging port;

a stack tray including a sheet placement face on which sheets fed through the sheet discharging port or a sheet bundle fed from the processing tray are stacked and stored;

tray lifting-lowering means which lifts and lowers the sheet placement face of the stack tray in a sheet stacking direction;

sheet holding means which presses an upmost sheet on the stack tray;

a level sensor which detects a height position of the upmost sheet on the stack tray in a state that a pressurization force of the sheet holding means is applied; and control means which controls the tray lifting-lowering means, the sheet holding means, and sheet conveyance from the sheet discharging path to the stack tray, the control means provides a first sheet discharge mode in which a sheet is discharged from the sheet discharging path to the stack tray without a post-process performed thereon and a second sheet discharge mode in which a binding-processed sheet bundle is discharged from the processing tray to the stack tray, the sheet holding means includes a sheet pressurizing member which is movable between an operating position engaging with a sheet on the sheet placement face and a retracting position retracting from a side above the sheet placement face, sheet hold shifting means which reciprocates the sheet pressurizing member between the operating position and the retracting position, and pressurizing means which applies a pressurization force to the sheet pressurizing member selecting from two or more different pressurization forces, and the control means controls the pressurizing means so that a pressurization force in the second sheet discharge mode is larger than a pressurization force in the first sheet discharge mode when the sheet pressurizing member presses the upmost sheet on the sheet placement face.

2. The sheet storing apparatus according to claim 1, wherein the pressurizing means includes an urging spring which applies an elastic force to the sheet pressurizing member in a sheet pressurizing direction, and pressurization switching means which adjusts the elastic force of the urging spring.

3. The sheet storing apparatus according to claim 2, wherein the sheet pressurizing member is arranged at a leading end portion of an arm member with a base end portion thereof being axially supported by an apparatus frame in a swingable manner, the sheet hold shifting means which reciprocates the sheet pressurizing member between the operating position and the retracting position is connected to the arm member, and the sheet hold shifting means includes a pressurizing lever which is swung with rotation of a drive motor, and the urging spring which is arranged between the pressurizing lever and the arm member.

4. The sheet storing apparatus according to claim 1, wherein the stack tray is provided with a tailing end regulating face which regulates a position of a tailing end of a sheet stacked on the sheet placement face, the sheet pressurizing member is provided with a frictional rotor which engages with an upmost sheet on the sheet placement face, and transmitting means which applies a rotation force to the frictional rotor, and rotation is transmitted to the frictional rotor to apply a conveyance force causing the upmost sheet stacked on the sheet placement face to proceed to the tailing end regulating face.

5. The sheet storing apparatus according to claim 1, wherein the sheet pressurizing member is configured to be swingable among a first angle position where the sheet pressurizing member retracts from a side above the sheet placement face, a second angle position where the sheet pressurizing member presses an end face of a sheet stacked on the sheet placement face, a third angle position where the sheet pressurizing member presses an upmost sheet on the sheet placement face from a side thereabove with a first pressurization force, and a fourth angle position where the sheet pressurizing member presses an upmost sheet on the sheet placement face from a side thereabove with a second pressurization force, and the first pressurization force is set smaller than a second pressurization force.

6. The sheet storing apparatus according to claim 5, wherein the second angle position where the sheet pressurizing member presses a sheet end face and the third angle position where the sheet pressurizing member presses the upmost sheet with the first pressurization force are set at the same angle.

7. The sheet storing apparatus according to claim 5, wherein the sheet pressurizing member is arranged at the leading end portion of the arm member with the base end portion thereof being axially supported by the apparatus frame in a swingable manner, and the first angle position, the second angle position, the third angle position, and the fourth angle position are angularly set in order thereof in a rotating direction of the arm member.

8. The sheet storing apparatus according to claim 1, wherein the control means controls the sheet holding means so that the sheet pressurizing member presses an upmost sheet on the sheet placement face with a first pressurization force during performing the first discharge mode and so that the sheet pressurizing member presses an upmost sheet on the sheet placement face with the first or a second pressurization force during performing the second discharge mode.

9. The sheet storing apparatus according to claim 1, wherein the stack tray is provided with jog shifting means which offsets the sheet placement face of the stack tray by a predetermined amount in a direction being perpendicular to a sheet-discharging direction, the control means which controls the tray lifting-lowering means and the jog shifting means, sheet holding means which presses an upmost sheet stacked on the sheet placement face, and pressurization switching means which adjusts a sheet pressurization force of the sheet holding means to be increased and decreased, the control means is configured to perform an operation to lift the stack tray to a predetermined height position when an upmost sheet on the sheet placement face is detected as being below the predetermined height position by the level sensor and a jog shifting operation to offset the sheet placement face by a predetermined amount by the jog shifting means when an instruction signal to offset the sheet placement face is received, and the control means is configured to perform the jog shifting operation of the sheet placement face preferentially to or simultaneously with the tray lifting operation when an offset instruction signal is received during operation to lift the stack tray to the predetermined height position.

10. The sheet storing apparatus according to claim 9, wherein the control means is configured to perform the first sheet discharge mode in which a single sheet is stored on the stack tray through the sheet discharging port and the second sheet discharge mode in which a sheet bundle is stored on the stack tray from the processing tray, and the pressurization switching means sets the sheet pressurization force to be low in the first sheet discharge mode and to be high in the second sheet discharge mode.

11. The sheet storing apparatus according to claim 10, wherein the control means is configured to be capable of selecting whether or not the jog shifting means is caused to perform the jog shifting operation to offset the sheet placement face by a predetermined amount during performing the first sheet discharge mode.

12. The sheet storing apparatus according to claim 9, wherein the stack tray is provided with the sheet placement face on which sheets are stacked, a tailing end regulating face which regulates a position of a sheet tailing end, and the tray lifting-lowering means which lifts and lowers the sheet placement face along the tailing end regulating face, the sheet placement face and the tailing end regulating face are supported by an apparatus frame as being movable to be offset in a direction perpendicular to a sheet discharging direction of a sheet fed through the sheet discharging port, and the sheet placement face and the tailing end regulating face are moved integrally by a shift cam arranged at the apparatus frame.

13. An image forming system which includes the sheet storing apparatus according to claim 1, comprising:

an image forming unit which includes a sheet feeding portion, an image forming portion, and a sheet discharging portion;

a post-processing unit which temporarily stores a sheet fed from the sheet discharging portion at a processing tray, and thereafter, stores the sheet at a stack tray, and a duplex path on which a sheet with an image formed on one face thereof by the image forming portion is re-fed to the image forming portion after being face-reversed, wherein the duplex path includes a switch-back path on which a conveying direction of a sheet fed from the sheet discharging portion is reversed, and a U-turn path on which the sheet is face-reversed as being connected to the switch-back path, the switch-back path includes a linear path which is connected to the sheet discharging portion as being arranged below the processing tray, and a guide tray which includes a supporting face of a sheet as being connected to the linear path and arranged below the stack tray, the stack tray and the guide tray are arranged so that the sheet placement face is formed to have a first inclination angle being an acute angle with reference to a regulating face of the stack tray and the supporting face is formed to have a second inclination angle and a third inclination angle being acute angles, the second inclination angle and the third inclination angle are continuously formed in the order thereof from the upstream side of the regulating face, and the second inclination angle is formed to be gentler than the first inclination angle and the third inclination angle is formed shaper than the second inclination angle.

14. The image forming system according to claim 13, wherein the second inclination angle and the third inclination angle are continuously formed in the order thereof from the regulating face, the second inclination angle is formed gentler than the first inclination angle and the third inclination angle is formed sharper than the first inclination angle, and the third inclination angle, the first inclination angle, and the second inclination angle are formed in ascending order respectively with reference to the regulating face.

15. The image forming system according to claim 14, wherein the post-processing unit includes a unit housing, the processing tray and the stack tray which are arranged at the unit housing, and a post-processing path on which a sheet fed from the sheet discharging portion is conveyed to the processing tray, the liner path and the guide tray are arranged at the unit housing, and the unit housing is supported by the image forming unit.

16. The image forming system according to claim 14, wherein the guide tray includes a curved face which is formed to have the second inclination angle and the third inclination angle continuing therefrom.

17. The image forming system according to claim 14, wherein the guide tray is axially supported in a rotatable manner so that the second inclination angle and third inclination angle are enlarged from acute angles to obtuse angles, and urging means is arranged to urge the second inclination angle and third inclination angle toward acute angles.

18. The image forming system according to claim 17, wherein a rotation support of the guide tray is located at a side toward the linear path from the regulating face.

* * * * *